US007031230B1

(12) United States Patent
Nagasaka et al.

(10) Patent No.: US 7,031,230 B1
(45) Date of Patent: Apr. 18, 2006

(54) STARTER FOR ELECTRICMAGNETIC CONVERTER, AND TIMEPIECE

(75) Inventors: Eiichi Nagasaka, Minowa-machi (JP); Osamu Takahashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/674,868

(22) PCT Filed: Mar. 8, 2000

(86) PCT No.: PCT/JP00/01411

§ 371 (c)(1),
(2), (4) Date: Jan. 3, 2001

(87) PCT Pub. No.: WO00/54113

PCT Pub. Date: Sep. 14, 2000

(30) Foreign Application Priority Data

Mar. 8, 1999 (JP) ..... 11-060464
Jul. 2, 1999 (JP) ..... 11-189038

(51) Int. Cl.
*G04B 1/00* (2006.01)

(52) U.S. Cl. ..... 368/204

(58) Field of Classification Search ..... 368/76, 368/203, 204, 155, 139; 318/255, 430, 431; 310/80, 113
See application file for complete search history.

(56) References Cited

U.S. PATENT DOCUMENTS 1,986,498 A 1/1935 Browning
3,579,974 A * 5/1971 Schmidt ..... 368/157
4,939,707 A * 7/1990 Nagao ..... 368/64
5,923,619 A * 7/1999 Knapen et al. ..... 368/64
6,441,516 B1 * 8/2002 Kaelin et al. ..... 310/36
6,483,276 B1 * 11/2002 Shimizu et al. ..... 322/24

FOREIGN PATENT DOCUMENTS

| | | |
|---|---|---|
| GB | 384441 | 12/1932 |
| JP | 38-16662 | 9/1963 |
| JP | 48-36878-01 | 5/1973 |
| JP | 51-133064 | 11/1976 |
| JP | 52-25776 | 2/1977 |
| JP | 52-87068 | 7/1977 |
| JP | 52-104970 | 9/1977 |
| JP | 53-42773 | 4/1978 |
| JP | 53-62573 | 6/1978 |
| JP | 56-44222 | 10/1981 |
| JP | 58-7358 | 2/1983 |
| JP | 56-171112 | 5/1983 |

(Continued)

*Primary Examiner*—Kamand Cuneo
*Assistant Examiner*—Jeanne-Marguerite Goodwin
(74) *Attorney, Agent, or Firm*—Michael T. Gabrik

(57) ABSTRACT

A starter which applies a mechanical rotating force to a rotor of an electromagnetic converter, such as a power generator, for startup of the rotor. The starter includes a startup spring (60) having an engaging portion (63) engageable with a *6th* pinion (11*a*) of a wheel train coupled to the power generator. In interlock with the operation of pulling out a crown, a reset lever (70) is operated to bias the startup spring for engagement with the *6th* pinion. Thereafter, the startup spring is released from the biased state in interlock with the operation of pushing in the crown. The startup spring is returned to the original position due to its own spring force, whereupon a mechanical rotating force is applied to the pinion. Since the rotating force can be set by a resilient force of only the startup spring, a stable rotating force is applied to the rotor (12).

7 Claims, 33 Drawing Sheets

FOREIGN PATENT DOCUMENTS

| | | |
|---|---|---|
| JP | 58-76171 | 5/1983 |
| JP | 3-251071 | 11/1991 |
| JP | 5-38262 | 9/1993 |
| JP | 8-5758 | 1/1996 |
| JP | 10-66326 | 3/1998 |
| JP | 11-14767 | 1/1999 |
| JP | 11 014768 | 1/1999 |
| JP | 11-14768 | 1/1999 |
| JP | 11-30676 | 2/1999 |

* cited by examiner (A)

(B)

STARTER FOR ELECTRICMAGNETIC CONVERTER, AND TIMEPIECE

TECHNICAL FIELD

The present invention relates to a starter for an electromagnetic converter such as a power generator or a motor, and a timepiece, such as a wristwatch, including the starter.

BACKGROUND ART

Japanese Unexamined Patent Application Publication No. 8-5758 discloses one of known electronically controlled mechanical watches wherein hands fixed to a wheel train are precisely driven to indicate the time of day right by converting mechanical energy produced upon unwinding of a mainspring into electrical energy with a power generator, operating a rotation controller with the electrical energy, and then controlling a current value flowing through a coil of the power generator.

In operation of the above watch, the electrical energy produced from the power generator is once supplied to a smoothing capacitor, and the rotation controller is driven with power from the capacitor. However, because an AC electromotive force is always inputted to the capacitor in synch with the cycle of rotation of the power generator, it is not required to, for a long time, hold power for enabling the operation of the rotation controller which includes an IC and a quartz oscillator. Therefore, a capacitor having a comparatively small electrostatic capacity just enough to operate the IC and the quartz oscillator for a time as short as several seconds has been employed in the past.

The above electronically controlled mechanical watch is featured in that, because the hands are driven by using the mainspring as a power source, a motor is not required, thus resulting in the less number of parts and a lower cost. In addition, power generation is only needed to produce slight electrical energy necessary to operate an electronic circuit, and the watch can be operated with small input energy.

However, the above electronically controlled mechanical watch has problems as follows. When setting the hands right (or setting the watch to the correct time) by pulling out a crown, all of hour, minute and second hands have been usually stopped so that the watch can be set to the correct time. For stopping the hands, the wheel train is stopped and, to this end, the power generator is also stopped.

To continue driving of the IC while stopping the supply of the electromotive force from the power generator to the smoothing capacitor, therefore, charges accumulated in the capacitor are discharged to the IC side and the terminal voltage of the capacitor is lowered. As a result, the rotation controller is also brought into a stop.

Accordingly, when the driving of the power generator is restarted by pushing in the crown after setting the hands right, it takes a time to accumulate charges in the capacitor to such an extent that the terminal voltage of the capacitor reaches an IC driving start voltage (i.e., a voltage at which the IC can start driving). At the start of driving of the power generator, the power generator produces a small electromotive force when its rotational speed is slow, and a large electromotive force when its rotational speed is fast. This means that the rotational speed of the power generator must be quickly increased at the startup. However, because the power generator and the associated driving mechanism have their own inertia, it takes a time for the power generator to transit from a stopped state to an ordinary driving (rotating) state due to the inertia. Where an inertia plate is provided on a rotor of the power generator, particularly, the rotor gradually increases a rotational speed at the startup of the power generator. Accordingly, when the rotor starts rotation, a large torque is required and it takes a time until the rotational speed increases to a sufficient value. As a result, the amount of power produced by the power generator is small in an initial stage of the startup of the power generator, and charging takes a time until the terminal voltage of the capacitor reaches the IC driving start voltage. Stated otherwise, a problem has been experienced in that a certain period of time is needed from the start of driving of the power generator to the start of operation of the IC, and precise time control cannot be made during that period of time.

In view of the above problem, as disclosed in Japanese Unexamined Patent Application Publication No. 11-14768, the applicant has invented a method which can rotate a rotor at an increased speed and quickly increase the amount of generated power as soon as the startup, thereby shortening a time required for charging. According to this method, a driving lever is held in contact with a gear of the wheel train and is departed away from the gear with the operation of pushing in the crown after setting the hands right, so that the rotor is rotated by a mechanical rotating force imposed on the gear due to a frictional force produced upon the departing of the driving lever.

In the above invention, however, the driving lever applies a mechanical rotating force to the gear with a frictional force, thus resulting in a problem that it is difficult to efficiently apply the rotating force with stability. Such a problem is not limited to a power generator, but occurs likewise when a mechanical rotating force is applied to a motor gear with a frictional force using a driving lever. In other words, the above problem is in common to any cases where a driving lever is provided to impose a rotating force on a gear of mechanical energy transmitting means, such as a rotor or a train wheel for driving the rotor, in electromagnetic converters including power generators or motors.

A first object of the present invention is to provide a starter for an electromagnetic converter and a timepiece, which enable a mechanical rotating force to be efficiently applied to a rotor or mechanical energy transmitting means with stability.

Further, in the invention disclosed in the above-cited Japanese Unexamined Patent Application Publication No. 11-14768, the mechanical rotating force applied by the driving lever needs to be set based on balance between a resilient force of an abutment portion coming into direct contact with the gear and a resilient force of a member for returning the abutment portion to its original position. This has raised a problem that a difficulty in setting of the rotating force makes it hard to apply a stable rotating force. In practice, if a return spring is too strong, a sufficient rotating torque cannot be applied because the spring causes the abutment lever to depart away from the gear before the startup. Conversely, if the return spring is too weak, the abutment lever is brought into contact with the gear upon an impact or the like.

A second object of the present invention is to provide a starter for an electromagnetic converter and a timepiece, which enable a mechanical rotating force to be applied to a rotor or mechanical energy transmitting means with higher stability.

Another problem in the case of applying a mechanical rotating force to a gear resides in efficiency.

More specifically, an appropriate rotational speed of the rotor is in the range of about 5–10 Hz, taking into account such conditions that the rotor can rotate with stability, and air resistance and viscosity resistance will not become too large. Also, from the standpoint of stability in rotation, an inertia disk is required as described above. The inertia disk is made of brass, for example, and its appropriate size is given by an outer diameter of about 6 mm and a thickness of about 0.2 mm in consideration of both the strength of a rotor shaft against an impact in the event of falling. Additionally, for the purposes of increasing inertial moment and reducing weight, radially arranged holes each having a diameter of about 5 mm are usually formed in the inertia disk.

Inertial moment I1 of a rotor provided with such an inertia disk is given, for example, by the following formula (1):

$$I_1=1.1\times10^{-10}\ \mathrm{kgm}^2 \tag{1}$$

Accordingly, kinetic energy $E_1$ is given by the following formula (2):

$$\begin{aligned} E_1 &= \frac{1}{2}\times1.1\times10^{-10}\times(2\pi)^2\times(5^2\sim10^2 \\ &= 5.4\times10^{-8}\sim2.2\times10^{-7}[J] \end{aligned} \tag{2}$$

On the other hand, the driving lever is made of phosphor bronze suitable for springs, and its sectional secondary moment $I_2$ is determined by the following formula (3) on an assumption of thickness h=0.2 mm, width b=0.2 mm and length 1=0.5 mm:

$$I_2 = \frac{bh^3}{12} = \frac{0.2\times0.2^3}{12} = 1.3\times10^{-4}[\mathrm{mm}^4 \tag{3}$$

Also, a deflection y of a spring in a cantilevered state is expressed by the following formula (4);

$$y = \frac{wl^3}{3EI_2} \tag{4}$$

where w is a spring force and E is the Young's modulus.

From the above formula (4), the spring force w is determined as expressed by the following formula (5):

$$\begin{aligned} w &= \frac{y\times3EI_2}{l^3} \\ &= \frac{0.2\times3\times10000\times1.3\times10^{-4}}{5^3} \\ &= 6.2\times10^{-3}[kg] \end{aligned} \tag{5}$$

Accordingly, spring energy $E_2$ is determined by the following formula (6):

Energy efficiency η in rotating the rotor by a spring is calculated as given in the following formula (7) and η=1–4% is resulted:

$$\begin{aligned} \eta &= \frac{E_1}{E_2} = \frac{(0.54\sim2.2)\times10^{-7}}{6.1\times10^{-6}} \\ &= 0.01\sim0.036 \\ &= 1\sim4[\%] \end{aligned} \tag{7}$$

It is very difficult to output energy at such a low efficiency of not more than 5% with stability. Even a slight variation in efficiency leads to a large variation in initial speed of the gear determined by the mechanical rotating force transmitted to the same. This has raised a problem of difficulty in rotating the gear with stability.

A third object of the present invention is to provide a starter for an electromagnetic converter and a timepiece, which can improve efficiency of a startup spring for applying a mechanical rotating force to a rotor or mechanical energy transmitting means.

Moreover, another problem of the above-cited invention has been encountered in that it is difficult to correctly set the time with high accuracy because the rotational speed of the sped-up rotor does not become stable unless the rotating force applied to the gear of the wheel train is controlled by the driving lever with high accuracy.

Stated otherwise, until the IC starts driving, a time lapsed from the start of rotation of the rotor, for example, cannot be detected. For this reason, an error in setting of the correct time must be canceled by adding a preset compensation value.

However, unless the rotation of the rotor is stable, a time lapsed until the start of driving of the IC is also varied. This has raised a problem that the correct time cannot be set even with compensation using a preset value, thus resulting in a difficulty in setting the time right with high accuracy.

Further, in order to keep constant the rotating force produced by the driving lever, a deflection of the driving lever, for example, must be controlled with high accuracy. This necessity has raised still another problem that, although such a parameter can be easily managed up to accuracy enough for ordinary uses, the parameter is difficult to manage at accuracy higher than such a level.

A fourth object of the present invention is to provide a starter for an electromagnetic converter and a timepiece, which can easily stabilize a rotational speed of a rotor.

DISCLOSURE OF INVENTION

The invention according to claim 1 resides in a starter for an electromagnetic converter comprising at least a rotor and mechanical energy transmitting means, which is constituted by a wheel train made up of a plurality of gears and transmits mechanical energy to and from the rotor, thereby converting one of mechanical energy and electrical energy into the other, wherein the starter includes a startup member which has an engaging portion capable of mechanically engaging with an engaged portion of a rotation target gear provided in the mechanical energy transmitting means, and which moves the engaging portion in response to operation of an external operating member for applying a rotating force to the rotation target gear, while the engaging portion is in engagement with the engaged portion, whereby the rotor is rotated.

With the invention having those features, the startup member is employed which has the engaging portion capable of mechanically engaging with the rotation target gear of the mechanical energy transmitting means. As compared with a conventional starter utilizing a frictional force, therefore, a mechanical rotating force can be more efficiently applied to the rotation target gear with higher stability. The above first object is thus achieved.

The invention according to claim 2 resides in a starter for an electromagnetic converter comprising at least a rotor and mechanical energy transmitting means, which is constituted by a wheel train made up of a plurality of gears and transmits mechanical energy to and from the rotor, thereby converting one of mechanical energy and electrical energy into the other, wherein the starter includes a startup member which has an engaging portion capable of engaging with a rotation target gear provided in the mechanical energy transmitting means, and which moves the engaging portion substantially in the tangential direction of the rotation target gear in response to operation of an external operating member for applying a rotating force to the rotation target gear, whereby the rotor is rotated.

By moving the engaging portion of the startup member substantially in the tangential direction of the rotation target gear, the direction in which the rotating force is applied to the gear and the rotating direction of the gear are aligned with each other. Therefore, the improved efficiency can be obtained and the gear can be efficiently rotated with stability. The above third object is thus achieved.

In the present invention, the term "substantially in the tangential direction" represents not only exactly the same direction as the tangential direction, but also a certain range of directions deviated from the tangential direction. In other words, even when the direction of applying the rotating force is inclined from the tangential direction with an angle (frictional angle) corresponding to the coefficient of friction in a contact area (between the rotation target gear and the startup member), the range of such an inclination is included in the term "substantially in the tangential direction". This is similarly applied to the case where the engaging portion of the startup member is moved substantially in the tangential direction of the pinion or the rotor as described later.

The invention according to claim 3 resides in a starter for an electromagnetic converter comprising at least a rotor and mechanical energy transmitting means, which is constituted by a wheel train made up of a plurality of gears and transmits mechanical energy to and from the rotor, thereby converting one of mechanical energy and electrical energy into the other, wherein the starter includes a startup member for, in response to operation of an external operating member, applying a rotating force to a pinion of a gear in the mechanical energy transmitting means, the gear being located just one step before the rotor, whereby the rotor is rotated.

Because of the pinion having a small diameter, the amount by which the startup spring engages with the pinion in the longitudinal direction of the spring can be increased, and the pinion can be efficiently rotated with stability. Further, if a gear two or more steps before the rotor is selected as the rotation target gear, the speed-up ratio would be increased and a very large force would be required to rotate that gear, thus resulting in a difficulty in starting up the rotor against its cogging torque. By selecting the gear just one step before the rotor as the rotation target gear, a rotating force required to start up the rotor can be reduced to a comparatively small value.

The invention according to claim 4 resides in a starter for an electromagnetic converter comprising at least a rotor and converting one of mechanical energy and electrical energy into the other, wherein the starter includes a startup member for, in response to operation of an external operating member, applying a rotating force to the rotor of the electromagnetic converter, whereby the rotor is rotated.

With the invention having those features, since the rotating force is applied to the rotor, an increase in speed error due to speed-up through the speed-up wheel train is avoided unlike the case of applying the rotating force to the speed-up wheel train, and hence the rotor can be rotated at a predetermined speed. The above fourth object can be thus achieved. Accordingly, the rotation of the rotor can be further stabilized and a time lapsed until the start of driving of an IC can be more precisely kept constant. When the starter is employed in a timepiece, for example, it is possible to eliminate an error in setting of the correct time by adding a preset compensation value, and manage the indication of time with high accuracy.

In the above starter, preferably, the rotation target gear, the pinion or the rotor includes an engaged portion, and the startup member includes an engaging portion capable of mechanically engaging with the engaged portion of the rotation target gear, the pinion or the rotor.

With those features, similarly to the invention of claim 1, since the startup member mechanically engaging with the rotation target gear, the pinion or the rotor is employed, the mechanical rotating force can be efficiently applied to the rotor through the rotation target gear, the pinion or the rotor with stability.

The startup member may be magnetically engageable with the rotation target gear, the pinion or the rotor.

By utilizing magnetic forces to apply the rotating force through magnetic engagement with the rotation target gear, the pinion or the rotor, a need of bringing the startup member into direct contact with the rotation target gear, the pinion or the rotor is eliminated. It is therefore possible to prevent wears of the startup member and the rotation target gear, the pinion or the rotor.

Preferably, the startup member engages the engaging portion of the startup member with the engaged portion of the rotation target gear, the pinion or the rotor in response to first operation of the external operating member, and moves the engaging portion of the startup member for applying a rotating force to the rotation target gear, the pinion or the rotor in response to second operation of the external operating member.

With the invention having those features, since the engagement and movement of the startup member are performed in interlock with the operation of the external operating member such as a crown, there is no need of externally operating a separate push button or the like, and the mechanical rotating force can be positively applied to the rotation target gear, the pinion or the rotor.

Preferably, the engaged portion of the startup member is moved substantially in the tangential direction of the rotation target gear, the pinion or the rotor in response to the second operation of the external operating member. By moving the engaging portion of the startup member substantially in the tangential direction of the rotation target gear, the pinion or the rotor, the direction in which the rotating force is applied to the rotation target gear, the pinion or the rotor and the rotating direction of the rotation target gear, the pinion or the rotor are aligned with each other. Therefore, the improved efficiency can be obtained and the gear can be efficiently rotated with stability.

Preferably, the startup member comprises a startup spring having an engaging portion capable of engaging with the engaged portion of the rotation target gear, the pinion or the rotor, and a startup-spring operating member for biasing the startup spring to engage the engaging portion of the startup spring with the engaged portion of the rotation target gear, the pinion or the rotor in response to the first operation of the external operating member, and releasing the startup spring from a biased state for returning the startup spring to an original position in response to the second operation of the external operating member, thereby applying a rotating force to the rotation target gear, the pinion or the rotor.

With the invention having those features, the startup spring is biased by the startup-spring operating member for engagement with the rotation target gear, the pinion or the rotor, and the biasing of the startup-spring operating member is then released so that the rotating force is applied to the rotation target gear, the pinion or the rotor upon return of the startup spring due to its own resilient force. In other words, since only the startup spring is employed and a spring for starting up the rotation target gear, the pinion or the rotor is the same as a spring for returning the startup spring to the original position, there is no need of considering balance between resilient forces of separate springs unlike a conventional starter. As a result, a stable rotating force can be always applied to the rotation target gear, the pinion or the rotor. The above second object can be thus achieved.

At the initial stage of startup of a power generator, therefore, a mechanical rotating force is applied to a rotor of the power generator by the startup spring through a wheel train with stability in addition to a rotating force applied by a mainspring. A large rotating force is thus temporarily applied to the rotor, whereby the rotor can be rotated at an increased speed as soon as the startup.

Accordingly, it is hence possible to increase the power outputted from the power generator up to a large value in a short time, shorten a period of time taken from the start of driving of the power generator to the start of operation of a rotation controller, and reduce an error in the time setting.

In the above starter, preferably, the startup spring is a leaf spring, and the engaging portion of the startup spring, which engages with the engaged portion of the rotation target gear, the pinion or the rotor, is moved by the startup-spring operating member substantially in the tangential direction of the gear, the pinion or the rotor.

By moving the engaging portion of the startup spring substantially in the tangential direction of the gear, the pinion or the rotor, the direction in which the rotating force is applied to the gear, the pinion or the rotor and the rotating direction of the gear, the pinion or the rotor are aligned with each other. Therefore, the improved efficiency can be obtained and the gear, the pinion or the rotor can be efficiently rotated with stability.

Preferably, an opposite end portion of the startup spring is fixed to a pin, and the pin is rotatably attached to a base of the electromagnetic converter.

By rotating the pin, to which the startup spring is fixed, relative to the base, the initial position of the startup spring, i.e., the resilient force of the startup spring, can be easily adjusted, and therefore the rotating force applied to the gear, the pinion or the rotor can be easily set to a predetermined value.

In this connection, preferably, the startup-spring operating member comprises a latch portion capable of engaging with the rotation target gear, the pinion or the rotor to stop rotation thereof, and a startup-spring biasing portion for biasing the startup spring by a predetermined amount, while the latch portion is in engagement with the rotation target gear, the pinion or the rotor, thereby bringing the engaging portion of the startup spring into engagement with the engaged portion of the rotation target gear, the pinion or the rotor.

By using the startup-spring operating member having the above features, the amount by which the startup spring is biased can be held constant with high accuracy, and the rotating force applied to the rotation target gear, the pinion or the rotor can be further stabilized. Additionally, since the latch portion of the startup-spring operating member is also engaged with the rotation target gear, the pinion or the rotor, it is possible to smoothly stop the rotation target gear, the pinion or the rotor, eventually the rotor.

Preferably, the external operating member is a crown, and the startup-spring operating member is constituted by a lever for biasing the startup spring to be engaged with the rotation target gear, the pinion or the rotor when the crown is pulled out, and releasing the startup spring from the biased state for returning the startup spring to the original position when the crown is pushed in, thereby applying a mechanical rotating force to the rotation target gear, the pinion or the rotor.

By using, as the startup-spring operating member, the lever in interlock with the operation of the crown, the operability is improved.

Preferably, the electromagnetic converter includes a yoke and a coil. In this connection, preferably, the electromagnetic converter is an electromagnetic converter including a core portion around which the coil is wound, e.g., a power generator with a core.

A coreless power generator may also be used as the power generator, i.e., as one example of the electromagnetic converter. By using a power generator with a core, however, a magnet size can be reduced and impact resistance can be increased. Although a power generator with a core is inferior in startup property because of having cogging torque, the mechanical rotating force can be applied with stability in the present invention, and therefore a rotor can be positively rotated with stability.

In each of the inventions described above, the engaged portion of the rotation target gear may be a tooth of the gear or may be provided in other area than a tooth by forming the engaged portion in the gear. Particularly, employing the tooth of the gear as the engaged portion is advantageous in that an additional work of forming the engaged portion is eliminated. Similarly, the engaged portion of the pinion may be provided in other area than a tooth. However, the engaged portion is preferably formed using a tooth of the pinion.

Also, the engaged portion of the rotor is preferably formed along an outer peripheral portion of the rotor of the electromagnetic converter. As the outer peripheral portion of the rotor, an outer peripheral portion of any of parts constituting the rotor, e.g., a outer peripheral portion of an inertia plate or a rotor pinion, can be utilized.

In particular, preferably, the rotor of the electromagnetic converter includes an inertia plate, and the engaged portion of the rotor is formed along an outer peripheral portion of the inertia plate.

Since the inertia plate has the largest diameter among the parts of the rotor, greater moment of rotation can be produced with a smaller force applied to the startup member. Therefore, the rigidity required for the startup member can be reduced to a comparatively small value, and the startup member can be formed of a comparatively thin member. It is thus possible to reduce the weight of the startup member and arrange it with more easiness.

Preferably, the inertia plate is attached to a rotating shaft of the rotor through a slip mechanism.

By providing the slip mechanism, if a force in excess of a predetermined value is applied to the inertia plate, the inertia plate slips relative to the rotating shaft of the rotor, and therefore the rotational speed of the rotor can be kept constant.

Preferably, the startup member enables the rotor to be restricted to a position offset from a statically stable position thereof when the engaging portion of the startup member is engaged with the engaged portion of the rotor.

By restricting the rotor to the position offset from the statically stable position, the effect of cogging torque at the startup is reduced and a required startup torque to be applied by the startup member can be reduced to a smaller value.

Preferably, the startup member for rotating the rotor rotates the rotor forward in a rotating direction thereof. By rotating the rotor directly or through the rotation target gear, the pinion, etc. by the startup member, the rotor having been so far stopped starts rotation, whereupon a frictional force imposed on the rotor is reduced from a large value caused by statical friction down to a small value caused by kinetic friction, thus resulting in an improvement of the startup property. In other words, the startup member is required to reduce the frictional force through a shift from statical friction to kinetic friction. Accordingly, the rotor may be rotated backward in the rotating direction other than being rotated forward in the rotating direction. However, rotating the rotor in the proper rotating direction by the startup member is more advantageous in that the rotational speed of the rotor can be more quickly increased.

A timepiece of the present invention comprises a mechanical energy source, an electromagnetic converter driven by the mechanical energy source and outputting electrical energy, a rotation controller operated with the electrical energy generated by the electromagnetic converter, hands driven under control by the rotation controller, and the above-mentioned starter for the electromagnetic converter.

With the timepiece having those features, because of including the starter for the electromagnetic converter which is used as a power generator, when the electromagnetic converter is stopped, for example, during the hand setting operation and the timepiece is then returned from the hand setting operation, the electromagnetic converter can be quickly started up at a predetermined rotational speed with stability. Accordingly, an error in indication of the time can be made very small and the timepiece can be operated with high accuracy.

Also, a timepiece of the present invention comprises a mechanical energy source, a transmission wheel train for transmitting mechanical energy from the mechanical energy source, hands driven by the transmission wheel train and indicating the time of day, an electromagnetic converter including a rotor rotated through the transmission wheel train and outputting electrical energy, an electricity accumulator for accumulating an electromotive force generated by the electromagnetic converter, and a rotation controller operated by the electricity accumulator, the rotation controller including a reference-signal output circuit for outputting a reference signal, and a comparison-and-control signal output circuit for detecting a cycle of the rotor of the electromagnetic converter, comparing the detected cycle with the reference signal, and outputting a comparison and control signal, wherein the timepiece further comprises the above-mentioned starter for the electromagnetic converter, the starter providing a rotating force to act on the transmission wheel train or the rotor in response to operation of an external operating member.

With the timepiece having those features, similarly to the above timepiece, because of including the starter for the electromagnetic converter which is used as a power generator, when the electromagnetic converter is stopped, for example, during the hand setting operation and the timepiece is then returned from the hand setting operation, the electromagnetic converter can be quickly started up at a predetermined rotational speed with stability. Accordingly, an error in indication of the time can be made very small and the timepiece can be operated with high accuracy.

In this connection, preferably, the timepiece further comprises an electricity accumulator being able to accumulate the electrical energy outputted from the electromagnetic converter and connected to the rotation controller through a mechanical switch, the mechanical switch being turned off in response to first operation of the external operating member to disconnect the electricity accumulator from the rotation controller, and being turned on in response to second operation of the external operating member to supply the electrical energy from the electricity accumulator to the rotation controller.

With those features, for example, when the operation of the external operating member such as pulling out the crown is performed for the hand setting, the mechanical switch is turned off, whereupon the electricity accumulator, e.g., a capacitor, is disconnected from the rotation controller (IC) and therefore the voltage of the electricity accumulator is maintained without being reduced.

Accordingly, when the operation of the external operating member such as pushing in the crown is performed at the end of the hand setting, the mechanical switch is turned on, whereby the rotation controller can be started up with the power from the electricity accumulator maintained at a high voltage. Thus, a startup time of the rotation controller can be shortened and held constant.

Preferably, the rotating force applied to the rotation target gear, the pinion or the rotor by the startup member is set to such a magnitude as causing the rotor of the electromagnetic converter to be started up at a reference speed.

Here, the term "reference speed" implies a speed, e.g., 8 Hz, at which the hands coupled to the wheel train connected to the rotor is moved without errors. By enabling the rotor to be started up for rotation at the reference speed, a period from the time at which the rotation controller is supplied with power for the startup to the time at which the rotation controller actually starts control, can be made in match with a period during which the hands are moved for indication of the time. As a result, an error in indication of the time can be eliminated.

The invention according to claim 24 resides in a timepiece comprising an electrical energy source, an electromagnetic converter driven by the electrical energy source and outputting mechanical energy, a rotation controller operated with electrical energy from the electrical energy source, hands driven under control by the rotation controller, and the above-mentioned starter for the electromagnetic converter.

With the timepiece having those features, because of including the starter for the electromagnetic converter which is used as a motor, when the electromagnetic converter is stopped, for example, during the hand setting operation and the timepiece is then returned from the hand setting operation, the electromagnetic converter can be quickly started up at a predetermined rotational speed with stability. Accordingly, an error in indication of the time can be made very small and the timepiece can be operated with high accuracy.

BEST MODE FOR CARRYING OUT THE INVENTION

Hereinafter, embodiments of the present invention will be described with reference to the drawings.

First Embodiment

An embodiment of the present invention will be described below in connection with the drawings.

Figure 1:
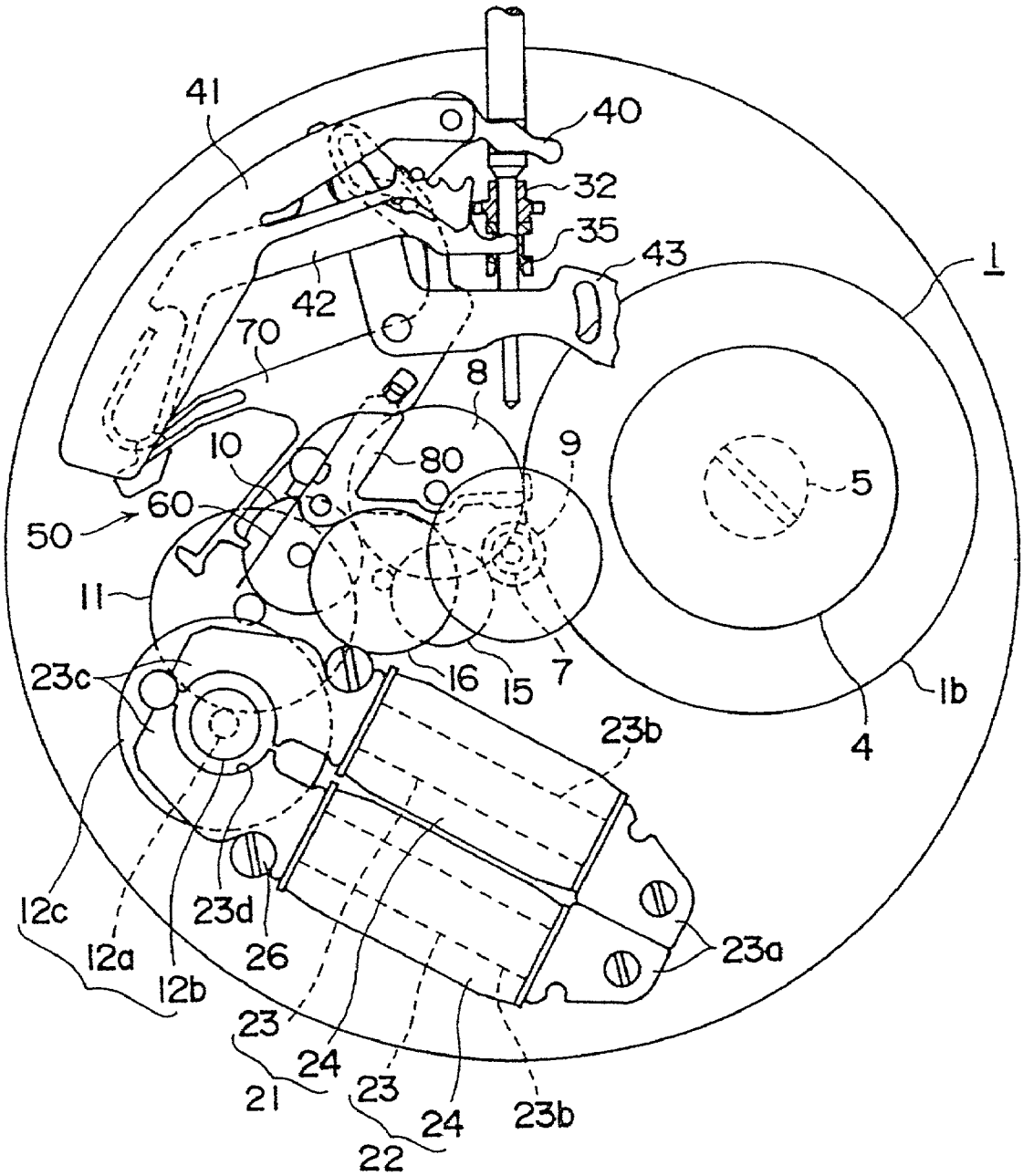
FIG. 1 is a plan view showing principal part of an electronically controlled mechanical watch according to a first embodiment of the present invention.
Figure 2:
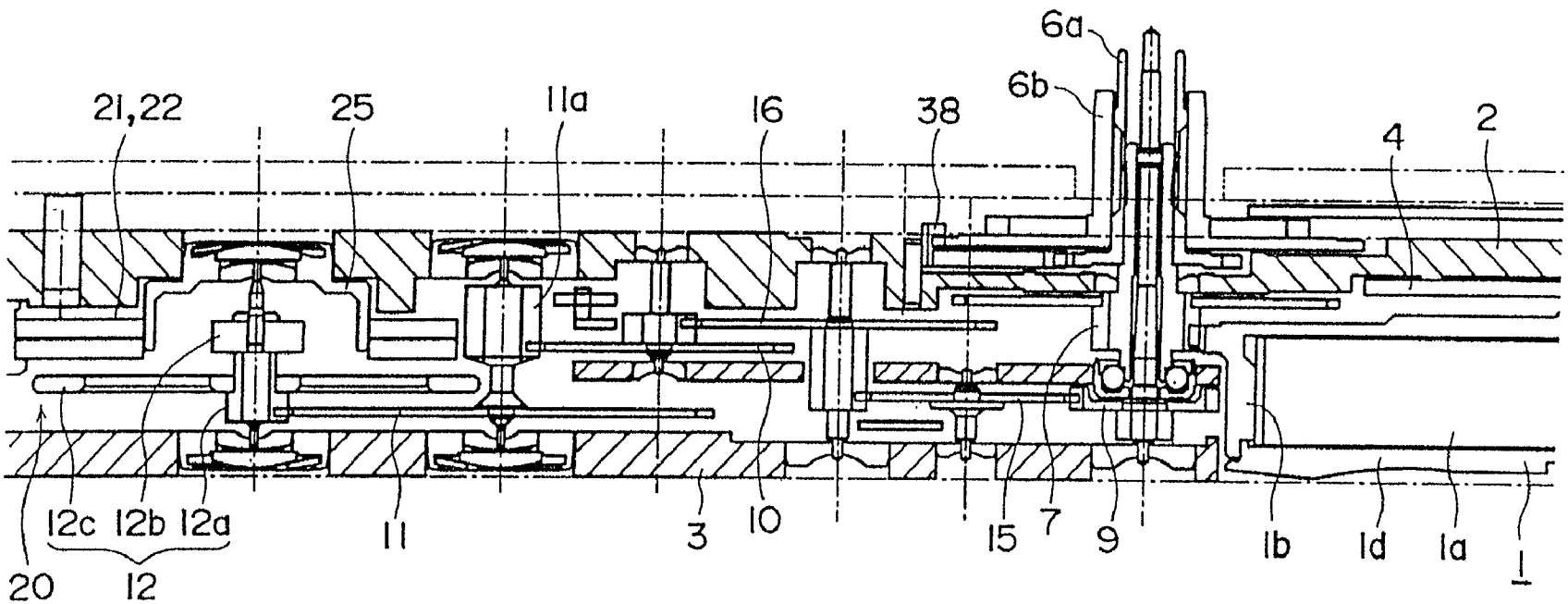
FIG. 2 is a sectional view showing principal part of the first embodiment.
Figure 3:
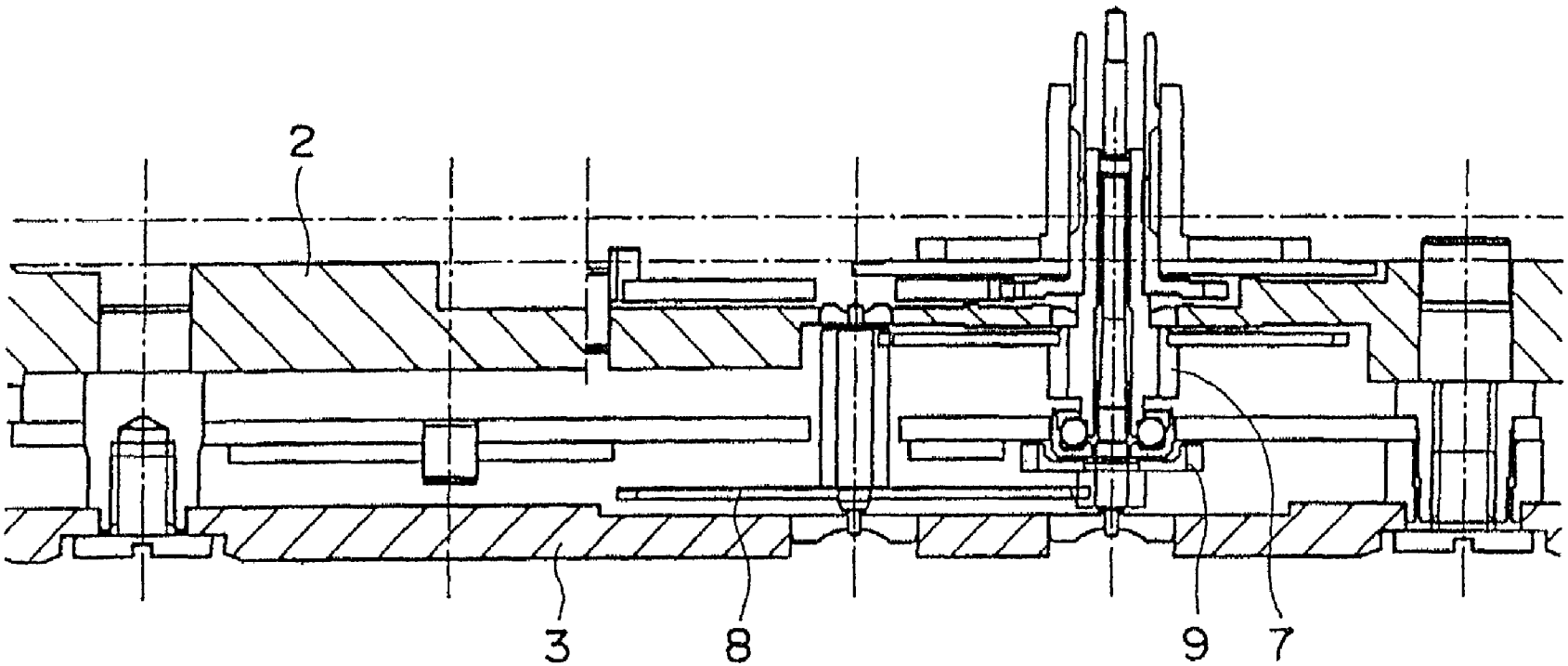
FIG. 3 is a sectional view showing principal part of the first embodiment.

FIG. 1 is a plan view showing principal part of an electronically controlled mechanical watch according to a first embodiment of the present invention, and FIGS. 2 and 3 are sectional views of the principal part.

The electronically controlled mechanical watch includes a movement barrel 1 comprising a mainspring 1*a*, a barrel wheel gear 1*b*, a barrel arbor, and a barrel cover 1*d*. The mainspring 1*a* has an outer end fixed to the barrel wheel gear 1*b* and an inner end fixed to the barrel arbor. The barrel arbor is inserted through a barrel axle fixed to a main plate 2 and is fixed by a ratchet wheel screw 5 for rotation together with a ratchet wheel 4.

The ratchet wheel 4 is meshed with a click (not shown) so that it is allowed to rotate counterclockwise, but checked from rotating clockwise. A manner of rotating the ratchet wheel 4 clockwise to wind up the mainspring 1*a* is similar to that employed in an automatically or manually wind-up mechanism of a mechanical watch, and therefore the manner is not described here.

The rotation of the barrel wheel gear 1*b* is transmitted to a power generator 20 (rotor 12) after being sped up through a wheel train comprising a 2nd (center) wheel 7, a 3rd wheel 8, a 4th (second) wheel 9, a 5th first intermediate wheel 15, a 5th second intermediate wheel 16, a 5th wheel 10, and a 6th wheel 11. These train wheels are supported by the main plate 2 and a train wheel bridge 3.

The power generator 20 as an electromagnetic converter is made up of the rotor 12 and coil blocks 21, 22. The rotor 12 is made up of a rotor pinion 12*a*, a rotor magnet 12*b*, and a rotor inertia disk 12*c*. The rotor inertia disk 12*c* serves to reduce variations in rotational speed of the rotor 12, which are caused due to variations in driving torque from the movement barrel 1.

The coil blocks 21, 22 are each constructed by winding a coil 24 around a yoke 23. Each yoke 23 has an integral structure comprising a stator portion 23*c* arranged adjacent to the rotor 12, a core portion 23*b* around which the coil 24 is wound, and a magnetically communicating portion 23*a* coupled to a counterpart of the other yoke.

The yokes 23, i.e., the coils 24, are arranged parallel to each other. The rotor 12 is arranged adjacent to the stator portions 23*c* with a rotor axis lying on a boundary line between the coils 24, and the stator portion 23*c* are arranged in transversely symmetrical relation with respect to the boundary line.

In addition, as shown in FIG. 2, a positioning member 25 is disposed in a stator hole 23*d* of each yoke 23 in which the rotor 12 is disposed. Then, a positioning jig 26 in the form of an eccentric pin is disposed midway each yoke 23 in the longitudinal direction, i.e., between the stator portion 23*c* and the magnetically communicating portion 23*a* of each yoke 23. By turning the positioning jig 26, the stator portion 23*c* of each yoke 23 is brought into abutment with the positioning member 25. As a result, the stator portions 23*c* can be precisely and simply positioned in place, and opposing side surfaces of the magnetically communicating portion 23*a* can be positively contacted with each other.

The coils 24 are formed in the same number of windings. The term "the same number" includes not only the case where the numbers of windings are exactly equal to each other, but also the case where there is some error in the number of windings between the coils at such a level negligible from the entire coil, for example, on the order of several hundreds turns.

The magnetically communicating portions 23*a* of the yokes 23 are coupled to each other through contact between their opposing side surfaces. Also, lower surfaces of the magnetically communicating portions 23*a* are held in contact with an auxiliary yoke for magnetic communication, not shown, which is arranged in bridging relation with respect to both the magnetically communicating portions 23*a*. With such an arrangement, the magnetically communicating portions 23*a* form two magnetically communicating paths, i.e., a magnetically communicating path passing the side surfaces of the magnetically communicating portions 23*a* and a magnetically communicating path passing the lower surfaces of the magnetically communicating portions 23*a* and the auxiliary yoke for magnetic communication. Thus, the yokes 23 form a looped magnetic circuit. The coils 24 are wound in the same direction along the longitudinal direction of each of the yokes 23 from the magnetically communicating portion 23*a* to the stator portion 23*c*.

Ends of the coils 24 are connected to coil lead boards, not shown, provided on the magnetically communicating portions 23*a* of the yokes 23.

Figure 4:
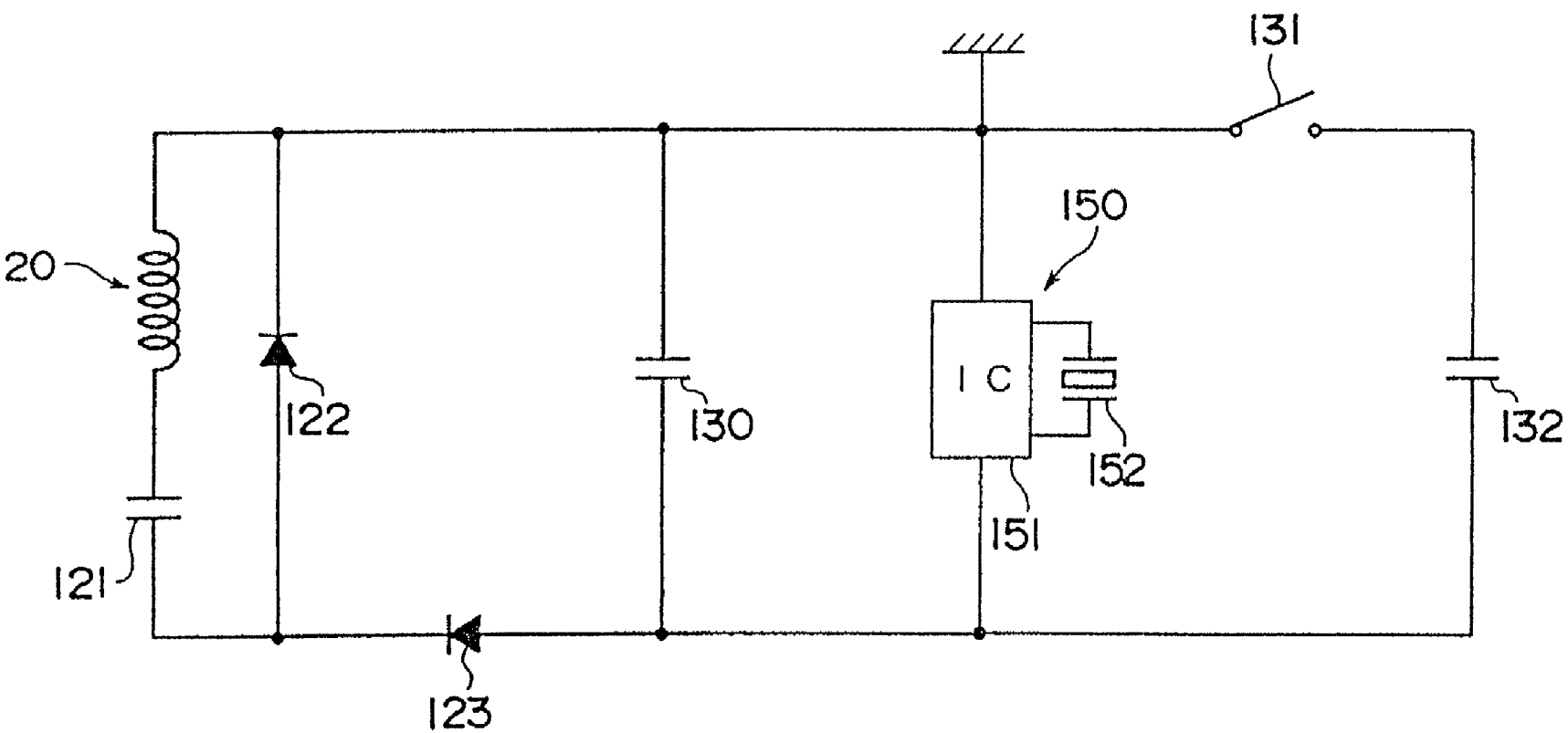
FIG. 4 is a diagram showing a control circuit of the first embodiment.

A control circuit of the electronically controlled mechanical watch will now be described with reference to FIG. 4.

An AC output from the power generator 20 is boosted and rectified through a boosting/rectifying circuit comprising a boosting capacitor 121 and diodes 122, 123. A resulting current is charged in a smoothing capacitor 130. Connected to the capacitor 130 is a rotation controller 150 comprising an IC 151 and a quartz oscillator 152. The capacitor 130 is a layered ceramic capacitor having a relatively small capacity of about 0.5 μF. An electrolytic capacitor or the like may also be used as the capacitor 130, but a layered ceramic capacitor is more preferable because it has a longer life than an electrolytic capacitor and can provide a product life at a level of several tens years.

When a predetermined voltage enough to drive the IC 151 and the quartz oscillator 152, e.g., a voltage of 1 V, is accumulated in the capacitor 130, the IC 151 and the quartz oscillator 152 are driven by the accumulated power to vary the amount of a current flowing through the coils of the power generator 20. As a result, the intensity of electromagnetic brake is adjusted to govern the cycle of rotation of the power generator 20, i.e., hands. More specifically, the IC 151 of the rotation controller 150 includes a reference-signal output circuit for outputting a reference signal using an oscillation signal from the quartz oscillator 152, and a comparison-and-control signal output circuit for detecting a cycle of the rotor 12 of the power generator 20 as an electromagnetic converter, comparing the detected cycle with the reference signal, and outputting a comparison and control signal. In accordance with the comparison and control signal, the amount of a current flowing through the coils of the power generator 20 is varied to govern the cycle of rotation of the power generator 20. Alternatively, the manner of governing and controlling the power generator 20 may be carried out by using a chopping control scheme. In such a case, a switch or the like is provided which can connect output terminals of the power generator 20 into the closed loop state. The switch is intermittently turned on and off in accordance with the comparison and control signal, whereby short brake is applied to the power generator 20 for governing it.

Further, a capacitor 132 serving as an electricity accumulator is connected to the capacitor 130 via a switch 131. The capacitor 132 has a relatively large capacity of about 5 μF.

The switch 131 is constructed, as described later, by a mechanical switch that is turned on when a not-shown crown (external operating member) is manipulated and a winding stem is set to the zero-th stage (normal hand driving mode) or the first stage (calendar correcting mode), and is turned off when the winding stem is set to the second stage (hand setting mode). Therefore, when the power generator 20 is in operation, the power from the power generator 20 is accumulated in not only the capacitor 130, but also the capacitor 132. When the power generator 20 is stopped during the hand setting operation, the switch 131 is turned off and hence the voltage of the capacitor 132 is maintained. Thus, when the switch 131 is turned on upon the crown being operated to the zero-th or first stage after setting the hands right, the capacitor 130 is momentarily charged with the power from the capacitor 132 and a predetermined voltage is applied to the IC 151. Accordingly, the IC 151 is started up after about 1 second from application of the voltage.

Means for varying the amount of a current flowing through the coils can be effectively implemented, for example, by a method of changing resistance of a load control circuit connected in parallel to both the terminals of the power generator 20 as disclosed in Embodiment 1 of Japanese Unexamined Patent Application Publication No. 8-101284, or a method of changing the number of boosting steps as disclosed in Embodiment 2 thereof.

In the electronically controlled mechanical watch described above, as shown in FIGS. 5–8, by operating a winding stem 31 connected to the notshown crown, the ratchet wheel 4 is rotated through a winding pinion 32, a crown wheel 33, etc., whereby the mainspring 1*a* is wound up.

The operation of setting minute and second hands right is performed by pulling out the crown, axially moving the winding stem 31 and setting it to the second stage, moving a sliding pinion 35 toward a setting wheel 36 to mesh them with each other under the action of a setting lever 40, a yoke holder 41 and a yoke 42, and moving the setting wheel 36 toward a minute wheel 38 by a setting wheel lever 43 to mesh them with each other, thereby rotating an hour pinion 6*a* and an hour wheel 6*b*, as shown in FIG. 2.

Additionally, when the winding stem 31 is set to the first stage, the setting wheel lever 43 is not moved and only the yoke 42 is moved to mesh the sliding pinion 35 with the setting wheel 36. Therefore, the calendar can be corrected through a calendar corrector transmitting wheel 45.

The electronically controlled mechanical watch further includes a starter operated by manipulating the crown, more concretely, a rotation driving means 50 serving as a startup member. The starter (rotation driving means) 50 is made up of a startup spring 60 for rotating the 6th wheel 11 midway the wheel train and driving the power generator 20, a reset lever 70 moved with movement of the setting lever 40 and being able to bias the startup spring 60, and a train wheel setting lever 80 moved with movement of the reset lever 70 and engaged with the 4th wheel 9, which rotates the second hand, for restricting rotation of the 4th wheel 9.

Figure 5:
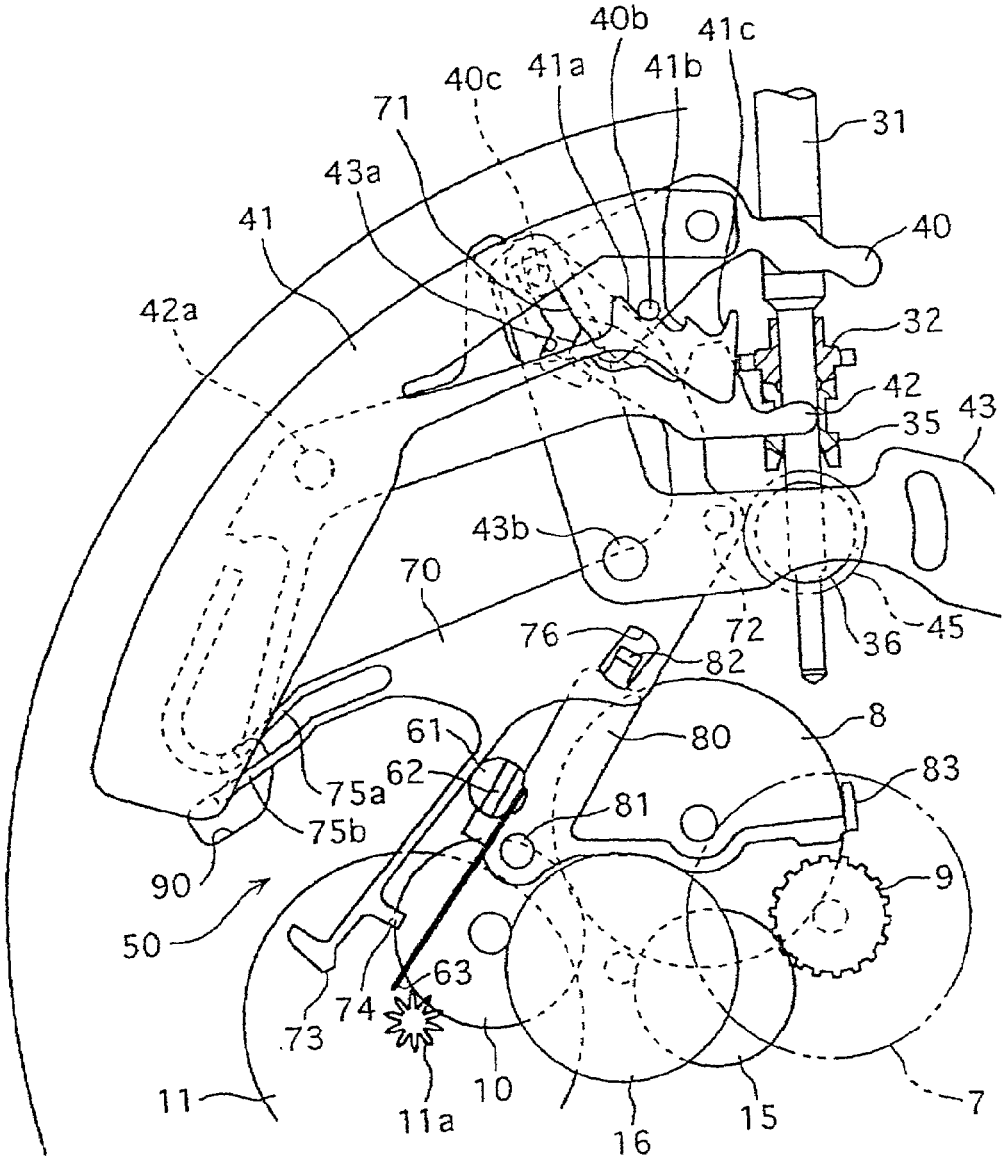
FIG. 5 is a plan view showing a starter of the first embodiment in the hand driving state.
Figure 6:
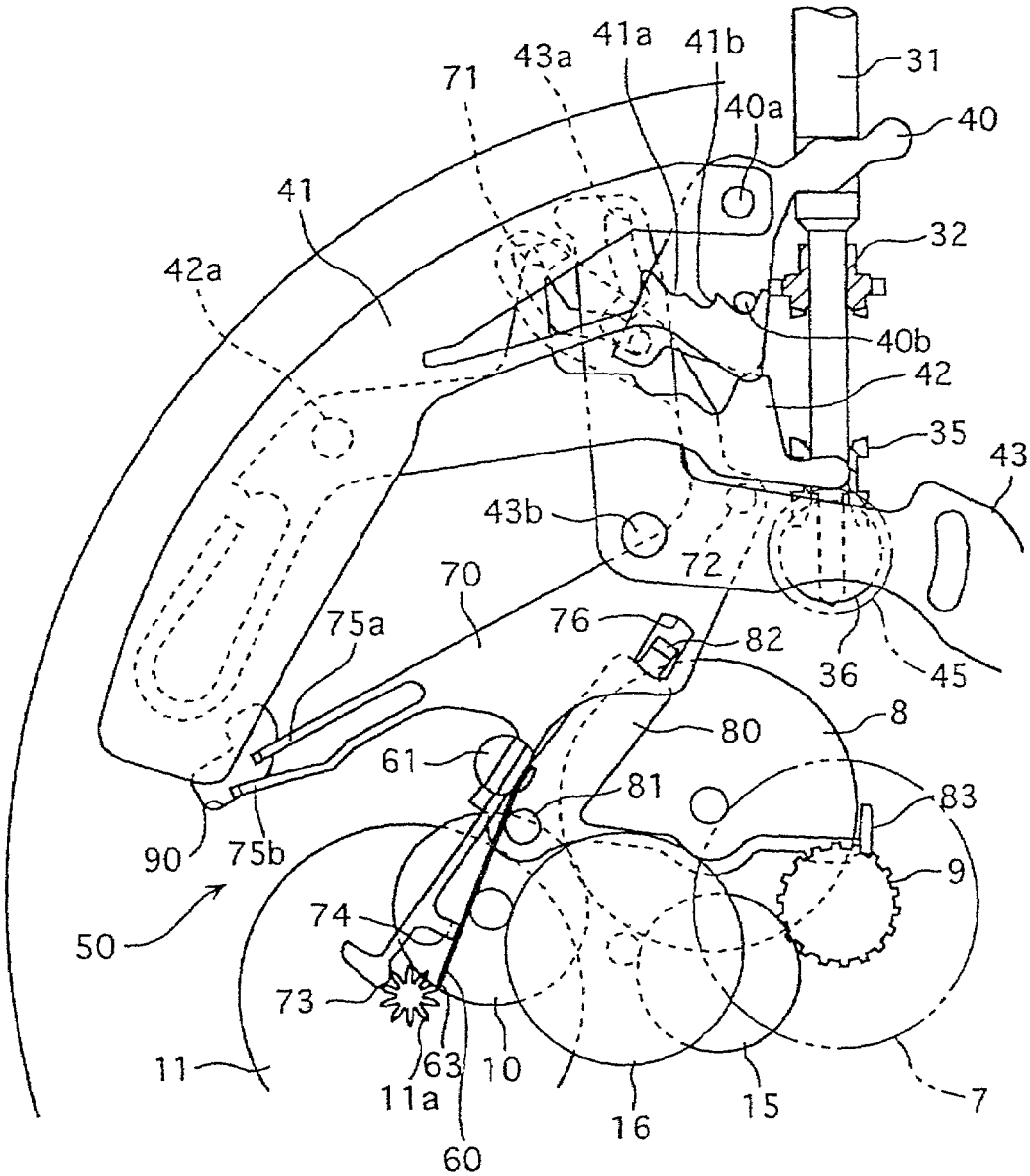
FIG. 6 is a plan view showing the starter of the first embodiment in the hand setting state.
Figure 9:
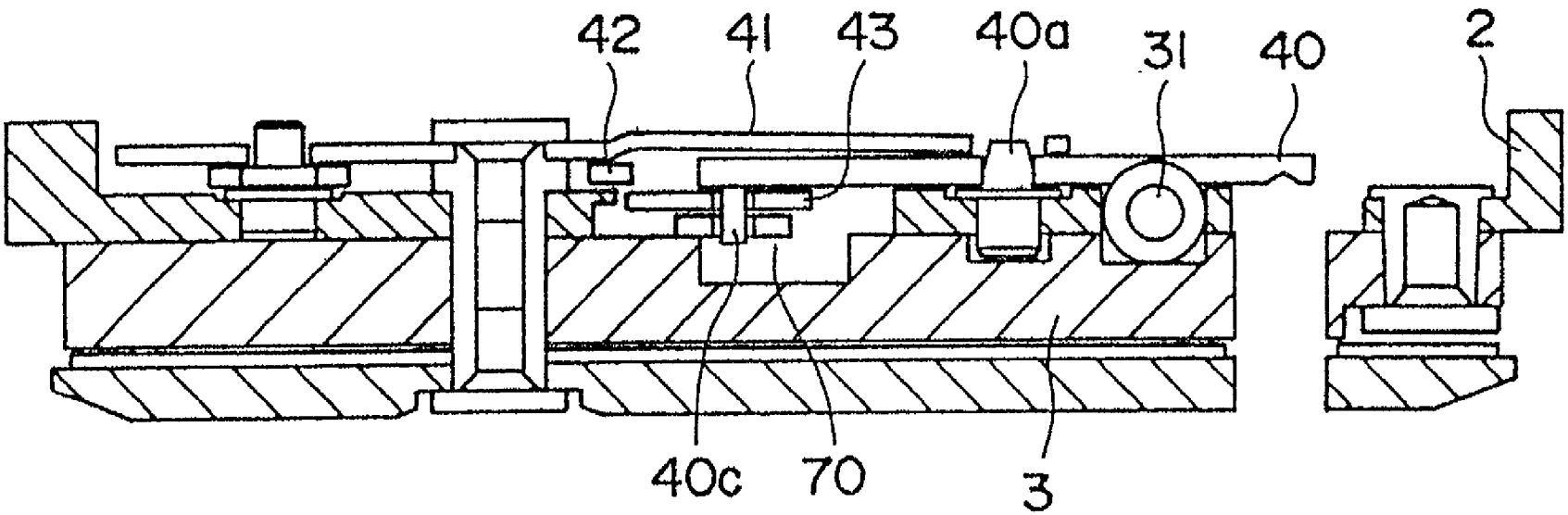
FIG. 9 is a sectional view showing principal part of the first embodiment.

The setting lever 40 is, as shown in FIGS. 5 and 6, supported rotatably about a shaft 40*a* and engaged with the winding stem 31. Then, the setting lever 40 includes a positioning pin 40*b* engageable with any of three engagement grooves 41*a*, 41*b*, 41*c* formed in the yoke holder 41, and a pin 40*c* engaged in grooves 43*a*, 71 formed respectively in the setting wheel lever 43 and the reset lever 70, the pin 40*c* being also shown in FIG. 9. Further, a corner portion of the setting lever 40 is constructed to be able to contact the yoke 42 for turning the same.

The yoke holder 41 is constructed such that the position of the winding stem 31, i.e., of the crown, can be set to any of three stages, i.e., zero-th, first and second stages, by engaging the positioning pin 40*b* of the setting lever 40 in corresponding one of the engagement grooves 41*a*–41*c*.

The yoke 42 is supported rotatably about a shaft 42*a*. The yoke 42 has one end engaged with the sliding pinion 35. Therefore, when the winding stem 31 is pulled out to the first or second stage and the setting lever 40 is rotated counterclockwise in the drawings, the one end of the yoke 42, i.e., the sliding pinion 35, is pushed by the setting lever 40 to move toward the center of the watch for engagement with the setting wheel 36.

Upon the pin 40*c* being moved in the groove 43*a*, the setting wheel lever 43 is turned about a shaft 43*b*. In this connection, a shape of the groove 43*a* is designed such that the setting wheel lever 43 is allowed to move in two steps; one step in which the crown is set to the zero-th or first stage and the other step in which the crown is set to the second stage. The setting wheel 36 is attached to the setting wheel lever 43, as described above, and with the movement of the setting wheel lever 43, the setting wheel 36 is moved toward the center of the watch for engagement with the minute wheel 38.

Figure 7:
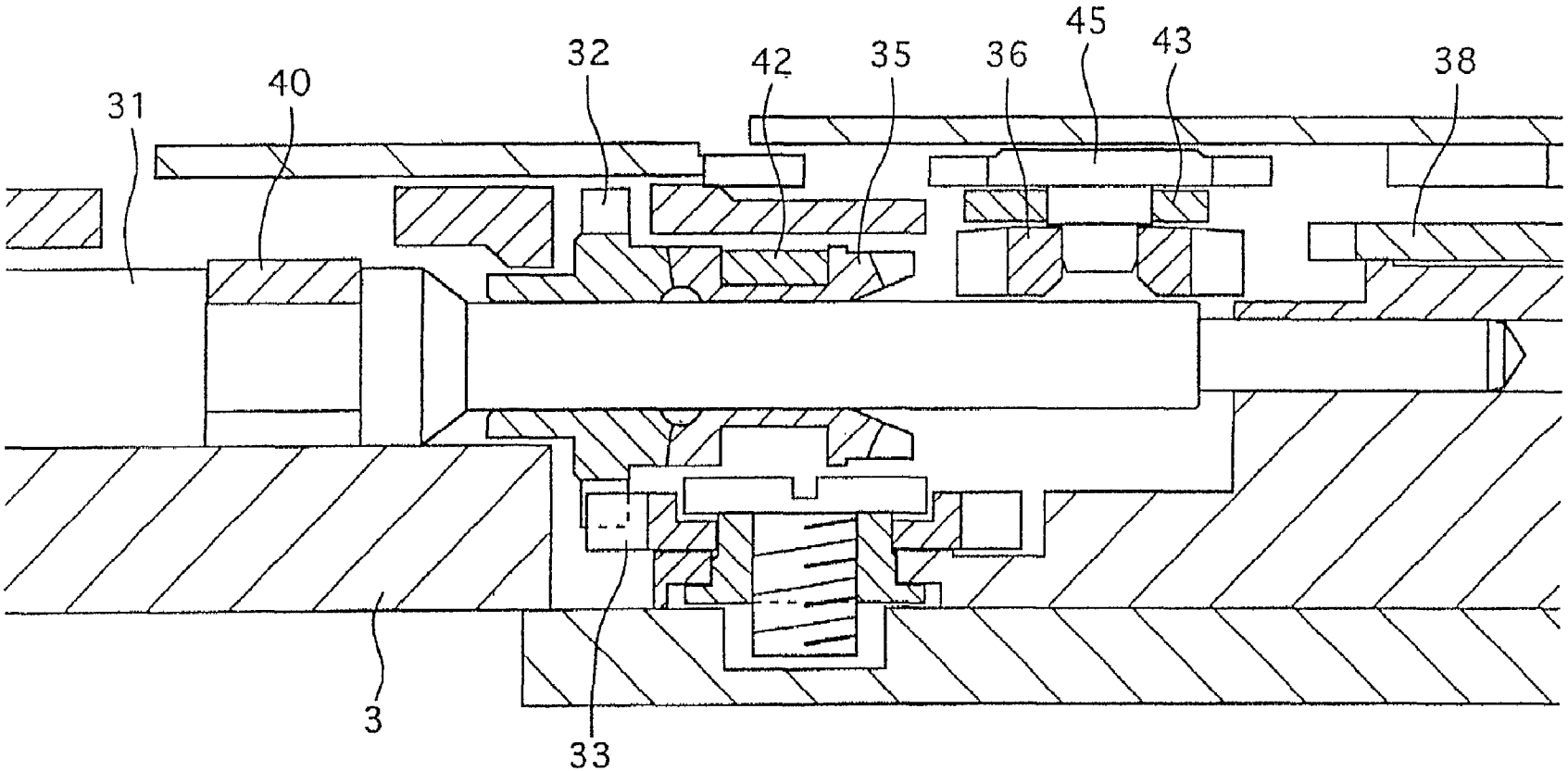
FIG. 7 is a sectional view showing a winding stem portion of the first embodiment in the hand driving state.
Figure 8:
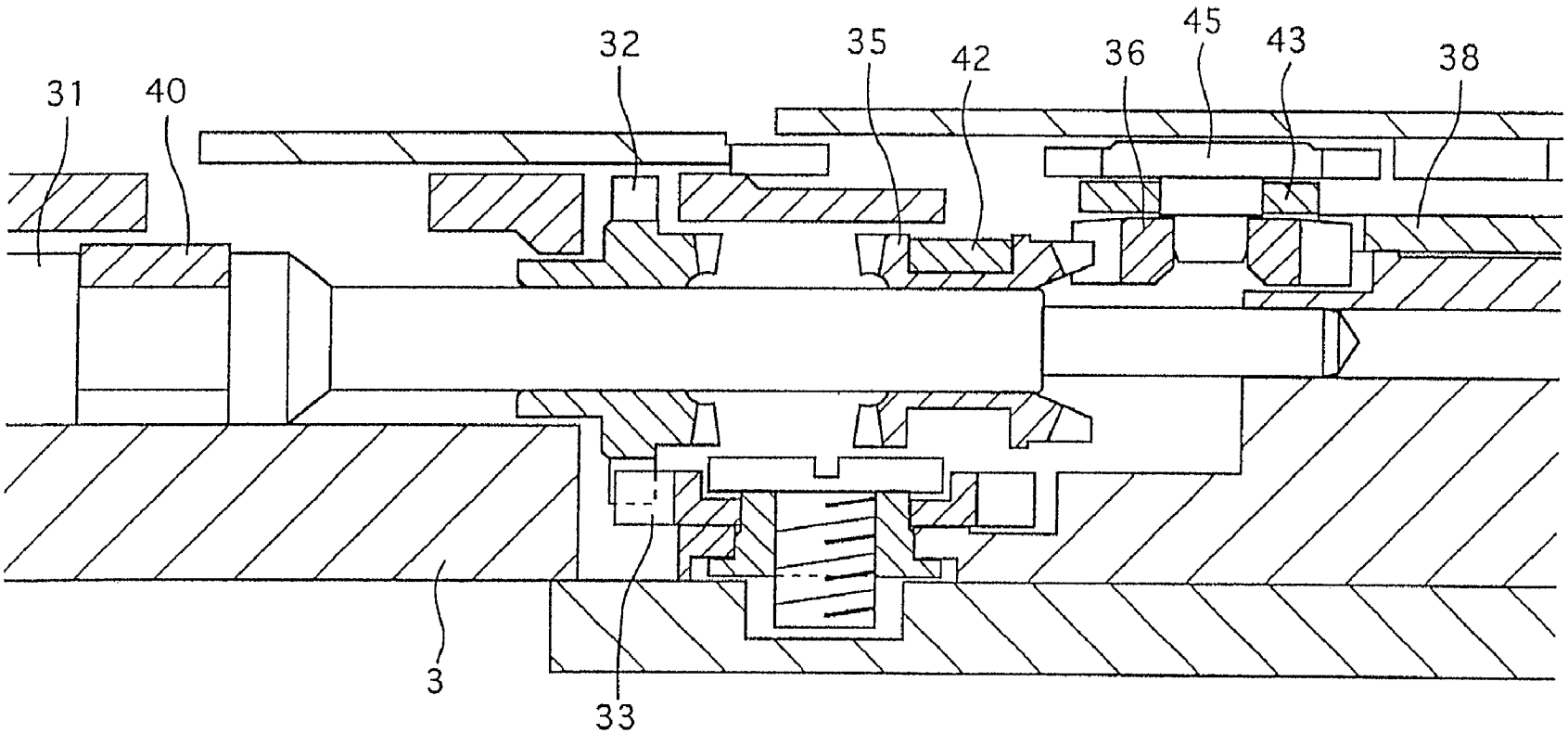
FIG. 8 is a sectional view showing the winding stem portion of the first embodiment in the hand setting state.

Moreover, as shown in FIGS. 7 and 8, with such an arrangement that a shaft of the calendar corrector transmitting wheel 45 is inserted through a hole formed in the setting wheel lever 43 and the setting wheel 36 is fitter over the shaft of the calendar corrector transmitting wheel 45, the setting wheel 36 is attached to the setting wheel lever 43 to be able to turn together with the calendar corrector transmitting wheel 45.

The reset lever 70 is supported rotatably about a shaft 72. A shape of the groove 71 is designed such that the reset lever 70 is likewise allowed to move in two steps; one step in which the crown is set to the zero-th or first stage and the other step in which the crown is set to the second stage.

The reset lever 70 includes a latch portion 73 capable of engaging with a pinion 11*a* of the 6th wheel 11, which is a rotation target gear, and latching the pinion 11*a* into the non-rotatable state, a startup-spring biasing portion 74 for, when the latch portion 73 is engaged with the pinion 11*a*, biasing the startup spring 60 through a predetermined amount and bringing an engaging portion 63 at a fore end of the startup spring 60 into engagement with an engaged portion (tooth) of the rotation target gear 11*a*, and two switch portions 75*a*, 75*b* arranged in a hole 90 formed in a circuit board. Thus, the reset lever 70 constitutes a startup-spring operating member.

As shown in FIGS. 5 and 6, the switch portion 75*a* of the reset lever 70 is brought into contact with the circuit board when the winding stem 31 is in the zero-th or first stage, and is moved away from the circuit board when the winding stem 31 is in the second stage. This mechanical switch portion 75*a* of the reset lever 70 constitutes the aforesaid switch 131 for the capacitor 132.

Also, the switch portion 75*b* of the reset lever 70 is brought into contact with the circuit board at one side of the hole 90 when the winding stem 31 is in the zero-th or first stage, and is brought into contact with the circuit board at the other side of the hole 90 when the winding stem 31 is in the second stage. Such an arrangement makes it possible to detect whether the winding stem 31 is in one of the zero-th and first stages or the second stage.

Figure 10:
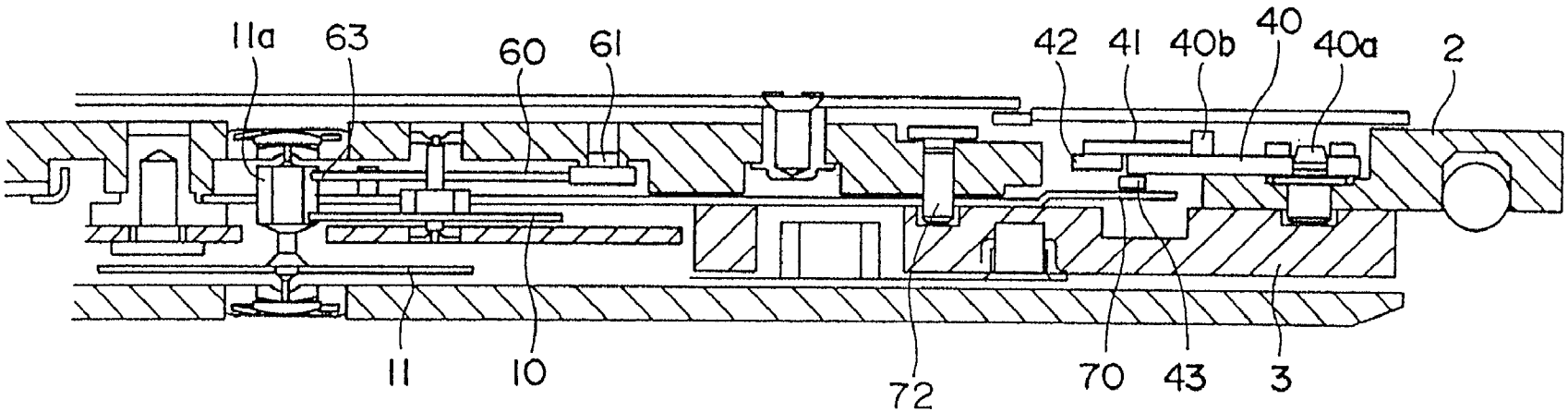
FIG. 10 is a sectional view showing principal part of the first embodiment.

The startup spring 60 is formed of a leaf spring and has a base end portion fixed to a set pin 61 by caulking. As also shown in FIG. 10, the set pin 61 is press-fitted to the main plate (base) and is rotatable by inserting a minus driver or the like in a groove 62 formed in the surface of the set pin 61.

Further, the material and size of the startup spring 60 may be appropriately set in practice. In this embodiment, the startup spring 60 is made of the same constant-modulus material as a hairspring for use in mechanical watches, and has a thickness of 0.035 mm and a height of 0.15 mm with a 3.7 mm-length portion projecting from the pin 61.

The train wheel setting lever 80 is rotatable about a shaft 81 and has one end portion 82 engaged in an engagement hole 76 of the reset lever 70 so as to turn with turning of the reset lever 70. The other end portion 83 of the train wheel setting lever 80 is bent upward such that it is able to engage with the 4th wheel 9.

The operation of the starter 50 in this embodiment will be described.

First, when the crown is in the normal pushed-in position, as shown in FIG. 5, the positioning pin 40*b* of the setting lever 40 is engaged in the engagement groove 41*a* of the yoke holder 41, and the pin 40*c* is engaged in the grooves 43*a*, 71 of the setting wheel lever 43 and the reset lever 70. In this condition, the sliding pinion 35 is engaged with the winding pinion 32. By turning the crown, therefore, the ratchet wheel 4 is rotated through the winding stem 31, the sliding pinion 35, the winding pinion 32 and the crown wheel 33, whereby the mainspring 1*a* can be wound up.

Also, the setting wheel 36 is held in a position out of engagement with the minute wheel 38. Further, the latch portion 73 and the startup-spring biasing portion 74 of the reset lever 70 are held in positions apart away from the pinion 11*a* and the startup spring 60, respectively, and the train wheel setting lever 80 is held in a position apart away from the 4th wheel 9.

Then, as shown in FIG. 6, when the crown is pulled out to the second stage, the setting lever 40 is rotated counterclockwise about the shaft 40*a* and the positioning pin 40*b* of the setting lever 40 is engaged in the engagement groove 41*b* of the yoke holder 41. Simultaneously, the end portion of the yoke 42 is pushed by the corner portion of the setting lever 40 toward the center of the watch, causing the sliding pinion 35 to move toward the setting wheel 36. Also, the setting wheel lever 43 is rotated clockwise about the shaft 43*b* by the pin 40*c* of the setting lever 40, causing the setting wheel 36 to move toward the minute wheel 38. As a result, the sliding pinion 35 is engaged with the setting wheel 36 and the setting wheel 36 is engaged with the minute wheel 38 so that the time setting can be made by turning the crown.

At the same time, the reset lever 70 is rotated counterclockwise about the shaft 72. With the rotation of the reset lever 70, the train wheel setting lever 80 is rotated clockwise and engaged with the 4th wheel 9. The 4th wheel 9, i.e., the second hand, is thereby restricted from rattling due to backlash in the rotating direction during the hand setting operation.

Further, the startup spring 60 is biased by the startup-spring biasing portion 74 of the reset lever 70 and is deflected to such an extent that the engaging portion 63 at the fore end of the startup spring 60 is engaged with one tooth, i.e., the engaged portion, of the 6th pinion 11*a*. On this occasion, since the latch portion 73 of the reset lever 70 is engaged with another tooth of the 6th pinion 11*a*, the amount of biasing (deflection) of the startup spring 60 is always maintained constant.

Figure 11:
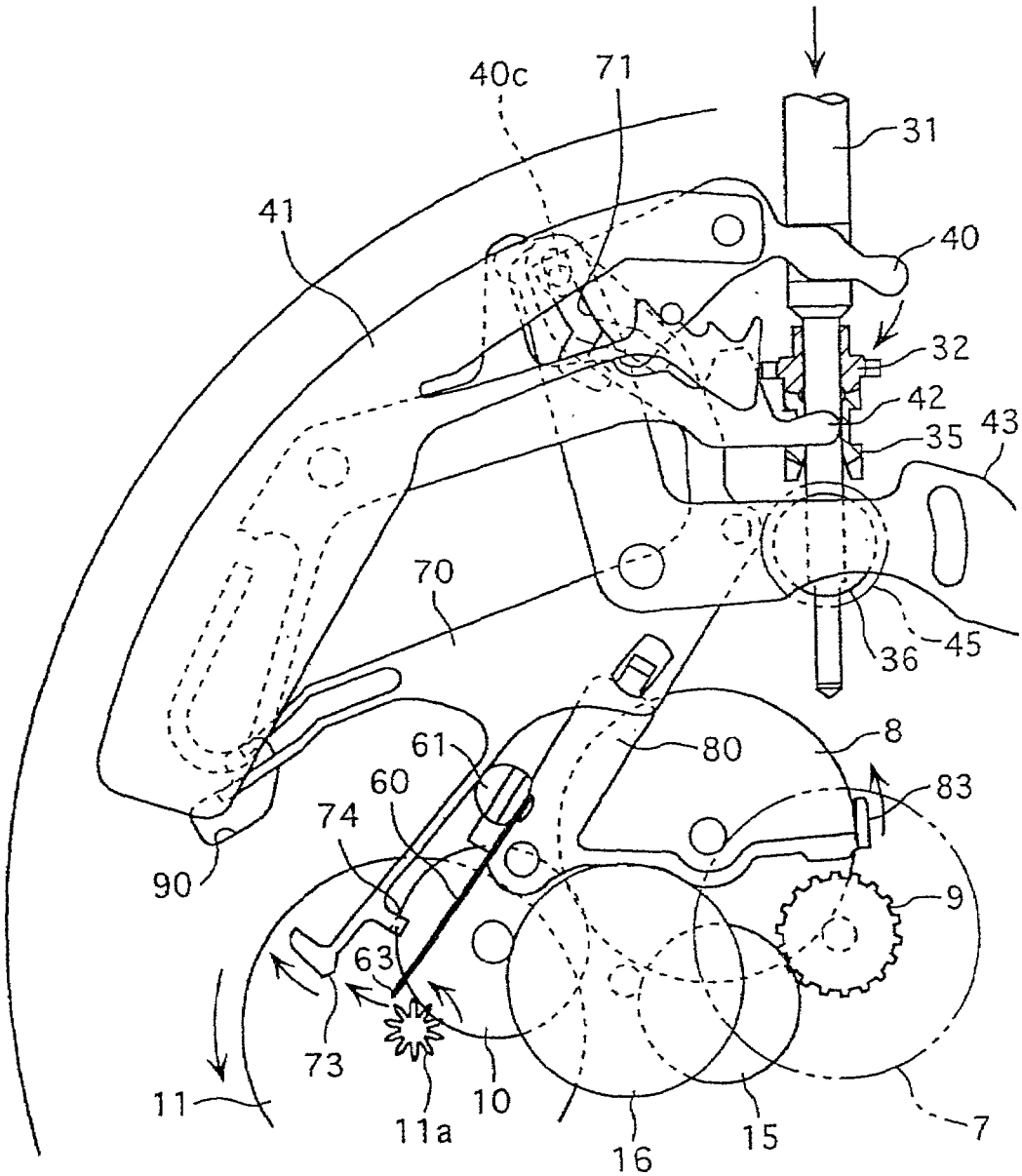
FIG. 11 is a plan view showing the starter of the first embodiment in the operative state.

When the crown is pushed in to finish the hand setting operation after turning the crown and setting the hands right, the setting lever 40 is rotated clockwise and the pin 40*c* is moved within the groove 71 in interlock with the pushing-in of the crown, as shown in FIG. 11. The reset lever 70 is thereby rotated clockwise for return to the original position.

Also, with the movement of the reset lever 70, the train wheel setting lever 80 is rotated counterclockwise and the other end portion 83 of the lever 80 is disengaged from the 4th wheel 9, allowing the second hand to rotate.

Further, the latch portion 73 and the startup-spring biasing portion 74 are quickly disengaged from the 6th wheel pinion 11*a* and the startup spring 60, respectively, with the movement of the reset lever 70.

Therefore, the startup spring 60 is also returned to the original position by its own spring force. At this time, the engaging portion 63 at the fore end of the startup spring 60 is moved in the tangential direction of the 6th wheel pinion 11*a*, whereupon a mechanical rotating force is applied to the 6th wheel 11 in the direction of arrow. With the rotation of the 6th wheel 11, the rotor 12 is rotated and the hands are moved through the wheel train comprising the 5th wheel 10, the 5th second intermediate wheel 16, the 5th first intermediate wheel 15, the 4th wheel 9, etc.

The rotating force thus produced may be appropriately set in practice. In this embodiment, the produced rotating force is set to a level enough to rotate the rotor 12 at the reference speed (speed at which the hands are allowed to move precisely, i.e., speed at which the second hand, for example, is moved in one second through a angular distance corresponding to one second; e.g., 8 Hz).

Upon the crown being pushed in for return from the hand setting operation, the power generator 20 starts to operate. At this startup of the power generator 20, the rotating force applied to the 6th pinion 11*a* by the startup spring 60 is transmitted to the rotor 12 in addition to the rotating force from the mainspring 1*a*. Accordingly, a large rotating force is temporarily applied to the rotor 12, whereby the rotor 12 is rotated at an increased speed as soon as the startup and the power outputted from the power generator 20 is increased up to a large value in a short time.

This embodiment thus constructed has the following advantages.

(1) A mechanical rotating force is applied to the 6th wheel 11 by providing the starter 50 including at least the reset lever 70 and the startup spring 60 which are operated in interlock with the manipulation of pushing in the crown for return from the hand setting operation. At the startup of the power generator 20, therefore, the mechanical rotating force produced by the starter 50 can be applied to the rotor 12 of the power generator 20 through the wheel train in addition to the rotating force from the mainspring 1*a*. Accordingly, a large rotating force is temporarily applied to the rotor 12, whereby the rotor 12 can be rotated at an increased speed as soon as the startup and the power outputted from the power generator 20 can be increased up to a large value in a short time. It is hence possible to shorten a period of time taken from the start of driving of the power generator 20 to the start of operation of the rotation controller 150 and reduce an error in the time setting.

(2) The rotating force produced by the starter 50 can be set only by the startup spring 60, i.e., a resilient force of a single spring, and there is no need of considering balance between resilient forces of a plurality of springs unlike the known method. This enables the rotating force to be simply set with good accuracy. It is therefore possible to avoid such a possibility that the rotating force applied to the 6th pinion 11*a* is too small to rotate (start up) the rotor 12, or that the rotating force is too great and the 6th pinion 11*a* is rotated too quick even with brake applied. As a result, the rotating force can be always applied at an appropriate level.

(3) Since the groove 62 is formed in the pin 61 to which the startup spring 60 is fixed, the initial position of the startup spring 60, i.e., the deflection of the startup spring 60 caused by the startup-spring biasing portion 74, can be easily adjusted by simply rotating the pin 61 with a driver or the like. As a result, the rotating force can be easily set with good accuracy.

(4) Since the rotating force produced by the startup spring 60 is applied to the 6th pinion 11*a* having a small diameter, the amount by which the startup spring 60 engages with the 6th pinion 11*a* in the longitudinal direction of the spring can be increased, and the engaging portion 63 of the startup spring 60 can be positively brought into engagement with the engaged portion of the pinion 11*a*. Further, since the rotating force is applied to the pinion 11*a* of the 6th wheel 11 just one step before the rotor 12, the rotor 12 can be positively started up. More specifically, in the above-described embodiment, the startup spring 60 has a spring force of about 0.4 g. Also, the pitch circle radius of the pinion 11*a* is 0.5 mm. Therefore, the startup spring 60 produces a torque of 0.4 g×0.5 mm=0.2 gmm=200 mgmm ($1.96\times10^{-6}$ N·m in terms of the internal unit system, a numeral value in ( ) similarly represents a converted one hereinafter). Then, assuming that the torque transmission efficiency is 0.8×0.8=0.64 and the speed-up ratio is 8, a torque applied to the rotor 12 is given by 200×0.64/8=16 mgmm ($1.57\times10^{-7}$ N·m). On the other hand, since a cogging torque of the rotor 12 is 1 mgmm ($9.8\times10^{-9}$ N·m), the above torque (16 mgmm) is much greater than the cogging torque, and therefore the rotor 12 can be positively started up (rotated) by applying the above torque.

For example, if the startup spring 60 is engaged with a 5th pinion for starting up the rotor 12, a produced torque is given by 16/5×0.8=2.6 mgmm ($2.55\times10^{-8}$ N·m) on condition that the speed-up ratio from the 5th wheel 10 to the 6th wheel 11 is 5 and the torque transmission efficiency is 0.8. Hence a difference between the produced torque and the cogging torque is small. Taking into account variations, therefore, there is a risk that the rotor 12 may not be positively started up. Consequently, by applying the rotating force to the 6th pinion 11*a* like the embodiment, the rotor can be always started up with stability.

(5) Since the engaging portion 63 of the startup spring 60, which is brought into engagement with the 6th pinion 11*a*, is moved in the tangential direction, i.e., the rotating direction, of the 6th pinion 11*a*, the efficiency in rotating the 6th pinion 11*a* by the startup spring 60 can be so increased that the rotor can be always started up with stability.

In the above-described embodiment, for example, the inertial moment of the rotor 12 including the inertia disk 12*c* is $1.4\times10^{-10}$ kgm$^2$. When the rotor 12 having the above inertial moment is rotated at 8 Hz, kinetic energy is given by $1.4\times10^{-10}\times(2\pi\times8)^2/2=1.8\times10^{-7}$ [J]. On the other hand, the startup spring 60 produces energy of $1\times10^{-6}$ [J], and therefore the efficiency 1 is given by $1.8\times10^{-7}/1\times10^{-6}=18\%$. Thus, the efficiency can be increased up to a higher level than a conventional value of 5% or below, and the rotor 12 can be started up with stability.

(6) Since the startup spring 60 is biased by the startup-spring biasing portion 74 of the reset lever 70 and the latch portion 73 of the reset lever 70 is engaged with the 6th pinion 11*a*, the amount of biasing (movement) of the startup spring 60 can be always maintained constant. As a result, the resilient force of the startup spring 60, i.e., the force applied to the 6th pinion 11*a*, can be always kept constant and the rotor 12 can be positively started up with stability.

(7) There are provided the switch 131 (switch portion 75*a*) intermittently turned on and off in response to manipulation of the crown, and the capacitor 132 connected to the IC 151 through the switch 131. Accordingly, the voltage of the capacitor 132 can be maintained during the hand setting operation in which the power generator 20 is stopped, and the capacitor 130 can be momentarily charged with the power from the capacitor 132 and a predetermined voltage can be applied to the IC 151 when the crown is pushed in for return from the hand setting operation. Hence the IC 151 can be started up quickly, for example, in about 1 second.

(8) Since the force applied from the startup spring 60 to the 6th pinion 11*a* can be kept constant, it is also possible to always start up and rotate the rotor 12 at the reference speed. This enables the hands to be precisely moved during a period from the time at which the rotation controller 150 is supplied with power for the startup to the time at which the rotation controller 150 actually starts control, e.g., a period of about one second. As a result, an error in indication of the time can be eliminated.

(9) Since the rotor 12 can be started up by additionally applying a mechanical rotating force, the power generator 20 may have a core which makes it harder to start up the power generator 20 because of the presence of cogging torque. Using the power generator 20 provided with a core is advantageous in that the rotor magnet 12*b* of the rotor 12 can be reduced in size and impact resistance can be enhanced. Thus, the electronically controlled mechanical watch can be made smaller in size and more resistant against an impact.

(10) The reset lever 70 can be moved at a constant speed regardless of the speed at which the crown is pushed in. Upon departing away from the startup spring 60, therefore, the reset lever 70 can also be quickly moved and the rotating force applied from the startup spring 60 to the 6th pinion 11*a* can be always kept constant. Accordingly, a stable and constant rotating force can be applied to the rotor 12 and there is no need of considering, e.g., the pushing-in speed of the crown, thus resulting in improved operability.

(11) The starter 50, i.e., the reset lever 70, the startup spring 60 and the train wheel setting lever 80, are operated in interlock with the operation of pushing in the crown (external operating member), i.e., the manipulation to effect return from the hand setting. Therefore, the starter 50 can be operated without needing consciousness of an operator, and operability can be further improved.

(12) Since the train wheel setting lever 80 capable of engaging with the 4th wheel 9 is provided, the second hand can be prevented from rattling due to backlash during the hand setting operation, whereby the hand setting operation can be easily and precisely performed.

Second Embodiment

Next, a second embodiment of the present invention will be described. Note that, in the following embodiments, the same or similar components as those in the above embodiment are denoted by the same symbols and a description thereof is omitted or abridged.

Figure 12:
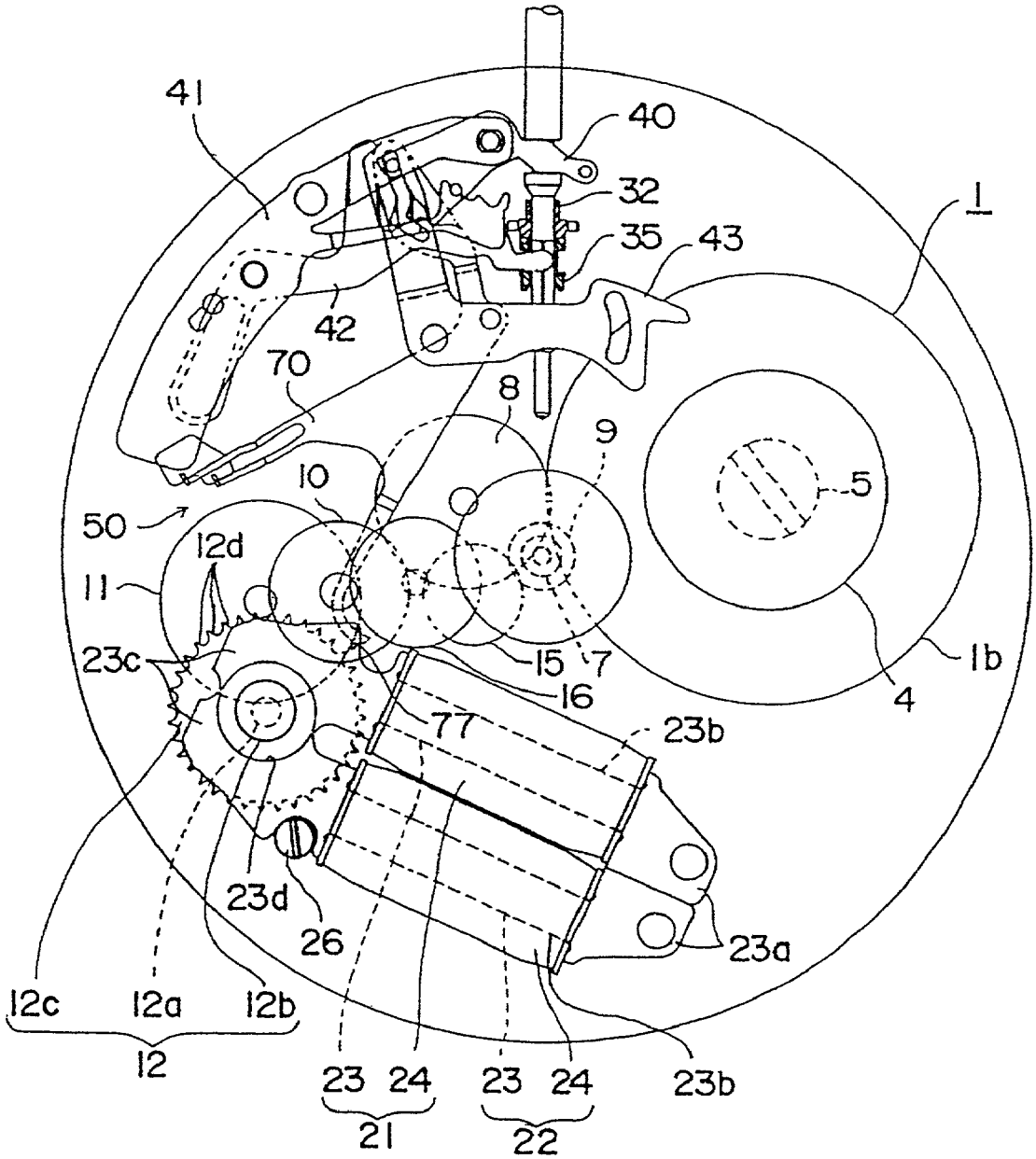
FIG. 12 is a plan view showing principal part of an electronically controlled mechanical watch according to a second embodiment of the present invention.
Figure 13:
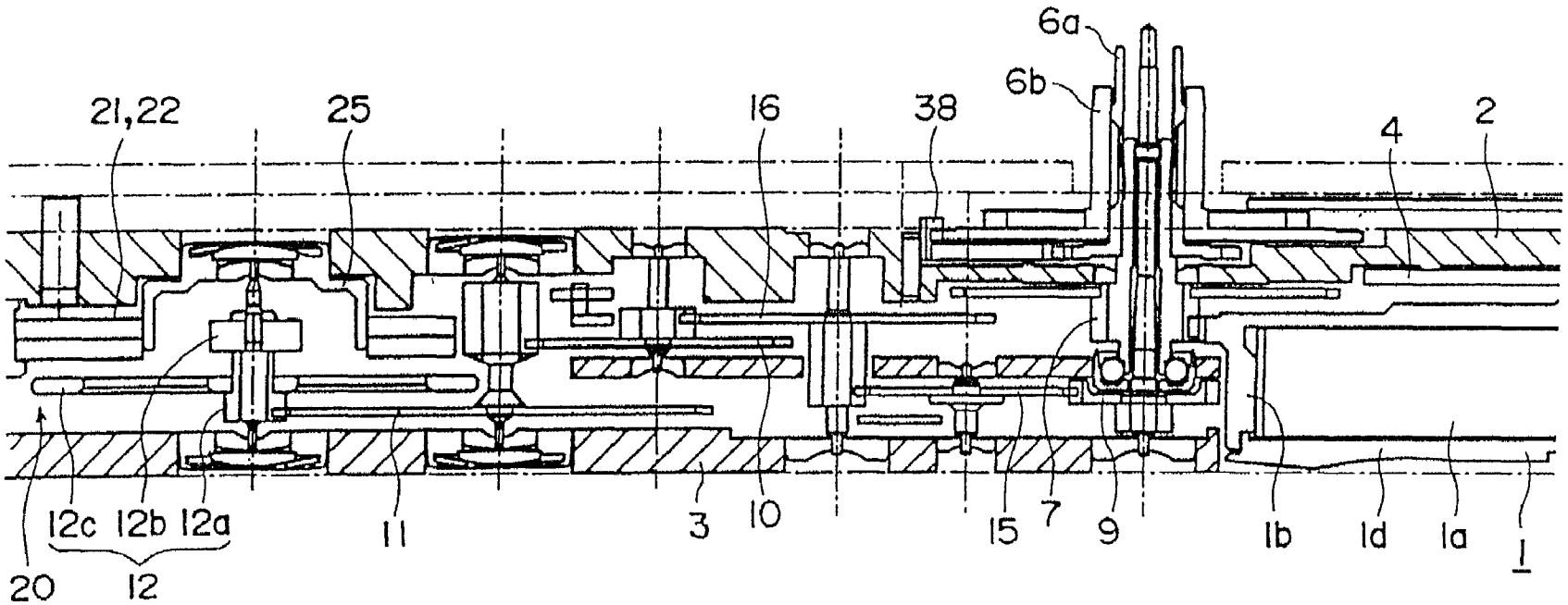
FIG. 13 is a sectional view showing principal part of the second embodiment.
Figure 14:
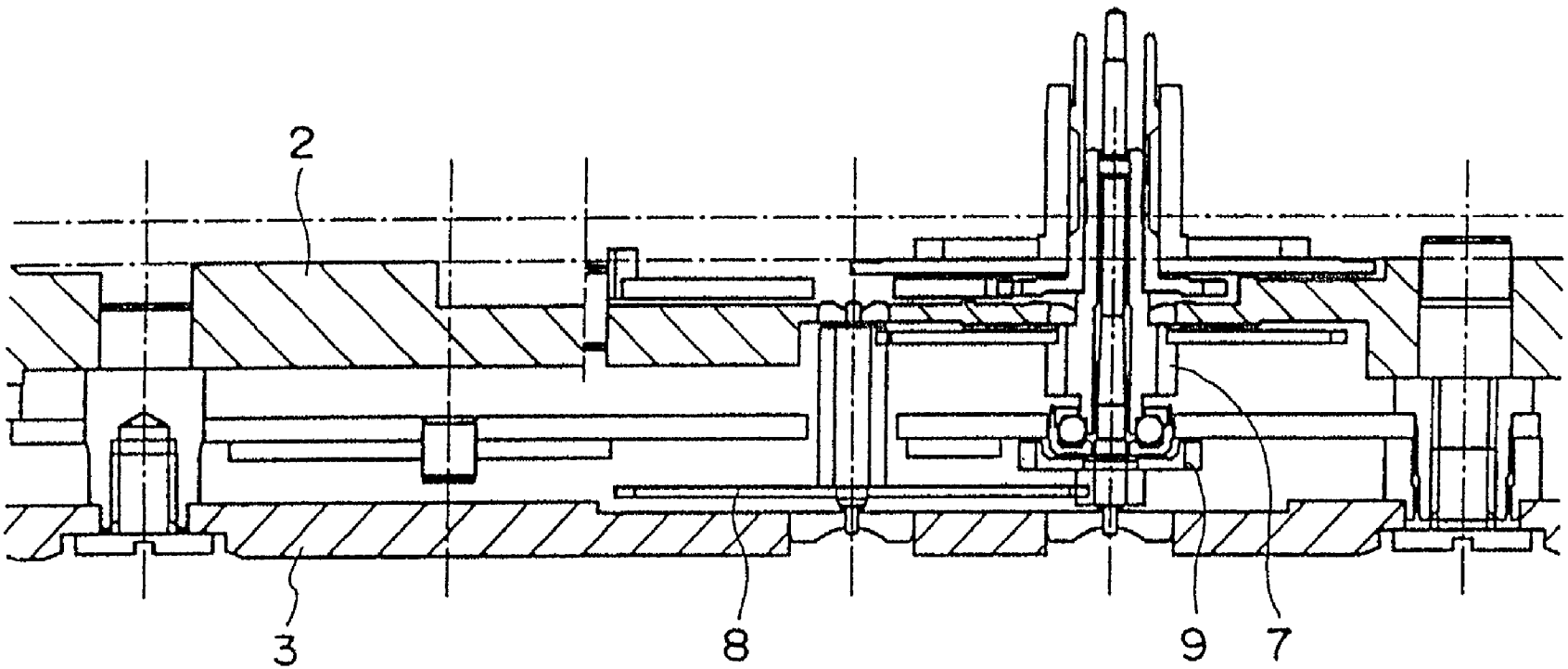
FIG. 14 is a sectional view showing principal part of the second embodiment.

FIG. 12 is a plan view showing principal part of an electronically controlled mechanical watch according to a second embodiment of the present invention, and FIGS. 13 and 14 are sectional views of the principal part.

The electronically controlled mechanical watch includes a movement barrel 1 comprising a mainspring 1*a* serving as a mechanical energy source, a barrel wheel gear 1*b*, a barrel arbor, and a barrel cover 1*d*. The mainspring 1*a* has an outer end fixed to the barrel wheel gear 1*b* and an inner end fixed to the barrel arbor. The barrel arbor is inserted through a barrel axle fixed to a main plate 2 and is fixed by a ratchet wheel screw 5 for rotation together with a ratchet wheel 4.

The ratchet wheel 4 is meshed with a click (not shown) so that it is allowed to rotate counterclockwise, but checked from rotating clockwise. A manner of rotating the ratchet wheel 4 clockwise to wind up the mainspring 1*a* is similar to that employed in an automatically or manually wind-up mechanism of a mechanical watch, and therefore the manner is not described here.

The rotation of the barrel wheel gear 1*b* is transmitted to a power generator 20 (rotor 12) after being sped up through a wheel train comprising a 2nd (center) wheel 7, a 3rd wheel 8, a 4th (second) wheel 9, a 5th first intermediate wheel 15, a 5th second intermediate wheel 16, a 5th wheel 10, and a 6th wheel 11. These train wheels are supported by the main plate 2 and a train wheel bridge 3.

The power generator 20 is made up of the rotor 12 and coil blocks 21, 22. The rotor 12 is made up of a rotor pinion 12*a*, a rotor magnet 12*b*, and a rotor inertia disk 12*c*. The rotor inertia disk 12*c* serves to reduce variations in rotational speed of the rotor 12, which are caused due to variations in driving torque from the movement barrel 1. A wave-shaped tooth profile 12*d* is formed all over an outer peripheral edge surface defined as an outer peripheral portion of the rotor inertia disk 12*c*.

Further, the rotor inertia disk 12*c* is attached to a rotor's rotating shaft through a slip mechanism. The slip mechanism is implemented by controlling a fitting force of the rotor inertia disk 12*c* to the rotor's rotating shaft, or providing a rubber or the like, not shown, in a fitting portion between the rotor inertia disk 12*c* and the rotor's rotating shaft. When a force greater than a predetermined value is applied to the rotor inertia disk 12*c*, there occurs a slip between the rotor's rotating shaft and the rotor inertia disk 12*c*, and the rotor's rotating shaft, i.e., the rotor magnet 12*b*, is suppressed from rotating at a speed higher than a predetermined value. Thus, the rotor magnet 12*b* is rotated substantially at a constant speed.

The coil blocks 21, 22 are each constructed by winding a coil 24 around a yoke 23. Each yoke 23 has an integral structure comprising a stator portion 23*c* arranged adjacent to the rotor 12, a core portion 23*b* around which the coil 24 is wound, and a magnetically communicating portion 23*a* coupled to a counterpart of the other yoke.

The yokes 23, i.e., the coils 24, are arranged parallel to each other. The rotor 12 is arranged adjacent to the stator portions 23*c* with a rotor axis lying on a boundary line between the coils 24, and the stator portion 23*c* are arranged in transversely symmetrical relation with respect to the boundary line.

In addition, as shown in FIG. 13, a positioning member 25 is disposed in a stator hole 23*d* of each yoke 23 in which the rotor 12 is disposed. Then, a positioning jig 26 in the form of an eccentric pin is disposed midway each yoke 23 in the longitudinal direction, i.e., between the stator portion 23*c* and the magnetically communicating portion 23*a* of each yoke 23. By turning the positioning jig 26, the stator portion 23*c* of each yoke 23 is brought into abutment with the positioning member 25. As a result, the stator portions 23*c* can be precisely and simply positioned in place, and opposing side surfaces of the magnetically communicating portion 23*a* can be positively contacted with each other.

The coils 24 are formed in the same number of windings. The term "the same number" includes not only the case where the numbers of windings are exactly equal to each other, but also the case where there is some error in the number of windings between the coils at such a level negligible from the entire coil, for example, on the order of several hundreds turns.

The magnetically communicating portions 23*a* of the yokes 23 are coupled to each other through contact between their opposing side surfaces. Also, lower surfaces of the magnetically communicating portions 23*a* are held in contact with an auxiliary yoke for magnetic communication, not shown, which is arranged in bridging relation with respect to both the magnetically communicating portions 23*a*.

With such an arrangement, the magnetically communicating portions 23*a* form two magnetically communicating paths, i.e., a magnetically communicating path passing the side surfaces of the magnetically communicating portions 23*a* and a magnetically communicating path passing the lower surfaces of the magnetically communicating portions 23*a* and the auxiliary yoke for magnetic communication. Thus, the yokes 23 form a looped magnetic circuit. The coils 24 are wound in the same direction along the longitudinal direction of each of the yokes 23 from the magnetically communicating portion 23*a* to the stator portion 23*c*.

Ends of the coils 24 are connected to coil lead boards, not shown, provided on the magnetically communicating portions 23*a* of the yokes 23.

Figure 15:
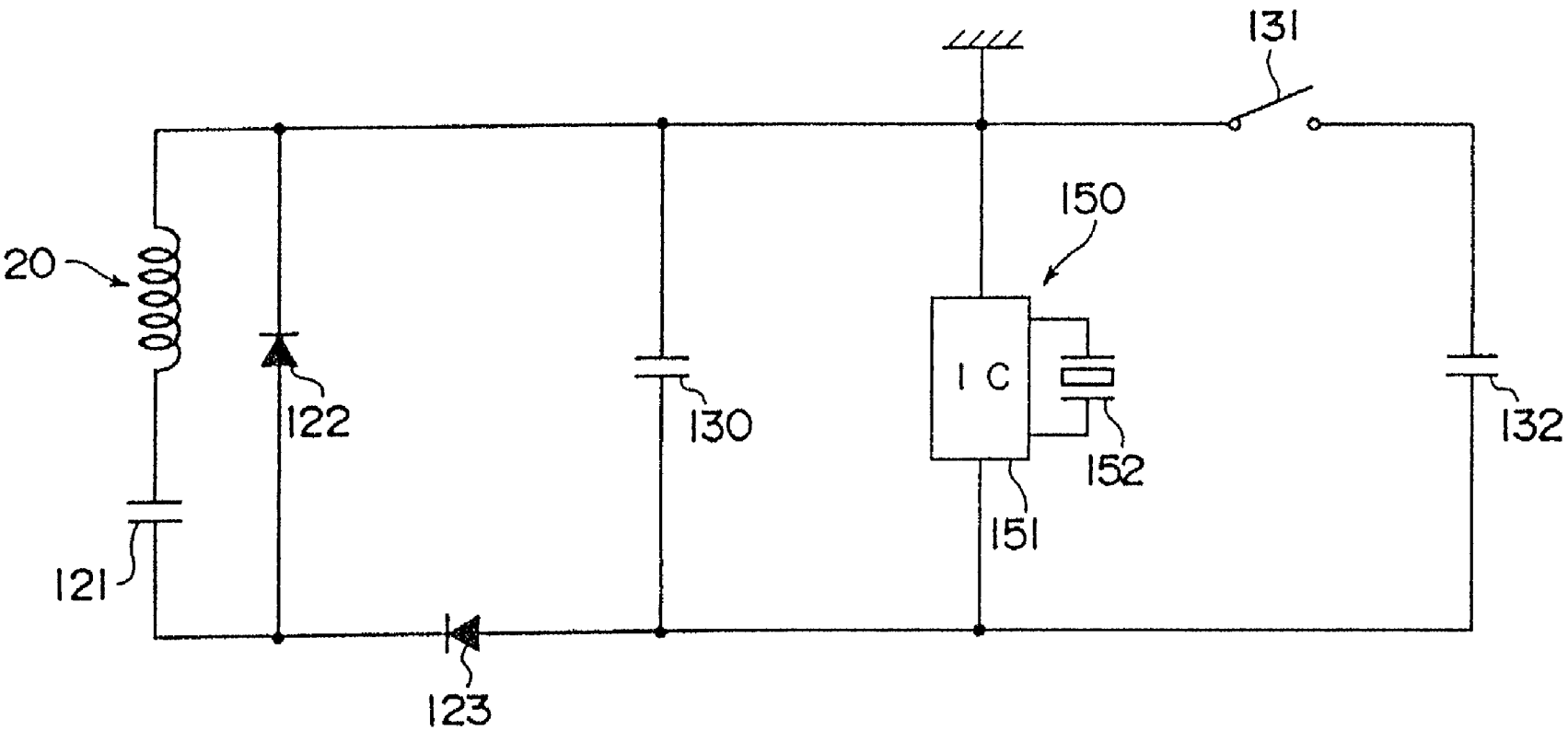
FIG. 15 is a diagram showing a control circuit of the second embodiment.

A control circuit of the electronically controlled mechanical watch will now be described with reference to FIG. 15.

An AC output from the power generator 20 is boosted and rectified through a boosting/rectifying circuit comprising a boosting capacitor 121 and diodes 122, 123. A resulting current is charged in a smoothing capacitor 130. Connected to the capacitor 130 is a rotation controller 150 comprising an IC 151 and a quartz oscillator 152. The capacitor 130 is a layered ceramic capacitor having a relatively small capacity of about 0.5 μF. An electrolytic capacitor or the like may also be used as the capacitor 130, but a layered ceramic capacitor is more preferable because it has a longer life than an electrolytic capacitor and can provide a product life at a level of several tens years.

When a predetermined voltage enough to drive the IC 151 and the quartz oscillator 152, e.g., a voltage of 1 V, is accumulated in the capacitor 130, the IC 151 and the quartz oscillator 152 are driven by the accumulated power to vary the amount of a current flowing through the coils of the power generator 20. As a result, the intensity of electromagnetic brake is adjusted to govern the cycle of rotation of the power generator 20, i.e., hands. Also in this embodiment, the IC 151 of the rotation controller 150 includes a reference-signal output circuit for outputting a reference signal using an oscillation signal from the quartz oscillator 152, and a comparison-and-control signal output circuit for detecting a cycle of the rotor 12 of the power generator 20 as an electromagnetic converter, comparing the detected cycle with the reference signal, and outputting a comparison and control signal. In accordance with the comparison and control signal, the amount of a current flowing through the coils of the power generator 20 is varied to govern the cycle of rotation of the power generator 20. Alternatively, the manner of governing and controlling the power generator 20 may be carried out by using a chopping control scheme. In such a case, a switch or the like is provided which can connect output terminals of the power generator 20 into the closed loop state. The switch is intermittently turned on and off in accordance with the comparison and control signal, whereby short brake is applied to the power generator 20 for governing it.

Further, a capacitor 132 serving as an electricity accumulator is connected to the capacitor 130 via a switch 131. The capacitor 132 has a relatively large capacity of about 5 μF.

The switch 131 is constructed, as described later, by a mechanical switch that is turned on when a not-shown crown (external operating member) is manipulated and a winding stem is set to the zero-th stage (normal hand driving mode) or the first stage (calendar correcting mode), and is turned off when the winding stem is set to the second stage (hand setting mode). Therefore, when the power generator 20 is in operation, the power from the power generator 20 is accumulated in not only the capacitor 130, but also the capacitor 132. When the power generator 20 is stopped during the hand setting operation, the switch 131 is turned off and hence the voltage of the capacitor 132 is maintained. Thus, when the switch 131 is turned on upon the crown being operated to the zero-th or first stage after setting the hands right, the capacitor 130 is momentarily charged with the power from the capacitor 132 and a predetermined voltage is applied to the IC 151. Accordingly, the IC 151 is started up after about 1 second from application of the voltage.

Means for varying the amount of a current flowing through the coils can be effectively implemented, for example, by a method of changing resistance of a load control circuit connected in parallel to both the terminals of the power generator 20 as disclosed in Embodiment 1 of Japanese Unexamined Patent Application Publication No. 8-101284, or a method of changing the number of boosting steps as disclosed in Embodiment 2 thereof.

In the electronically controlled mechanical watch described above, as shown in FIGS. 16–19, by operating a winding stem 31 connected to the not-shown crown, the ratchet wheel 4 is rotated through a winding pinion 32, a crown wheel 33, etc., whereby the mainspring 1*a* is wound up.

The operation of setting minute and second hands right is performed by pulling out the crown, axially moving the winding stem 31 and setting it to the second stage, moving a sliding pinion 35 toward a setting wheel 36 to mesh them with each other under the action of a setting lever 40, a yoke holder 41 and a yoke 42, and moving the setting wheel 36 toward a minute wheel 38 by a setting wheel lever 43 to mesh them with each other, thereby rotating an hour pinion 6*a* and an hour wheel 6*b*, as shown in FIG. 13.

Additionally, when the winding stem 31 is set to the first stage, the setting wheel lever 43 is not moved and only the yoke 42 is moved to mesh the sliding pinion 35 with the setting wheel 36. Therefore, the calendar can be corrected through a calendar corrector transmitting wheel 45.

The electronically controlled mechanical watch further includes a starter operated by manipulating the crown. The starter 50 includes a reset lever 70 moved with movement of the setting lever 40 and serving as a startup member which directly applies a rotating force to the rotor 12 for rotating it.

Figure 16:
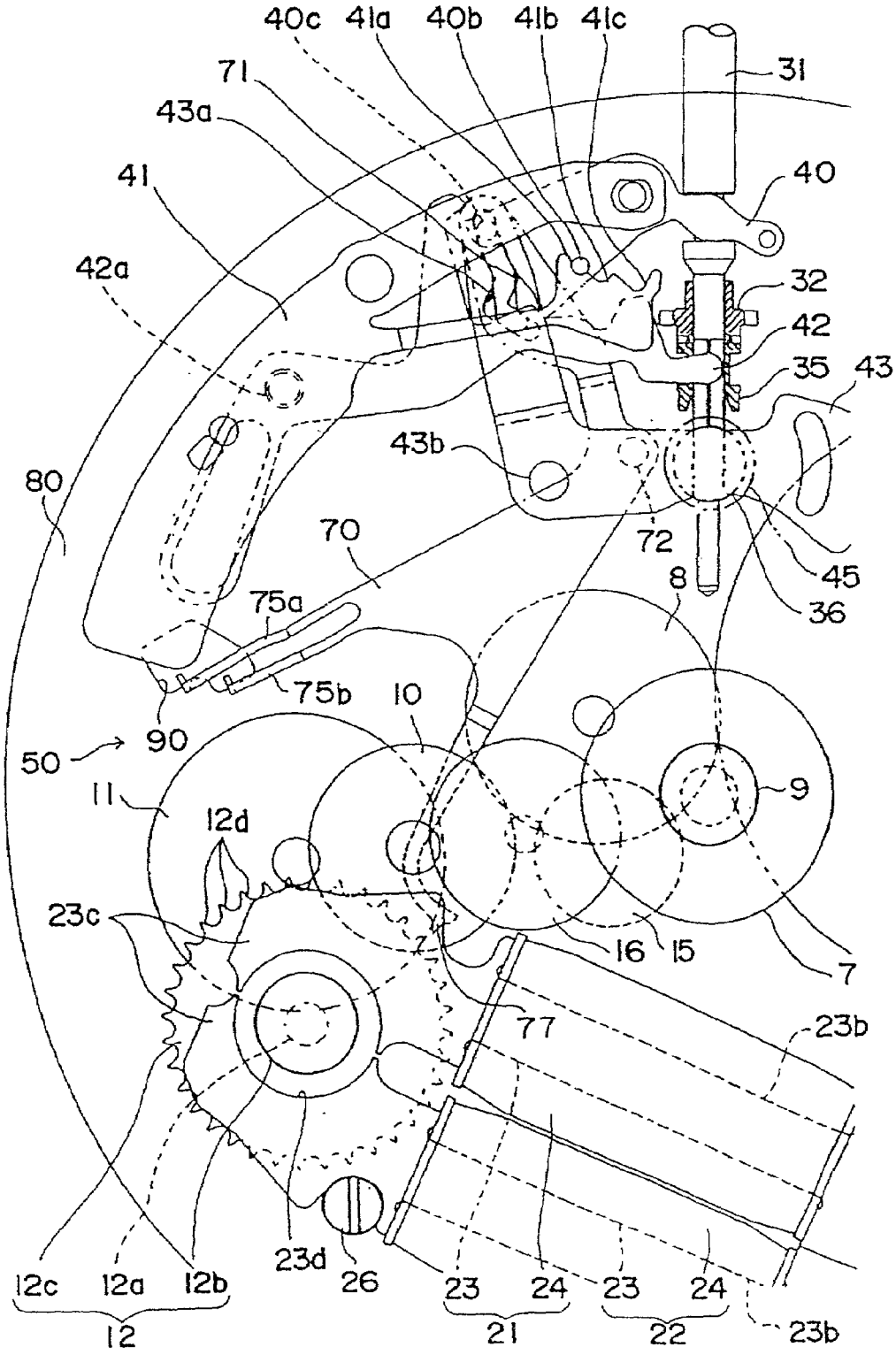
FIG. 16 is a plan view showing a starter of the second embodiment in the hand driving state.
Figure 17:
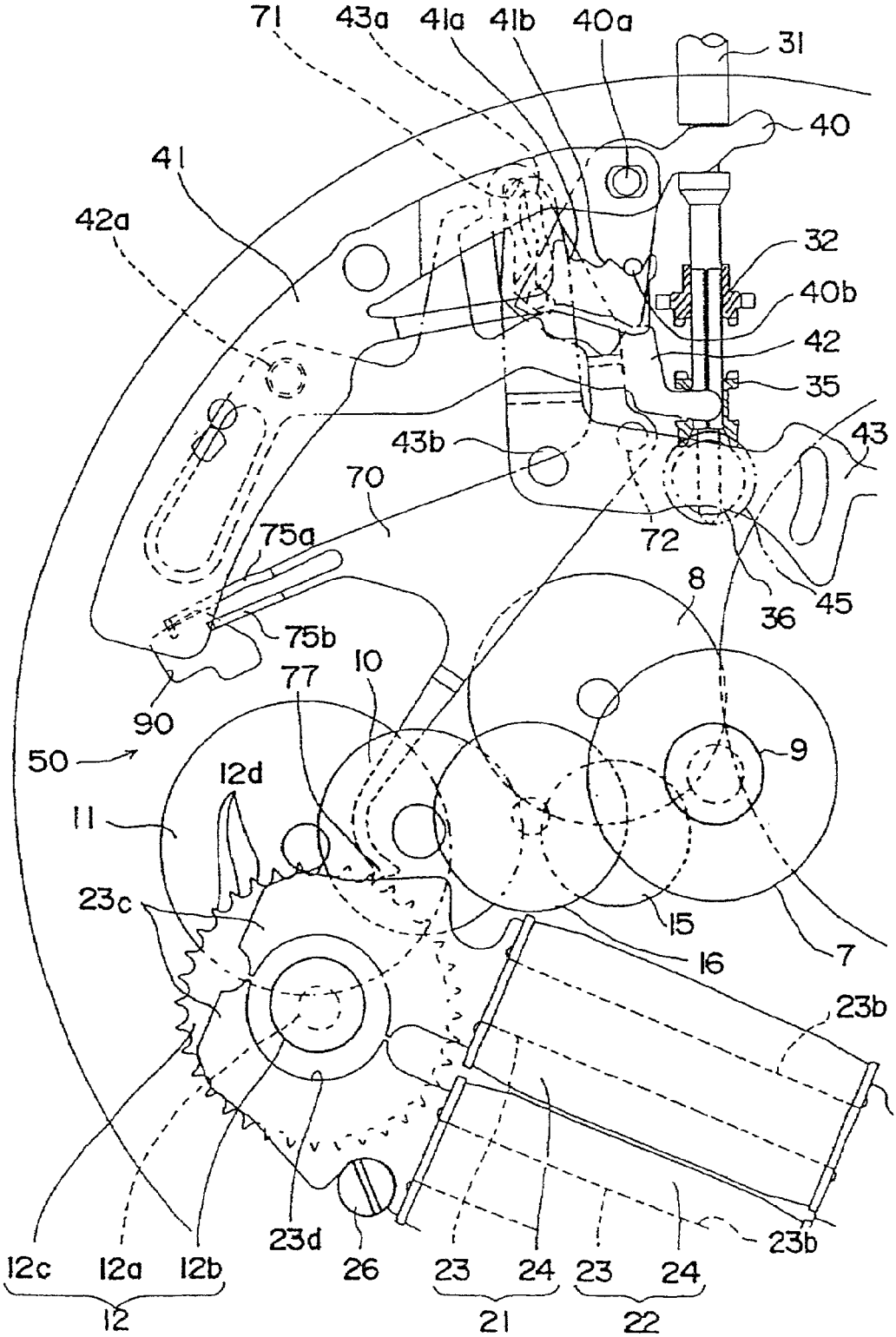
FIG. 17 is a plan view showing the starter of the second embodiment in the hand setting state.

The setting lever 40 is, as shown in FIGS. 16 and 17, supported rotatably about a shaft 40*a* and engaged with the winding stem 31. Then, the setting lever 40 includes a positioning pin 40*b* engageable with any of three engagement grooves 41*a*, 41*b*, 41*c* formed in the yoke holder 41, and a pin 40*c* engaged in grooves 43*a*, 71 formed respectively in the setting wheel lever 43 and the reset lever 70, the pin 40*c* being also shown in FIG. 20. Further, a corner portion of the setting lever 40 is constructed to be able to contact the yoke 42 for turning the same.

The yoke holder 41 is constructed such that the position of the winding stem 31, i.e., of the crown, can be set to any of three stages, i.e., zero-th, first and second stages, by engaging the positioning pin 40*b* of the setting lever 40 in corresponding one of the engagement grooves 41*a*–41*c*.

The yoke 42 is supported rotatably about a shaft 42*a*. The yoke 42 has one end engaged with the sliding pinion 35. Therefore, when the winding stem 31 is pulled out to the first or second stage and the setting lever 40 is rotated counterclockwise in the drawings, the one end of the yoke 42, i.e., the sliding pinion 35, is pushed by the setting lever 40 to move toward the center of the watch for engagement with the setting wheel 36.

Upon the pin 40*c* being moved in the groove 43*a*, the setting wheel lever 43 is turned about a shaft 43*b*. In this connection, a shape of the groove 43*a* is designed such that the setting wheel lever 43 is allowed to move in two steps; one step in which the crown is set to the zero-th or first stage and the other step in which the crown is set to the second stage. The setting wheel 36 is attached to the setting wheel lever 43, as described above, and with the movement of the setting wheel lever 43, the setting wheel 36 is moved toward the center of the watch for engagement with the minute wheel 38.

Figure 18:
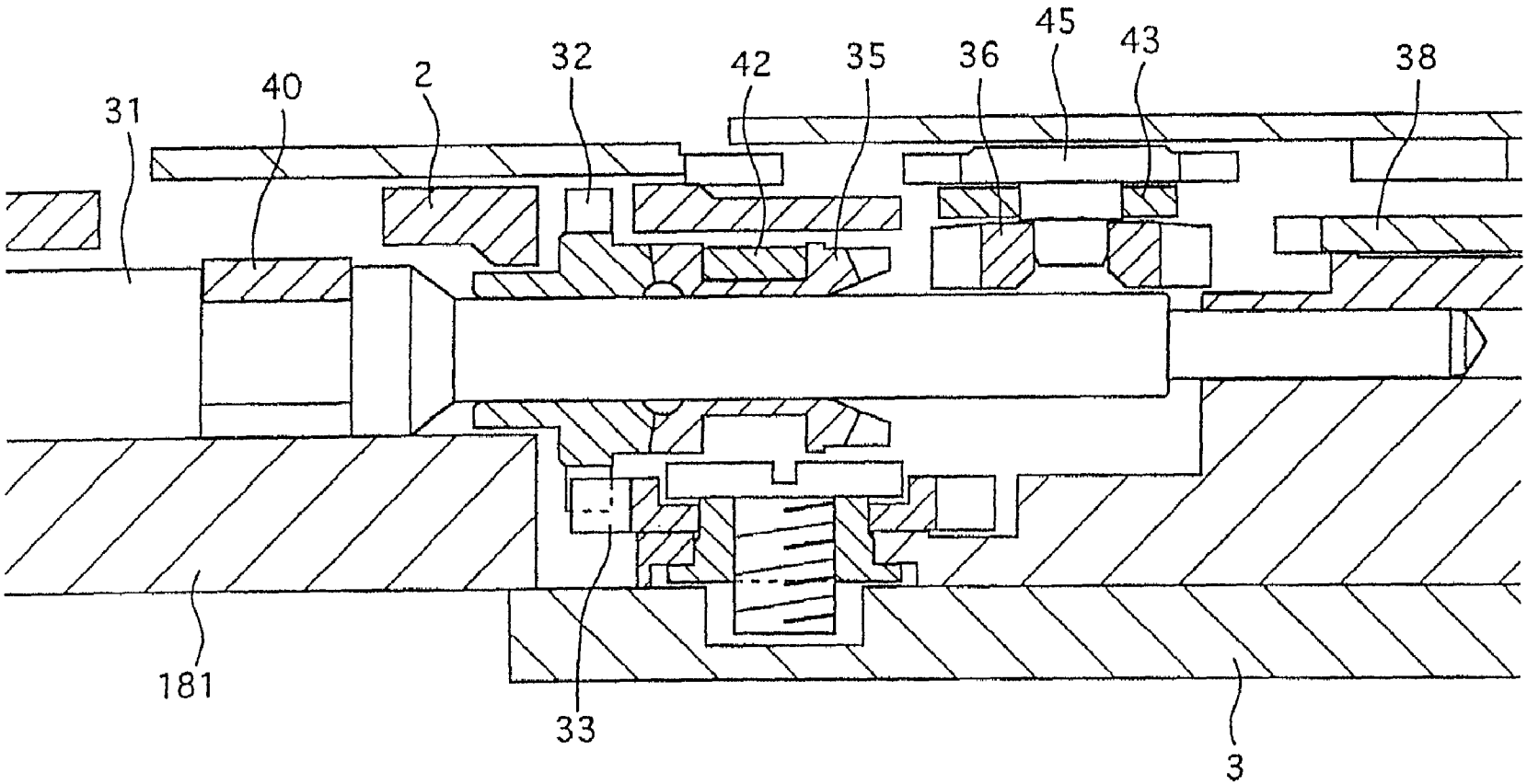
FIG. 18 is a sectional view showing a winding stem portion of the second embodiment in the hand driving state.
Figure 19:
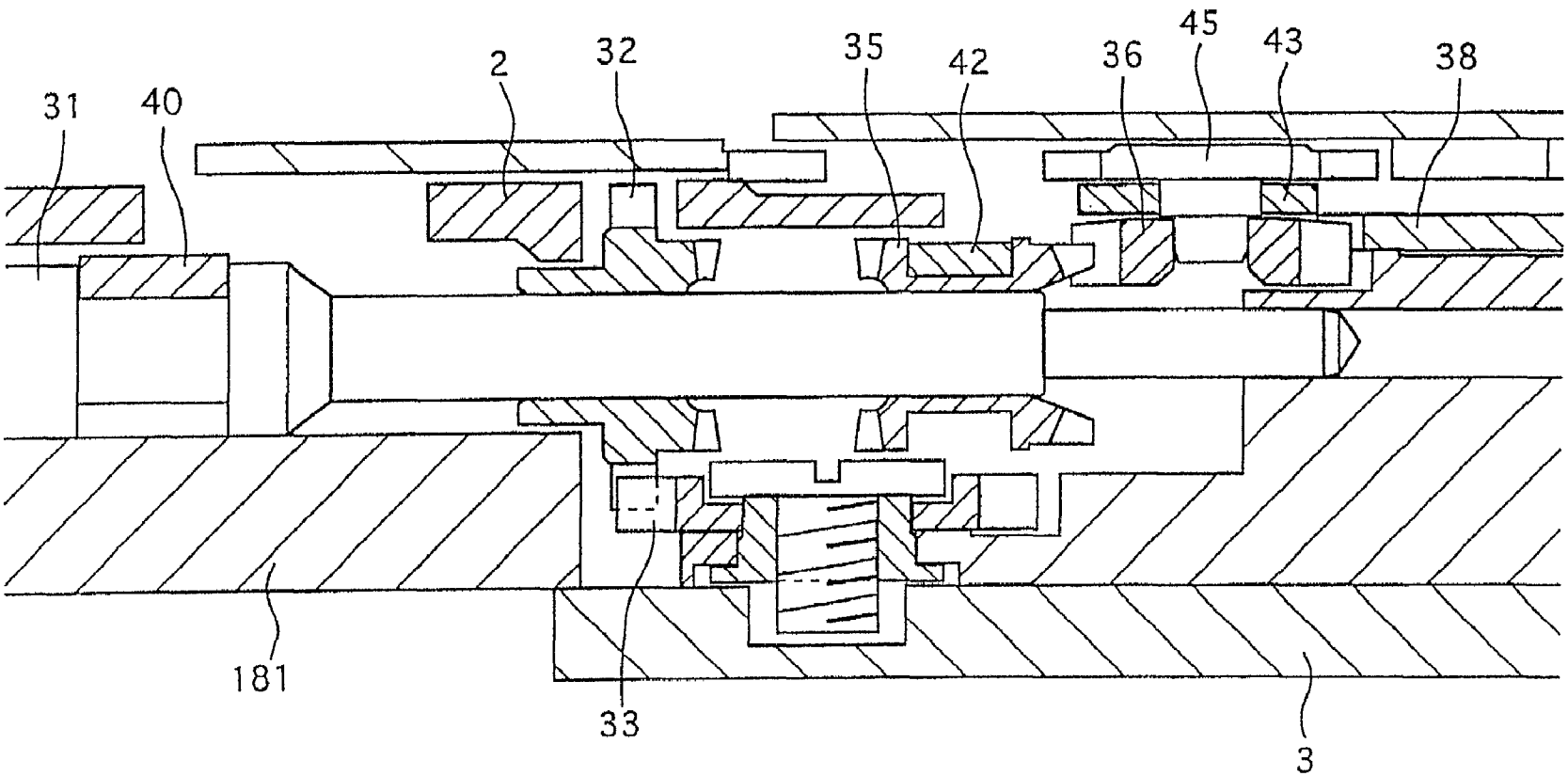
FIG. 19 is a sectional view showing the winding stem portion of the second embodiment in the hand setting state.

Moreover, as shown in FIGS. 18 and 19, with such an arrangement that a shaft of the calendar corrector transmitting wheel 45 is inserted through a hole formed in the setting wheel lever 43 and the setting wheel 36 is fitter over the shaft of the calendar corrector transmitting wheel 45, the setting wheel 36 is attached to the setting wheel lever 43 to be able to turn together with the calendar corrector transmitting wheel 45.

Figure 21:
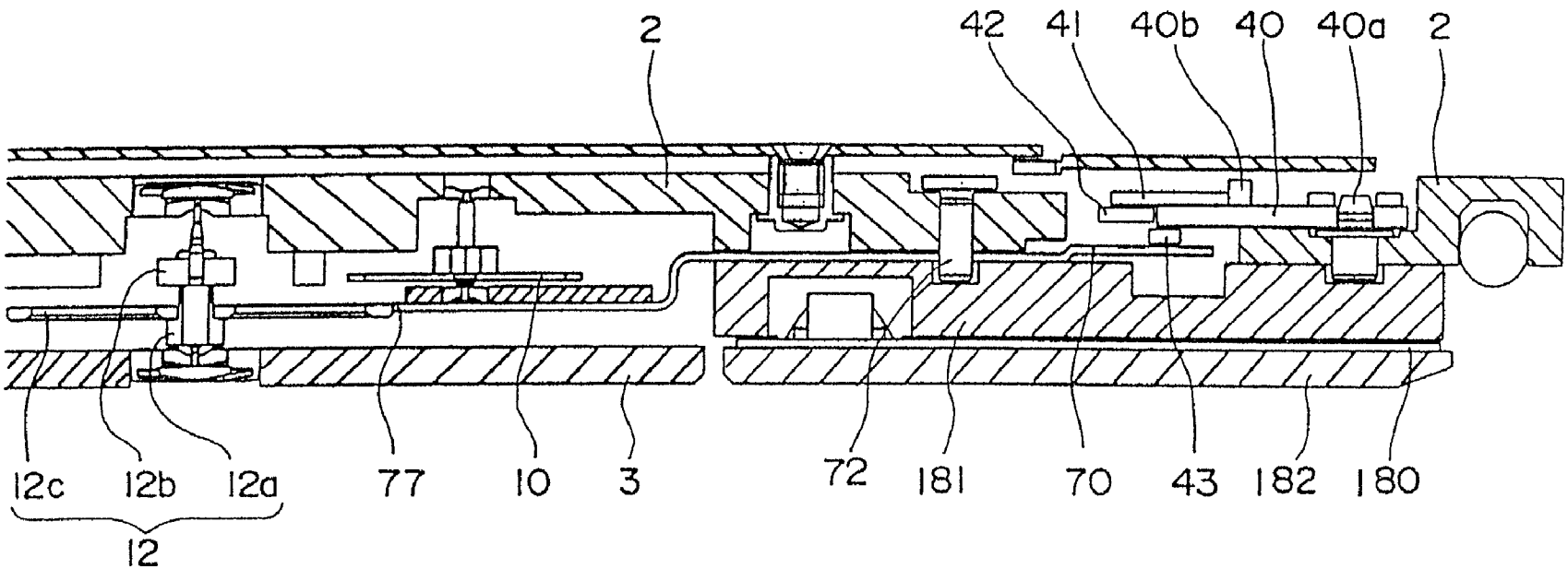
FIG. 21 is a sectional view showing principal part of the second embodiment.

The reset lever 70 is supported rotatably about a shaft 72, as also shown in FIG. 21. A shape of the groove 71 is designed such that the reset lever 70 is likewise allowed to move in two steps; one step in which the crown is set to the zero-th or first stage and the other step in which the crown is set to the second stage.

The reset lever 70 includes an engaging portion 77 capable of engaging with an engaged portion, i.e., the tooth profile 12*d* of the rotor inertia disk 12*c*, which constitutes the outer peripheral portion of the rotor 12, and two switch portions 75*a*, 75*b* arranged in a hole 90 formed in a circuit block 180.

The reset lever 70 is arranged such that when the crown is pulled out to the second stage, the engaging portion 77 is engaged with the tooth profile 12*d* of the rotor inertia disc 12*c*, and when the crown is pushed in, the engaging portion 77 is moved for applying a rotating force to the rotor inertia disc 12*c*.

As shown in FIGS. 16 and 17, the switch portion 75*a* of the reset lever 70 is brought into contact with the circuit block 180 on one side of the hole 90 when the winding stem 31 is in the zero-th or first stage, and is brought into contact with the circuit block 180 on the other side of the hole 90 when the winding stem 31 is in the second stage. Such an arrangement makes it possible to detect whether the winding stem 31 is in one of the zero-th and first stages or the second stage.

Also, the switch portion 75*b* of the reset lever 70 is brought into contact with the circuit block 180 when the winding stem 31 is in the zero-th or first stage, and is moved away from the circuit block 180 when the winding stem 31 is in the second stage. This mechanical switch portion 75*b* of the reset lever 70 constitutes the aforesaid switch 131 for the capacitor 132.

Figure 20:
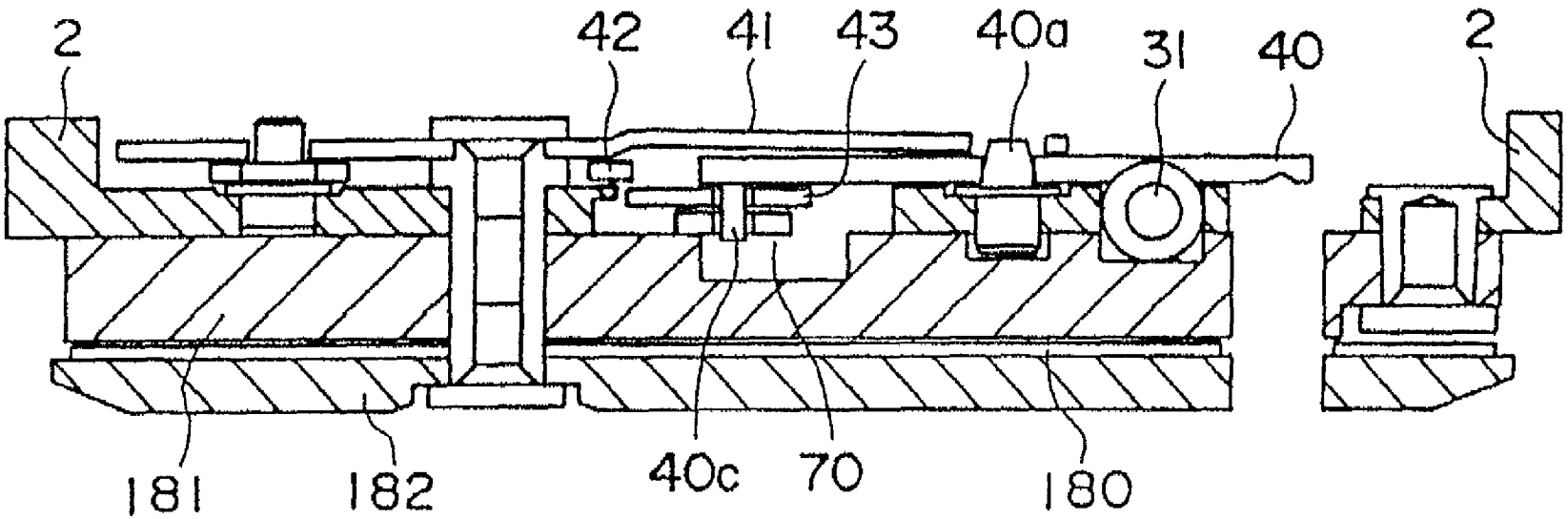
FIG. 20 is a sectional view showing principal part of the second embodiment.

Additionally, the circuit block 180 is constructed by attaching an IC, for example, to a flexible board. As shown in FIGS. 18, 20 and 21, the circuit block 180 is fixed by being held between a circuit receiving seat 181 screwed to the main plate 2 and a circuit retaining seat 182 also screwed to the main plate 2.

The operation of the starter 50 in this embodiment will be described.

First, when the crown is in the normal pushed-in position, as shown in FIG. 16, the positioning pin 40*b* of the setting lever 40 is engaged in the engagement groove 41*a* of the yoke holder 41, and the pin 40*c* is engaged in the grooves 43*a*, 71 of the setting wheel lever 43 and the reset lever 70. In this condition, the sliding pinion 35 is engaged with the winding pinion 32. By turning the crown, therefore, the ratchet wheel 4 is rotated through the winding stem 31, the sliding pinion 35, the winding pinion 32 and the crown wheel 33, whereby the mainspring 1*a* can be wound up.

Also, the setting wheel 36 is held in a position out of engagement with the minute wheel 38. Further, the engaging portion 77 of the reset lever 70 is held in a position apart away from the rotor inertia disk 12*c*.

Then, as shown in FIG. 17, when the crown is pulled out to the second stage, the setting lever 40 is rotated counterclockwise about the shaft 40*a* and the positioning pin 40*b* of the setting lever 40 is engaged in the engagement groove 41*b* of the yoke holder 41. Simultaneously, the end portion of the yoke 42 is pushed by the corner portion of the setting lever 40 toward the center of the watch, causing the sliding pinion 35 to move toward the setting wheel 36. Also, the setting wheel lever 43 is rotated clockwise about the shaft 43*b* by the pin 40*c* of the setting lever 40, causing the setting wheel 36 to move toward the minute wheel 38. As a result, the sliding pinion 35 is engaged with the setting wheel 36 and the setting wheel 36 is engaged with the minute wheel 38 so that the time setting can be made by turning the crown.

At the same time, the reset lever 70 is rotated clockwise about the shaft 72. With the rotation of the reset lever 70, the engaging portion 77 of the reset lever 70 is engaged with the rotor inertia disk 12*c*.

Figure 22:
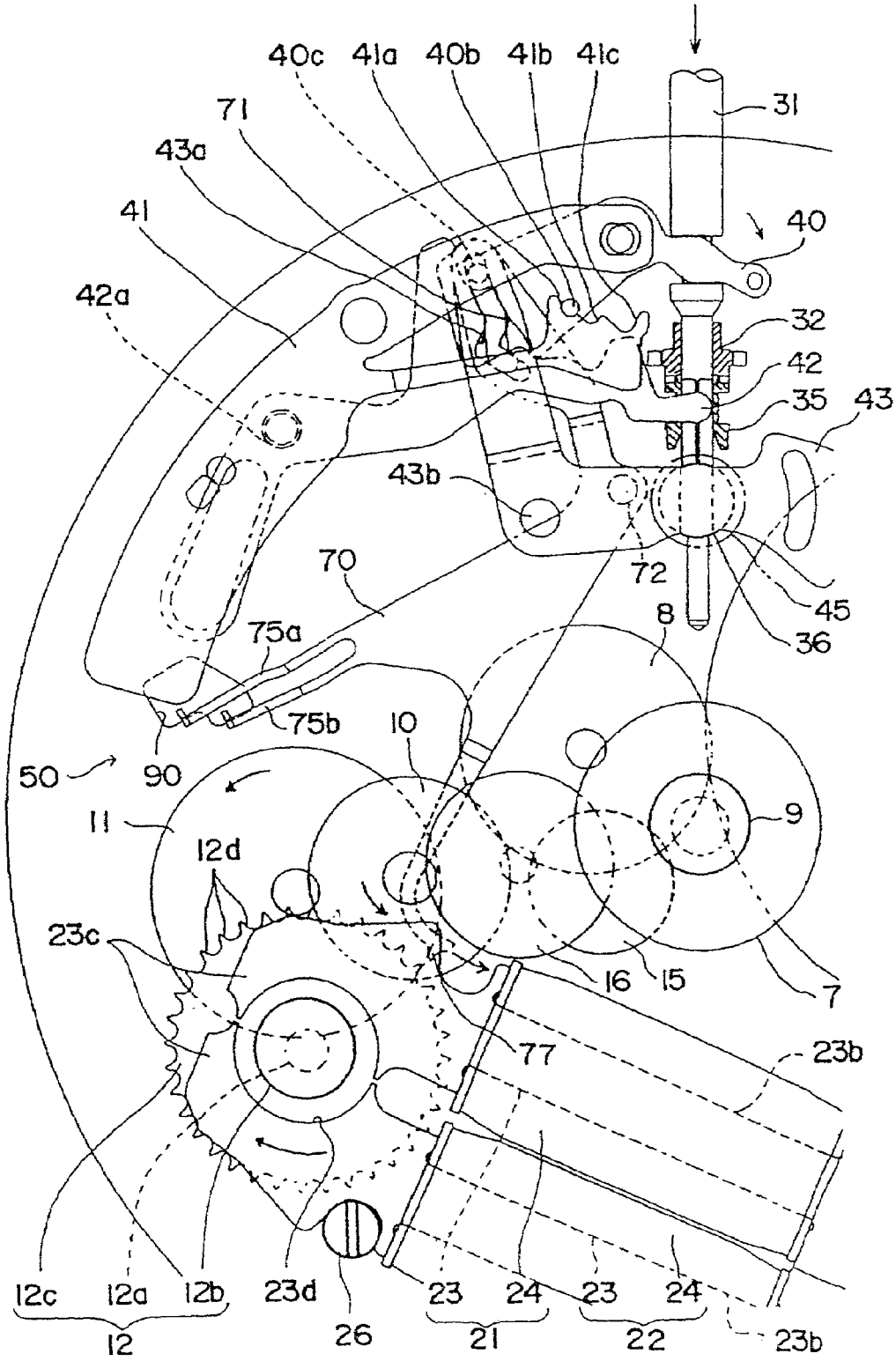
FIG. 22 is a plan view showing the starter of the second embodiment in the operative state.

When the crown is pushed in to finish the hand setting operation after turning the crown and setting the hands right, the setting lever 40 is rotated clockwise and the pin 40*c* is moved within the groove 71 in interlock with the pushing-in of the crown, as shown in FIG. 22. The reset lever 70 is thereby rotated counterclockwise for return to the original position.

Also, with the movement of the reset lever 70, the engaging portion 77 of the reset lever 70 is quickly disengaged from the rotor inertia disk 12*c* and returned to the original position. At this time, the fore end of the engaging portion 77 is moved in the tangential direction of the rotor inertia disk 12*c*, whereupon a mechanical rotating force is applied to the rotor inertia disk 12*c* in the direction of arrow (clockwise). With the rotation of the rotor inertia disk 12*c*, the 6th wheel 11 is rotated and the hands are moved through the wheel train comprising the 5th wheel 10, the 5th second intermediate wheel 16, the 5th first intermediate wheel 15, the 4th wheel 9, etc.

The rotating force thus produced may be appropriately set in practice. In this embodiment, the produced rotating force is set to a level enough to rotate the rotor 12 at a speed close to the reference one (speed at which the hands are allowed to move precisely, i.e., speed at which the second hand, for example, is moved in one second through a angular distance corresponding to one second; e.g., 8 Hz).

Upon the crown being pushed in for return from the hand setting operation, the power generator 20 starts to operate. At this startup of the power generator 20, the rotating force is applied to the rotor inertia disk 12*c* by the reset lever 70 in addition to the rotating force from the mainspring 1*a*. Accordingly, the rotor 12 is rotated at an increased speed as soon as the startup and the power outputted from the power generator 20 is increased up to a large value in a short time.

This second embodiment thus constructed has the following advantages.

(21) By providing the starter 50 including the reset lever 70 which is operated in interlock with the manipulation of pushing in the crown for return from the hand setting operation, a mechanical rotating force is directly applied to the rotor inertia disk 12*c* using the reset lever 70. An increase in speed error due to speed-up through the wheel train, which has occurred in the comparative case of applying a rotating force to the wheel train, can be avoided and the rotor 12 can be rotated at a predetermined speed. Accordingly, the rotation of the rotor 12 can be stabilized and a time lapsed until the start of driving of the IC can be made constant. It is hence possible to eliminate an error in setting of the correct time by adding a preset compensation value, and manage the indication of time with high accuracy.

It is assumed, for example, that a rotating force capable of rotating the 7th wheel (rotor 12) at 240 Hz is applied in the case of directly driving the pinion of the 6th wheel 11 by the reset lever. Considering a moving speed of the reset lever on condition that the speed-up ratio from the 6th wheel 11 to the rotor 12 is 10, the 6th wheel 11 is rotated at 240÷10=24 Hz. From the outer circumferential speed of the 6th wheel, the speed of the reset lever in this case is determined by 2×π×0.5 mm (radius of the 6th pinion)×24 (Hz)=75.4 mm/s. When the rotor inertia disk 12*c* is directly driven by the reset lever 70 moving at the above speed, the rotating speed of the rotor inertia disk 12*c* is given by f=outer circumferential speed of the inertia disk/(2×π×radius of the inertia disk)=75.4/(2×π×3)=4.0 (Hz).

Through similar calculation, if the rotor inertia disk 12*c* is directly driven by the reset lever 70 by applying a rotating force with which the 7th wheel is rotated at 200 Hz when applied to the 6th wheel, the rotating speed f of the rotor inertia disk 12*c* is given by 3.33 Hz. Also, if the rotor inertia disk 12*c* is directly driven by the reset lever 70 by applying a rotating force with which the 7th wheel is rotated at 280 Hz when applied to the 6th wheel, the rotating speed f of the rotor inertia disk 12*c* is given by 4.66 Hz. In other words, applying the difference rotating forces by using the same reset lever 70 causes a variation of 200–280 Hz, i.e., 80 Hz, in the rotational speed of the rotor 12 when the pinion of the 6th wheel is driven, but causes a variation of 3.33–4.66 Hz, i.e., 1.33 Hz, in the rotational speed of the rotor 12 when the rotor inertia disk 12*c* is directly driven. Thus, an error in the rotational speed of the rotor 12 caused by variations in the driving force of the reset lever 70 can be reduced down to about ⅙ of that in the comparative case, and the rotor 12 can be rotated substantially at the predetermined speed.

(22) The reset lever 70 includes the engaging portion 77 formed to be directly engageable with the outer peripheral portion of the rotor 12. With a first operation such as pulling out the crown for setting the hands right, therefore, the rotor 12 can be positively restricted from rotating and the hand setting operation can be precisely performed. Also, with a second operation such as pushing in the crown after the end of the hand setting, the rotor 12 can be started up at once.

(23) Since the engaging portion 77 of the reset lever 70 is made engageable with the tooth profile 12*d* of the rotor inertia disk 12*c* that has the largest diameter among the parts of the rotor 12, greater moment of rotation can be produced with a smaller force applied to the reset lever 70. Therefore, the rigidity required for the reset lever 70 can be reduced to a comparatively small value, and the reset lever 70 can be formed of a comparatively thin member. It is thus possible to reduce the weight of the reset lever 70 and arrange it with more easiness.

(24) With the provision of the slip mechanism between the rotor's rotating shaft and the rotor inertia disk 12*c*, even if a force greater than the predetermined value is applied to the rotor inertia disk 12*c*, the rotor inertia disk 12*c* slips relative to the rotor's rotating shaft and the rotation of the rotor is suppressed. As a result, the rotational speed of the rotor 12 can be always held constant.

(25) Since the engaging portion 77 is moved in the tangential direction, i.e., the rotating direction, of the rotor inertia disk 12*c*, the efficiency in rotating the rotor inertia disk 12*c* by the reset lever 70 can be so increased that the rotor can be always started up with stability.

(26) There are provided the switch 131 (switch portion 75*b*) intermittently turned on and off in response to manipulation of the crown, and the capacitor 132 connected to the IC 151 through the switch 131. Accordingly, the voltage of the capacitor 132 can be maintained during the hand setting operation in which the power generator 20 is stopped, and the capacitor 130 can be momentarily charged with the power from the capacitor 132 when the crown is pushed in for return from the hand setting operation. Hence the IC 151 can be started up quickly, for example, in about 1 second.

(27) Since the rotating force is directly applied to the rotor inertia disk 12*c* by the reset lever 70, the rotational speed of the rotor 12 can be controlled with high accuracy. For example, it is possible to always start up and rotate the rotor 12 at the reference speed (e.g., 8 Hz). This enables the hands to be precisely moved during a period from the time at which the rotation controller 150 is supplied with power for the startup to the time at which the rotation controller 150 actually starts control, e.g., a period of about one second. As a result, an error in indication of the time can be eliminated.

(28) Since the rotor 12 can be started up by additionally applying a mechanical rotating force, the power generator 20 may have a core which makes it harder to start up the power generator 20 because of the presence of cogging torque. Using the power generator 20 provided with a core is advantageous in that the rotor magnet 12*b* of the rotor 12 can be reduced in size and impact resistance can be enhanced. Thus, the electronically controlled mechanical watch can be made smaller in size and more resistant against an impact.

(29) The reset lever 70 can be moved at a constant speed regardless of the speed at which the crown is pushed in. Therefore, the rotating force applied to the rotor inertia disk 12*c* by the reset lever 70 can also be always kept constant, and a stable and constant rotating force can be applied to the rotor 12. In addition, there is no need of considering, e.g., the pushing-in speed of the crown, thus resulting in improved operability.

(30) The starter 50, i.e., the reset lever 70, is operated in interlock with the operation of pushing in the crown (external operating member), i.e., the manipulation to effect return from the hand setting. Therefore, the starter 50 can be operated without needing consciousness of an operator, and operability can be further improved.

(31) Even when the rotating force applied by the reset lever 70 is not so high in accuracy, the rotational speed of the rotor 12 can be maintained constant. It is therefore possible to simplify the structure of the reset lever 70 and realize a reduction in both the number of parts and cost.

Third Embodiment

Next, a third embodiment of the present invention will be described. Note that, in this embodiment, the same or similar components as those in the above first embodiment are denoted by the same symbols and a description thereof is omitted or abridged.

In the above first embodiment, the latch portion 73 and the startup-spring biasing portion 74 of the reset lever 70 are formed as integral parts of a one-piece member and the relative positional relationship between them is not changed. In this embodiment, as shown in FIGS. 23 and 24, a slit is formed in the reset lever 70 between the latch portion 73 engaging with the 6th pinion 11*a* and the startup-spring biasing portion 74 for biasing the startup spring 60 so that the latch portion 73 and the startup-spring biasing portion 74 are constructed as separate pieces and the relative positional relationship between them is changeable.

Figure 25:
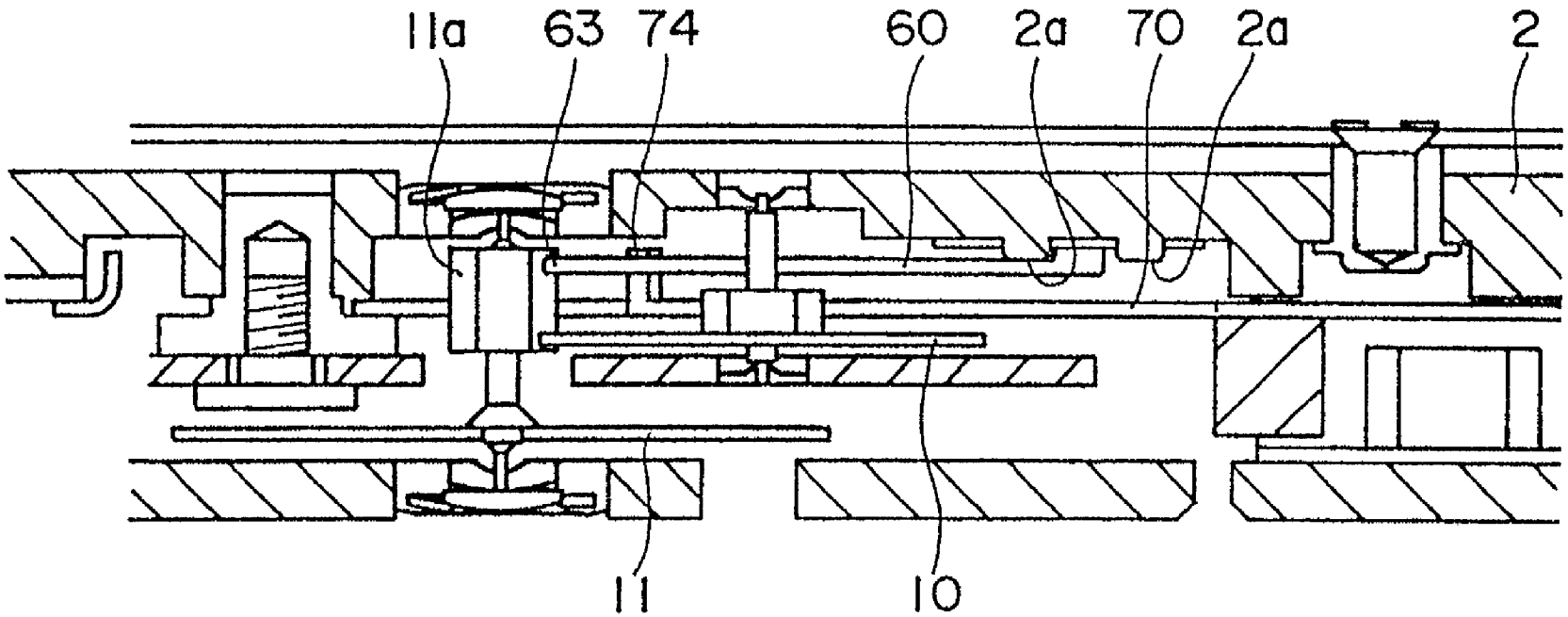
FIG. 25 is a sectional view showing principal part of the third embodiment.

Further, in the above first embodiment, the startup spring 60 is fixed to the main plate 2 by the set pin 61 so that the initial position of the startup spring 60 can be adjusted by rotating the pin 61. In this embodiment, as shown in FIG. 25, the startup spring 60 is fixed by press-fitting its base end between two projections 2*a* formed on the main plate 2.

Figure 24:
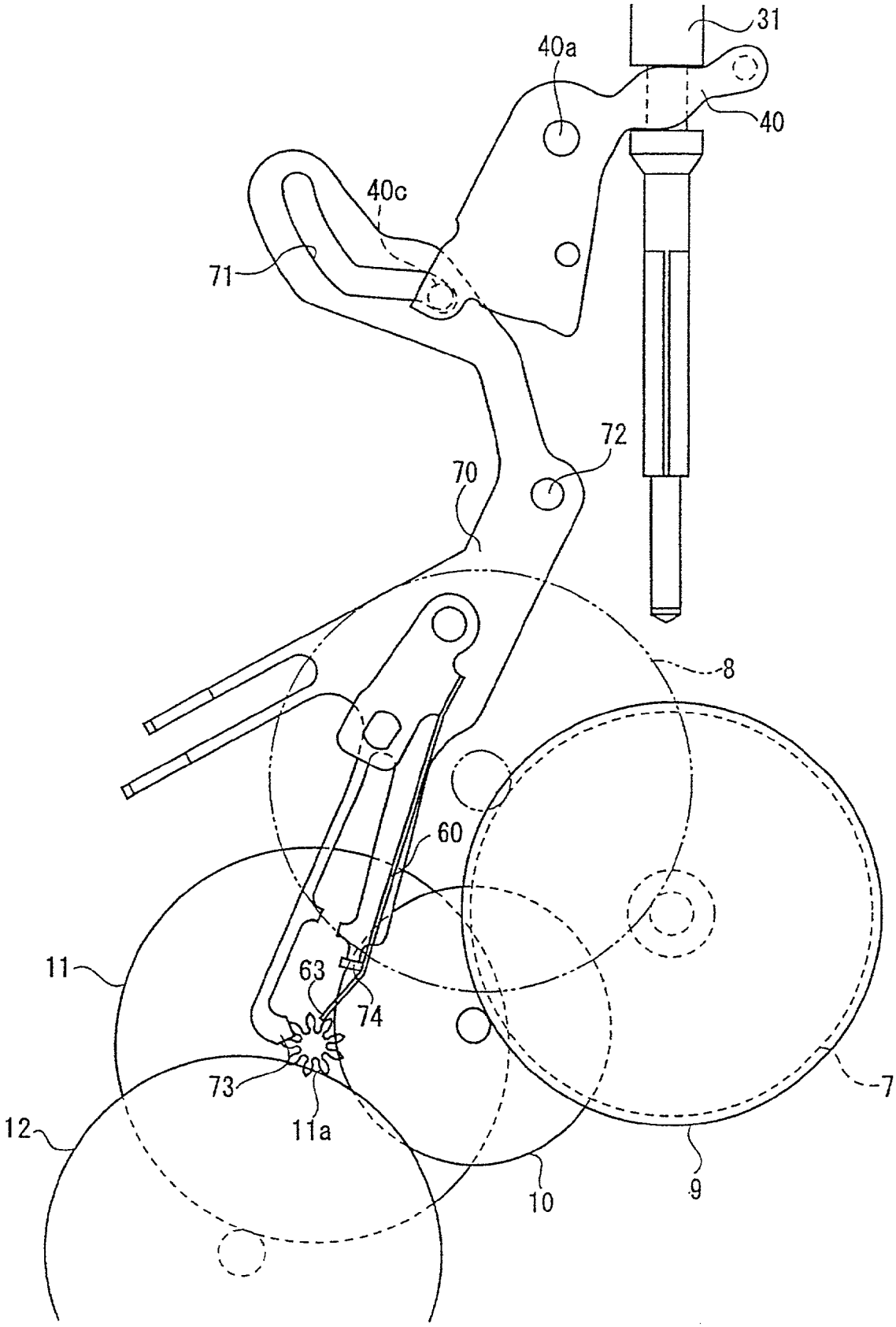
FIG. 24 is a plan view showing the starter of the third embodiment in the hand setting state.

In this embodiment having the above construction, as shown in FIG. 24, when the crown is pulled out and the reset lever 70 is rotated counterclockwise in the drawing about the shaft 72, the latch portion 73 is first engaged with the pinion 11*a*. Then, the startup spring 60 is pushed by the startup-spring biasing portion 74, whereupon the startup spring 60 is deflected to such an extent that the engaging portion 63 at the fore end of the startup spring 60 is engaged with a tooth (engaged portion) of the pinion 11*a*.

Figure 23:
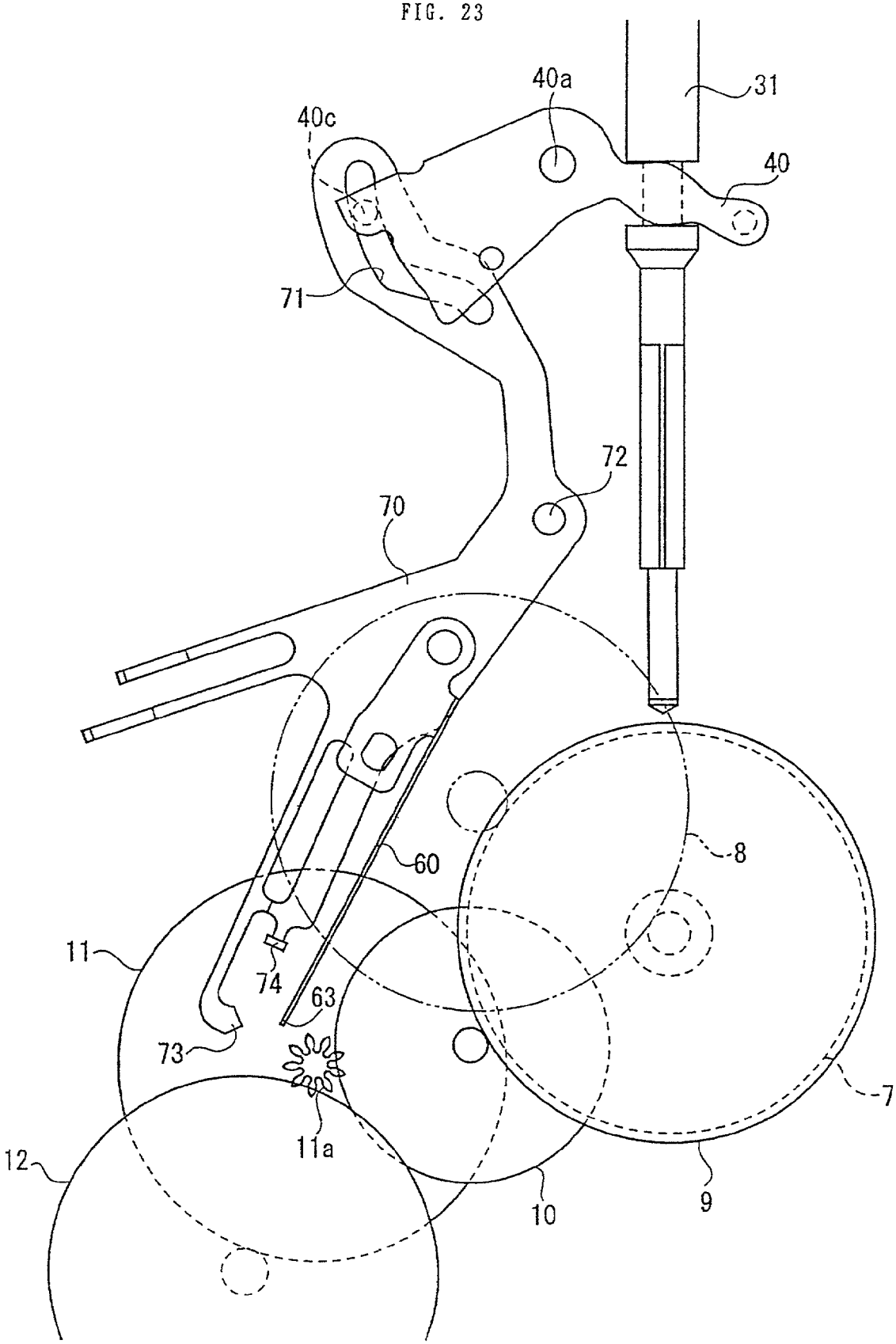
FIG. 23 is a plan view showing a starter of a third embodiment of the present invention in the hand driving state.

When the crown is pushed in to finish the hand setting operation, as shown in FIG. 23, the reset lever 70 is rotated clockwise in the drawing for return to the original position in response to the pushing-in of the crown. On this occasion, the startup-spring biasing portion 74 is first moved and the latch portion 73 is then moved in such a manner that the portions 74, 73 quickly depart away respectively from the startup spring 60 and the pinion 11*a*. Therefore, the startup spring 60 is returned to the original position by its own spring force. At the same time, a mechanical rotating force is applied to the 6th pinion 11*a*, whereby the rotor 12 is rotated as with the above first embodiment.

In addition to the same advantages as (1), (2) and (4) to (12) of the above first embodiment, this embodiment can provide another advantage (13) that, even with some variations in dimensional accuracy of parts of the reset lever 70, e.g., the latch portion 73, resulting fluctuations in the mechanical rotating force applied to the pinion 11*a* are held down and stable rotation of the pinion 11*a* can be achieved.

Still another advantage (14) is that the latch portion 73 can be always set so as to engage with the pinion 11*a* earlier such that the timing at which the latch portion 73 is engaged with the pinion 11*a* and the timing at which the engaging portion 63 of the startup spring 60 is engaged with the engaged portion of the pinion 11*a* always occur in the constant sequence; hence the startup spring 60 can be positively and easily engaged with the pinion 11*a*.

The above advantages lead to still another one (15) that, since there is no need of fixing the startup spring 60 by the set pin 61 for adjustment of the initial position of the startup spring 60, the startup spring 60 can be fixed by press-fitting its base end between the projections 2*a* of the main plate 2; hence the manufacturing process can be simplified and the manufacturing capacity can be easily increased.

More specifically, in the first embodiment, the relative positional relationship between the latch portion 73 and the startup-spring biasing portion 74 of the reset lever 70 is fixed. Therefore, if variations occurred in the manufacturing process, for example, cause an error in length by which the startup-spring biasing portion 74 is projected, an error is also caused in the mechanical rotating force applied to the pinion 11*a*. In the case of using the reset lever 70 with the startup-spring biasing portion 74 having a small projection size, the startup spring 60 cannot be sufficiently biased by the startup-spring biasing portion 74 when the latch portion 73 is engaged with the pinion 11*a*. Accordingly, the mechanical rotating force applied to the pinion 11*a* is reduced. On the other hand, in the case of using the reset lever 70 with the startup-spring biasing portion 74 having a large projection size, the startup spring 60 is overly biased by the startup-spring biasing portion 74 when the latch portion 73 is engaged with the pinion 11*a*. Accordingly, the mechanical rotating force applied to the pinion 11*a* becomes too large. For those reasons, the initial position of the startup spring 60 must be adjusted by the set pin 61, thus resulting in a fear of lowering of the production efficiency. By contrast, in this embodiment, since the latch portion 73 and the startup-spring biasing portion 74 are formed as separate pieces, some dimensional error can be absorbed, even if it occurs, through flexing of the latch portion 73, for example. As a result, adjustment of the initial position of the startup spring 60 is no longer needed.

Fourth Embodiment

Next, a fourth embodiment of the present invention will be described. Note that, in this embodiment, the same or similar components as those in the above second embodiment are denoted by the same symbols and a description thereof is omitted or abridged.

Figure 26:
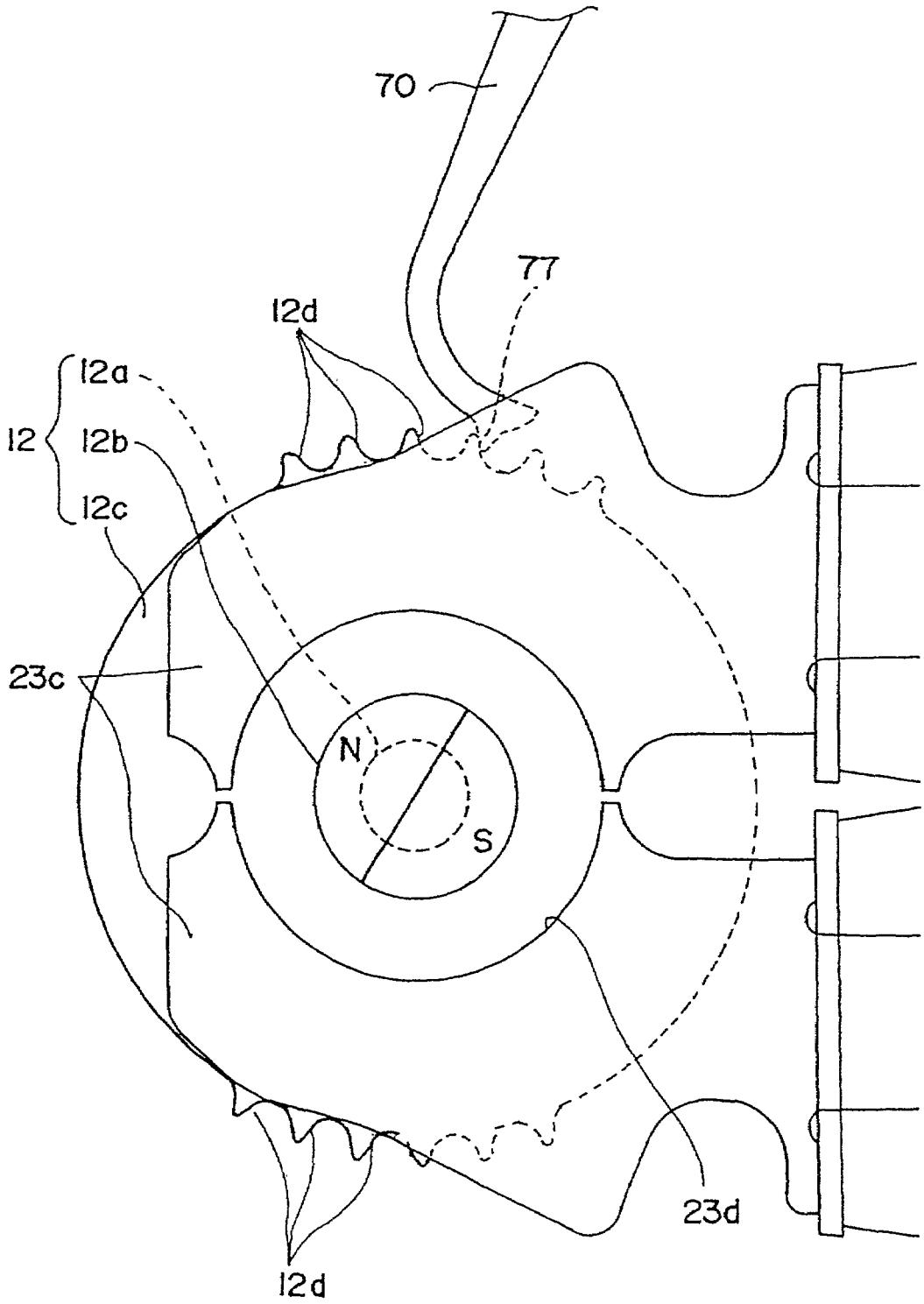
FIG. 26 is a plan view showing principal part of a fourth embodiment of the present invention.

FIG. 26 shows, in enlarged scale, an area including a rotor 12 according to the fourth embodiment of the present invention. While the tooth profile 12*d* is formed, as the engaged portion, along the overall circumference of the rotor inertia disk 12*c* in the above second embodiment, the tooth profile 12*d* is partly formed along the circumference of the rotor inertia disk 12*c* in this fourth embodiment.

More specifically, the tooth profile 12*d* of the rotor inertia disk 12*c* is formed in two regions which are parts of the outer circumference of the rotor inertia disk 12*c* and are opposed to each other. Then, the rotor magnet 12*b* is set such that, when the reset lever 70 is engaged with the tool profile 12*d*, the magnetic-pole direction of the rotor magnet 12*b* is deviated from the diametrical direction in which the tooth profiles 12*d* are positioned. With such an arrangement, when the engaging portion 77 of the reset lever 70 is engaged with the tooth profile 12*d*, the rotor 12 can be restricted to a position offset from the statically stable position thereof.

In addition to the same advantages as (21) to (31) of the above second embodiment, this fourth embodiment can provide another advantage (32) that, since the rotor 12 is restricted to a position offset from the statically stable position thereof, the effect of cogging torque at the startup is reduced and a required startup torque to be applied by the reset lever 70 can be reduced correspondingly.

Fifth Embodiment

Figure 27:
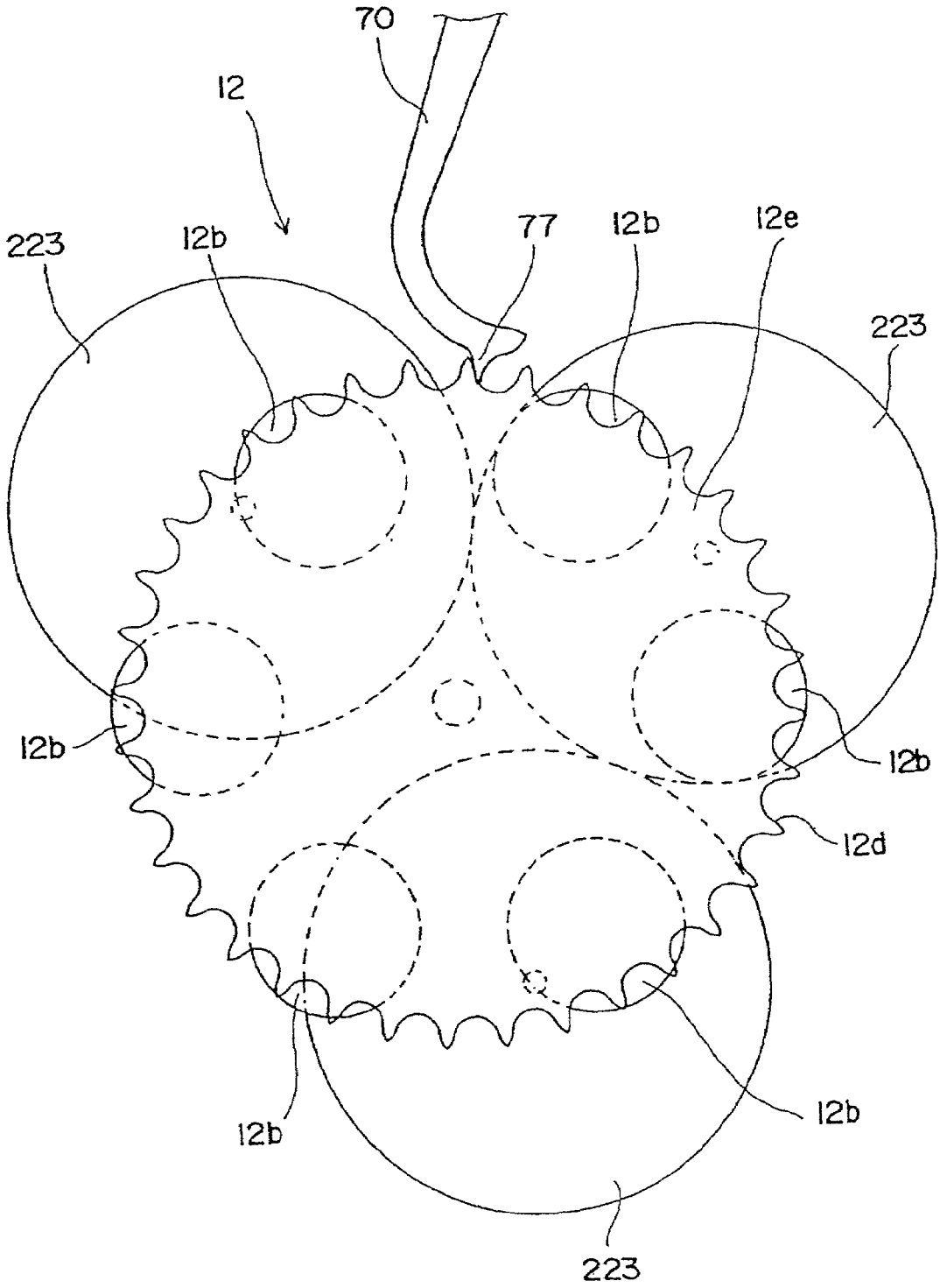
FIG. 27 is a plan view showing principal part of a fifth embodiment of the present invention.
Figure 28:
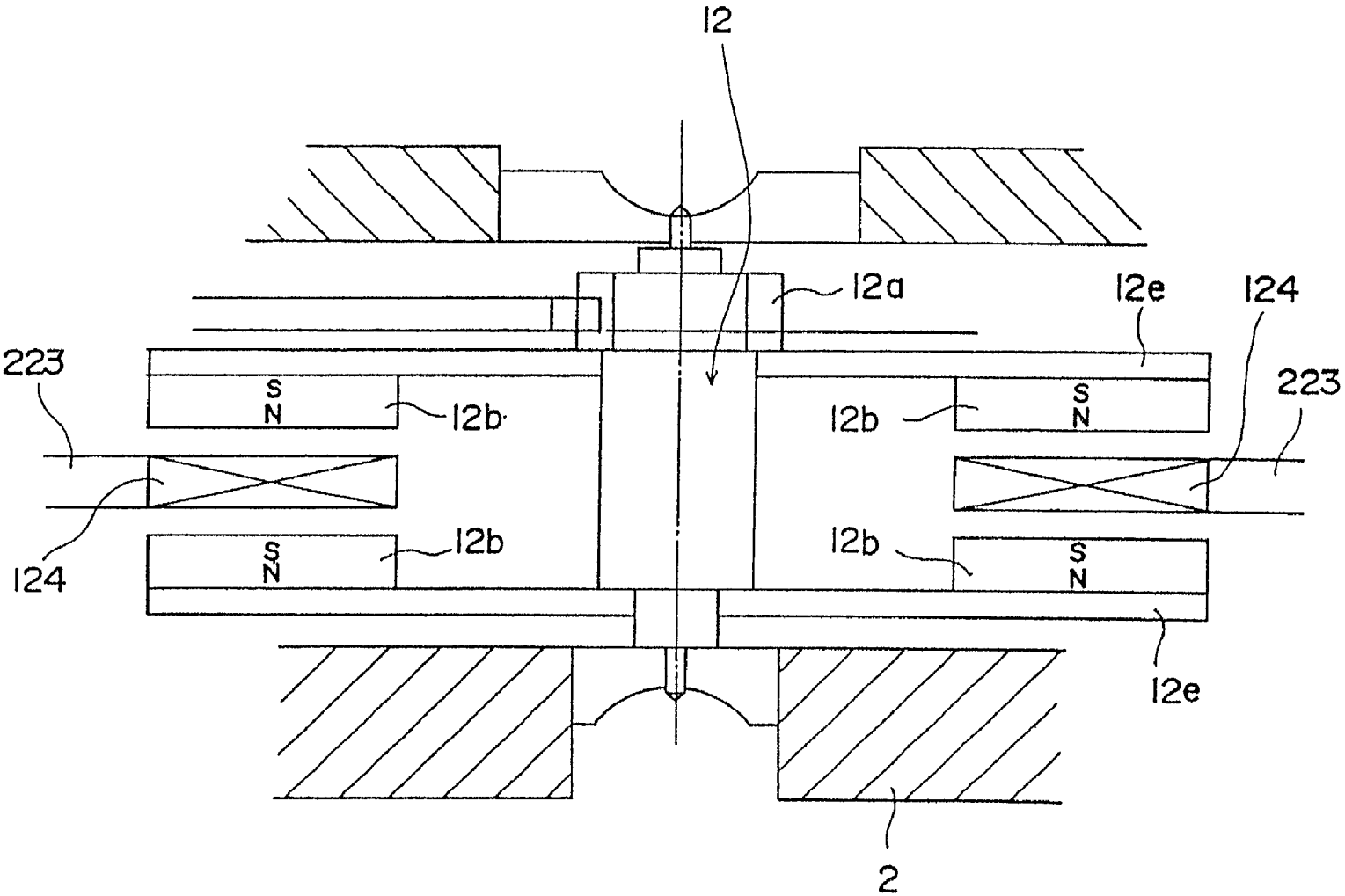
FIG. 28 is a sectional view showing principal part of a fifth embodiment.

FIGS. 27 and 28 show an area including a rotor 12 according to a fifth embodiment of the present invention. In this fifth embodiment, the rotor 12 in the above second embodiment is constructed as one having the similar structure to that of a brushless motor.

More specifically, the rotor 12 in this embodiment includes pairs of disk-shaped rotor magnets 12*b* arranged with a spacing left in the axial direction for each pair. The rotor magnet 12*b* of each pair is supported by a plate-shaped back yoke 12*e*. A board 223 serving as a part located opposite to the rotor magnets 12*b* is arranged to lie between the paired rotor magnets 12*b*, and includes a coil 123 disposed in a position corresponding to the paired rotor magnets 12*b*. In the rotor 12 of this embodiment, the rotor 12 including the disk-shaped rotor magnets 12*b* serves itself as an inertia disk, and therefore the rotor inertia disk 12*c* used in the above second embodiment is not provided here.

Further, a tooth profile 12*d* similar to that in the above second embodiment is formed in one of the two back yokes 12*e*. Upon the engaging portion 77 of the reset lever 70 engaging with the tooth profile 12*d*, a rotating force is directly applied to the back yoke 12*e*, i.e., the rotor 12.

This fifth embodiment thus constructed can provide the same advantages as (21) to (31) of the above second embodiment. A power generator having a structure similar to that used in this embodiment is advantageous in leaking a less amount of magnetic flux and producing a less amount of iron loss, but has a large weight or inertia and is inferior in the startup characteristic. As an additional advantage of this embodiment, the startup characteristic of such a power generator can be improved by directly rotating the back yoke 12*e* using the reset lever 70.

Sixth Embodiment

Figure 29:
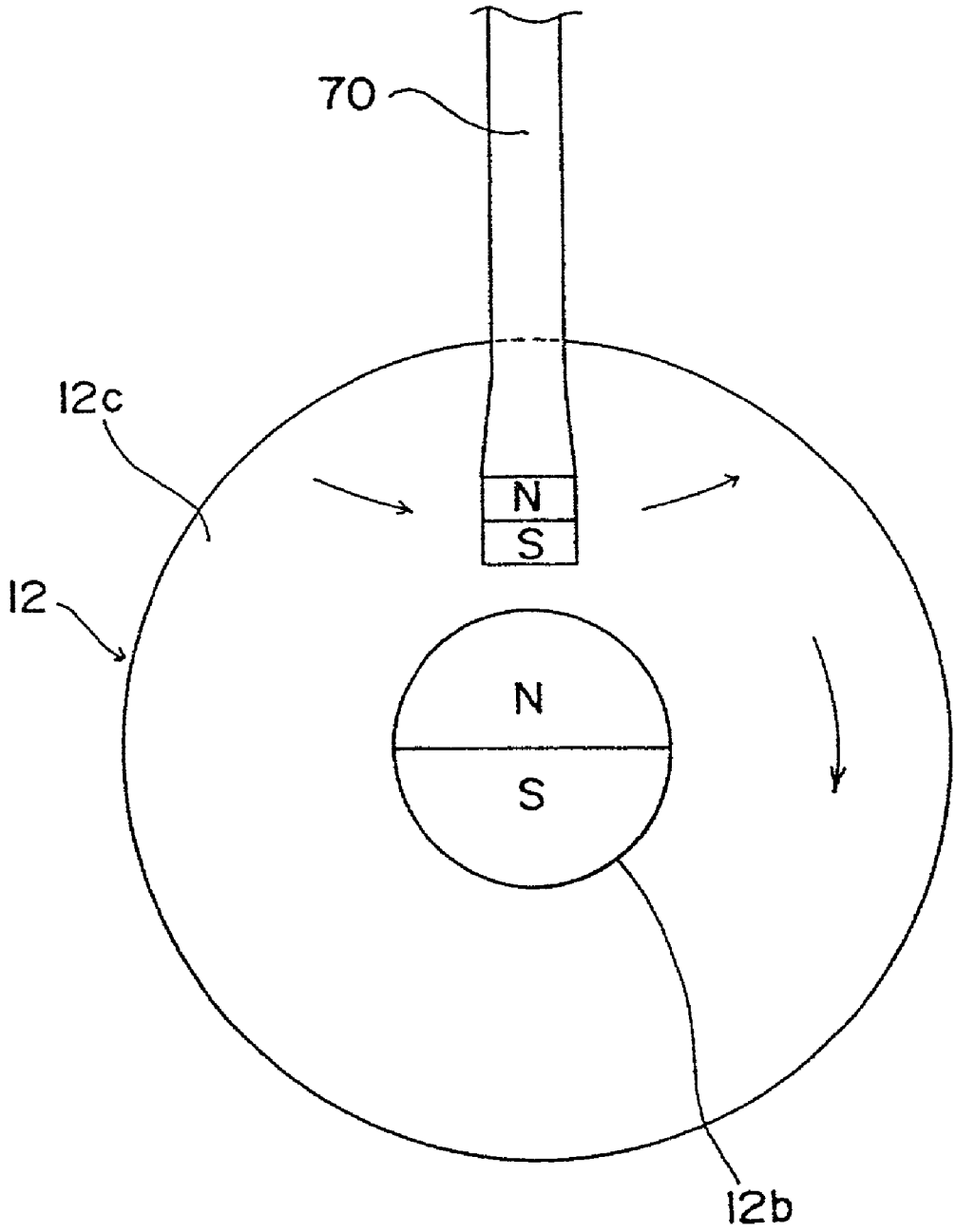
FIG. 29 is a plan view showing principal part of a sixth embodiment of the present invention.

FIG. 29 schematically shows a rotor 12 according to a sixth embodiment of the present invention. While a rotating force is applied to the rotor 12 by bringing the reset lever 70 into direct contact with the rotor inertia disk 12*c* in the above second embodiment, a rotating force is applied to the rotor 12 by utilizing magnetic forces in this sixth embodiment.

More specifically, a magnet moving in response to the manipulation of the crown is disposed at a fore end of the reset lever 70, and the fore end of the reset lever 70 is extended up to a position close to the rotor magnet 12*b*. A rotating force is thus applied to the rotor 12 with magnetic forces acting between the magnet at the fore end of the reset lever 70 and the rotor magnet 12*b*, i.e., through magnetic engagement.

When the fore end of the reset lever 70 is positioned close to the rotor magnet 12*b*, the rotor magnet 12*b* is rotated such that a magnetic pole (e.g., an N pole) of the rotor magnet 12*b* causing attraction forces with respect to a magnetic pole (e.g., a S pole) at the fore end of the reset lever 70 is positioned on the same side as the reset lever 70. Then, when the reset lever 70 is further rotated counterclockwise, the rotor magnet 12*b* is rotated clockwise with the attraction forces acting between them. A rotating force is thereby directly applied to the rotor 12.

In addition to the same advantages as (21), (24) and (26) to (31) of the above second embodiment, this sixth embodiment can provide another advantage (33) that, since a rotating force is directly applied to the rotor 12 by utilizing magnetic forces without bringing the reset lever 70 into direct contact with the rotor 12, it is possible to prevent wears of the reset lever 70 and the rotor 12.

Still another advantage (34) is that, since the rotor magnet 12*b* serves also as a magnet to be disposed on the side of the rotor 12, there is no need of additionally providing a magnet on the side of the rotor 12; hence the cost can be reduced and an increase in weight can be suppressed.

Seventh Embodiment

Figure 30:
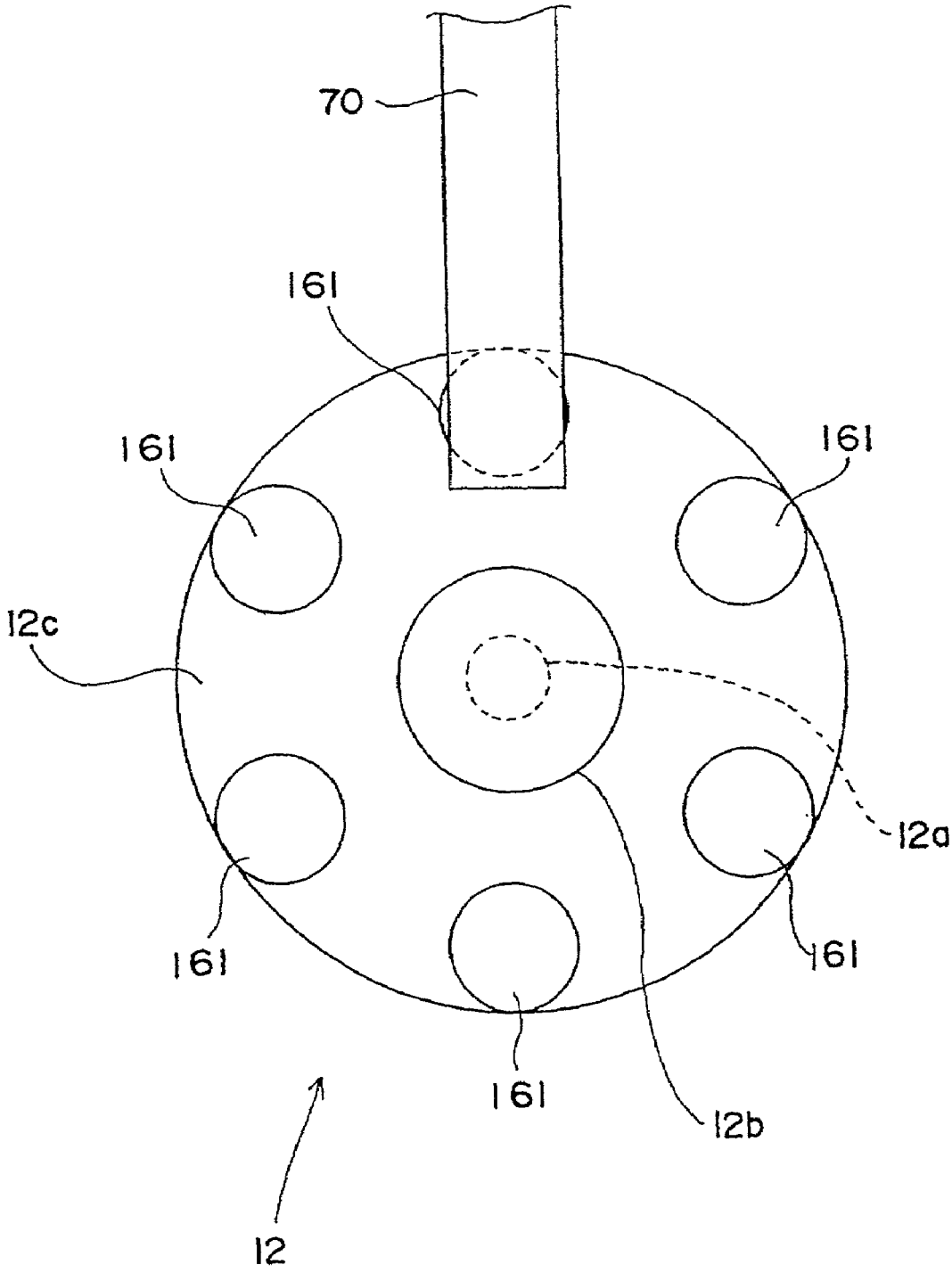
FIG. 30 is a plan view showing principal part of a seventh embodiment of the present invention.
Figure 31:
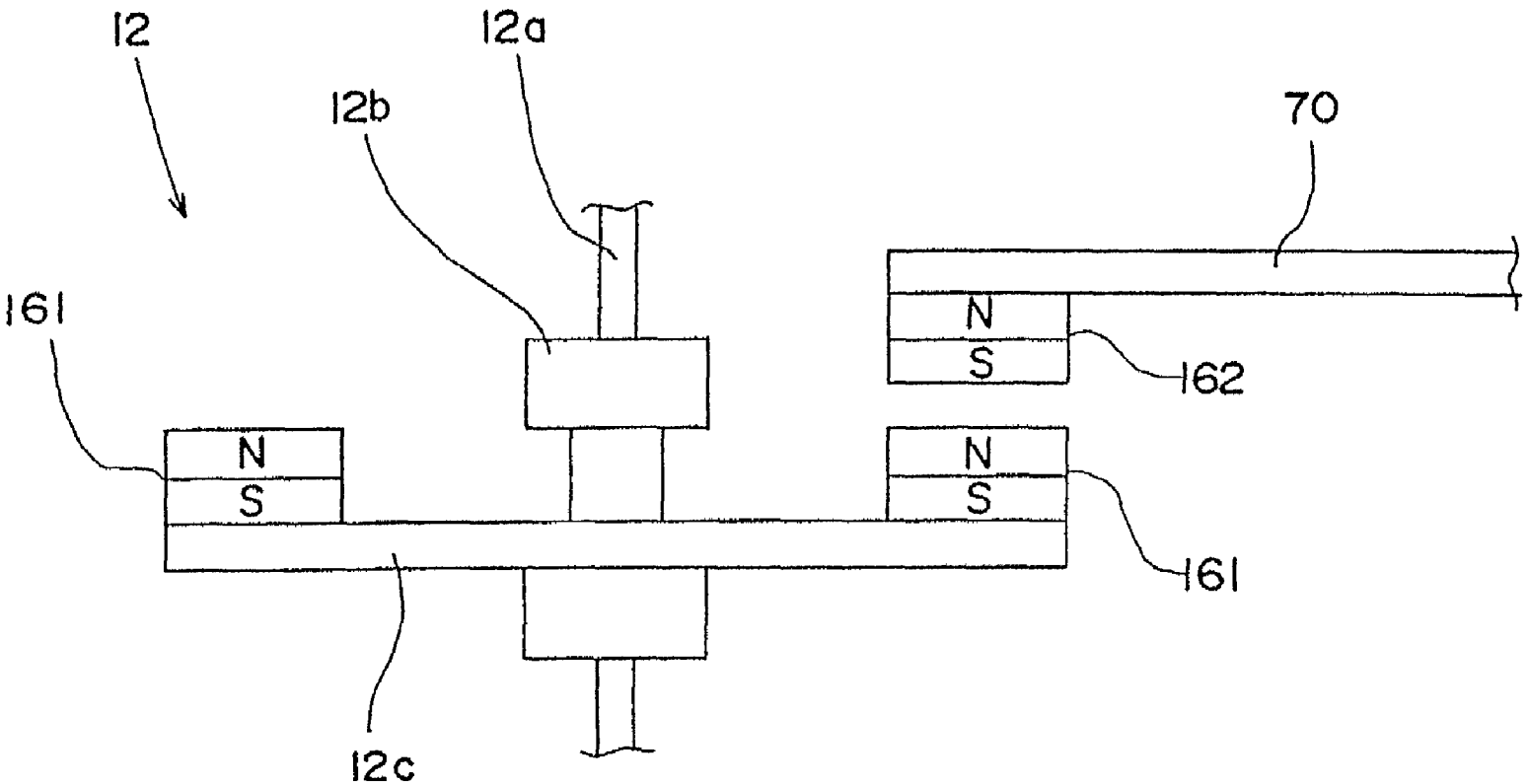
FIG. 31 is a side view showing principal part of the seventh embodiment.

FIGS. 30 and 31 show an area including a rotor 12 according to a seventh embodiment of the present invention. While a rotating force is applied to the rotor 12 by bringing the reset lever 70 into direct contact with the rotor inertia disk 12*c* in the above second embodiment, a rotating force is applied to the rotor 12 in this sixth embodiment by utilizing magnetic forces, i.e., magnetic engagement, as with the above sixth embodiment.

More specifically, a plurality of magnets 161 are arranged on an upper surface (or a lower surface) of the rotor inertia disk 12*c* along its circumferential edge, and the rotor 12 is rotated using the magnets 161 and a magnet 162 disposed at the fore end of the reset lever 70 on the underside thereof. Magnetic poles of the magnet 161 on the side of the reset lever 70 and magnetic poles of the magnet 162 on the side of the rotor inertia disk 12*c* are arranged such that mutually attracting magnetic poles (S and N poles) of both the magnets 161, 162 face each other. Thus, when the fore end of the reset lever 70 is positioned close to the rotor inertia disk 12*c*, both the magnets 161, 162 are attracted to each other and a rotating force is applied to the rotor 12 due to attraction forces produced therebetween.

In addition to the same advantages as (21), (24), (26) to (31), and (33) of the above embodiments, this seventh embodiment can provide another advantage (35) that the reset lever 70 having a magnet is not required to be extended up to a position corresponding to the center of rotation of the rotor 12 unlike the case of using the rotor magnet 12*b* as a magnet on the rotor side; hence flexibility in arrangement of the reset lever 70 can be increased and the efficiency in use of a space can be improved.

It is to be noted that the present invention is not limited to the embodiments described above, but may be constructed in other ways while achieving the objects of the invention, and also involves modifications, etc. as follows.

For example, the startup member (starter 50) comprising the startup spring 60 and the startup-spring operating member (reset lever 70), which is employed in the first and third embodiments, may be used as the starter engaging with the outer peripheral portion of the rotor 12 in the second embodiment.

Conversely, the starter 50 constituted by the reset lever 70 having the engaging portion 77, which is employed in the second embodiment, may be used to rotate the rotation target gear, e.g., the 6th pinion 11*a*, provided in the wheel train serving as a mechanical energy transmitting means.

Thus, it is essential that the starter of the present invention is able to engage with the rotation target gear, the pinion or the rotor 12, of the mechanical energy transmitting means, thereby applying a rotating force to the same.

The startup member for rotating the rotor 12 in the starter for the electromagnetic converter of the present invention has been described as rotating the rotor 12 forward in the rotating direction. Conversely, the startup member may be constructed to rotate the rotor 12 backward in the rotating direction. In this case, the rotor 12 is rotated backward by the startup member, but it is rotated forward in the rotating direction with mechanical energy produced by the spring, for example, immediately after the backward rotation. Stated otherwise, since the rotor 12 held at a standstill is rotated, though in the backward direction, by the startup member, a frictional force imposed on the rotor 12 is reduced from a large value caused by statical friction down to a small value caused by kinetic friction, enabling the rotor to be more easily started up. Accordingly, after the rotating direction of the rotor 12 is changed from the backward direction to the proper forward direction as described above, the rotor rotational speed is quickly increased. Even with the fact that the rotor is initially rotated backward, the startup characteristic of the rotor can be improved as a total effect resulted from using the startup member.

Also, in the above embodiments, the engaging portion 63, 77 engaging with the rotation target gear, e.g., the 6th pinion 11*a* or the rotor 12 (rotor inertia disk 12*c*), is moved in the tangential direction of the 6th pinion 11*a* or the rotor inertia disk 12*c*. However, the moving direction of the engaging portion 63, 77 may be not exactly in the tangential direction, but substantially in the tangential direction. In other words, the engaging portion 63, 77 may also be moved in any direction deviated from the tangential direction within the range of a inclination defined by an angle (frictional angle) corresponding to the coefficient of friction in a contact area between the engaging portion 63, 77 and the rotor inertia disk 12*c*. If the moving direction of the engaging portion 63, 77 is within the range of the substantially tangential direction, a similar working effect to that in the case of moving the engaging portion 63, 77 exactly in the tangential direction can be obtained. It is however most preferable that the moving direction is set to the tangential direction as with the above embodiments.

Figure 32:
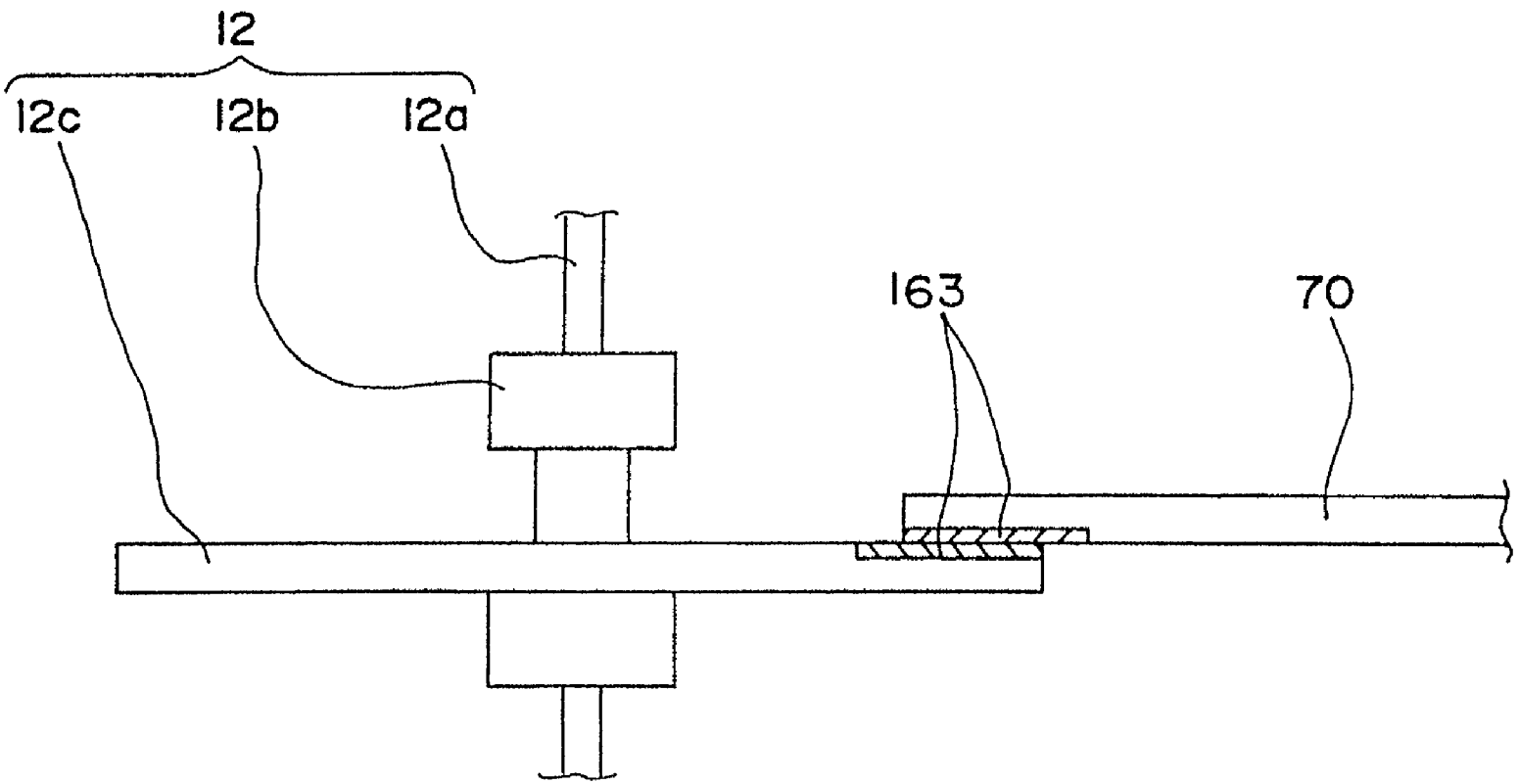
FIG. 32 is a side view showing principal part of a modification of the present invention.

Further, in the second embodiment, the structure for realizing contact between the rotor inertia disk 12*c* and the reset lever 70 is not limited to a combination of the tooth profile 12*d* and the engaging portion 77 to realize the contact. For example, a rotating force may be applied using a frictional force, as shown in FIG. 32, by bringing the fore end of the reset lever 70 into contact with an upper surface of the rotor inertia disk 12*c* while non-slip members 163, such as rubber materials, are provided on contact areas of the reset lever 70 and the rotor inertia disk 12*c*. Other than providing the non-slip members 163, the contact areas of the reset lever 70 and the rotor inertia disk 12*c* may be processed to have roughness by etching, discharge machining, cutting, etc. so that a rotating force is applied using a frictional force, etc. produced by the processed contact areas.

Likewise, when the reset lever 70 is engaged with the pinion 11*a*, a frictional force may be instead utilized for engagement between them. In such a case of utilizing a frictional force, it is also preferable that the rotating force be applied in the tangential direction of the rotor 12 or the pinion 11*a*. However, the direction of applying the rotating force is not necessarily set to the tangential direction.

In the case of applying the rotating force to the rotation target gear, the pinion or the rotor through magnetic engagement as with the above sixth and seventh embodiments, it is also preferable that the rotating force be applied in the tangential direction of the gear or the rotor. However, the direction of applying the rotating force is not necessarily set to the tangential direction.

Figure 33:
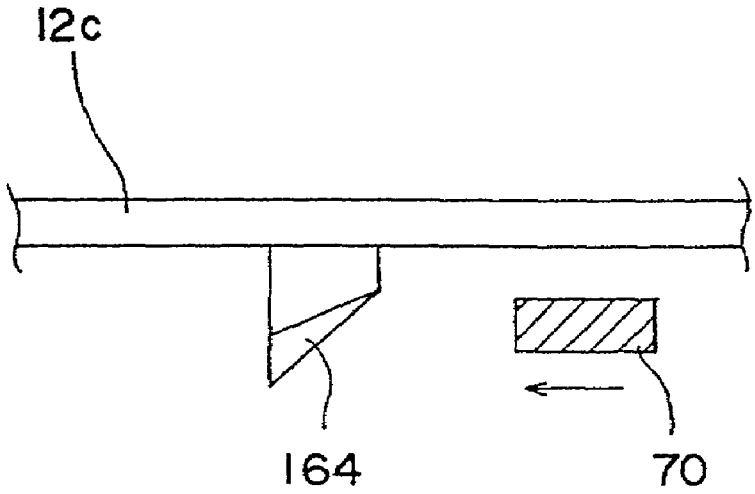
FIG. 33 is a schematic side view showing principal part of another modification of the present invention.
Figure 33:
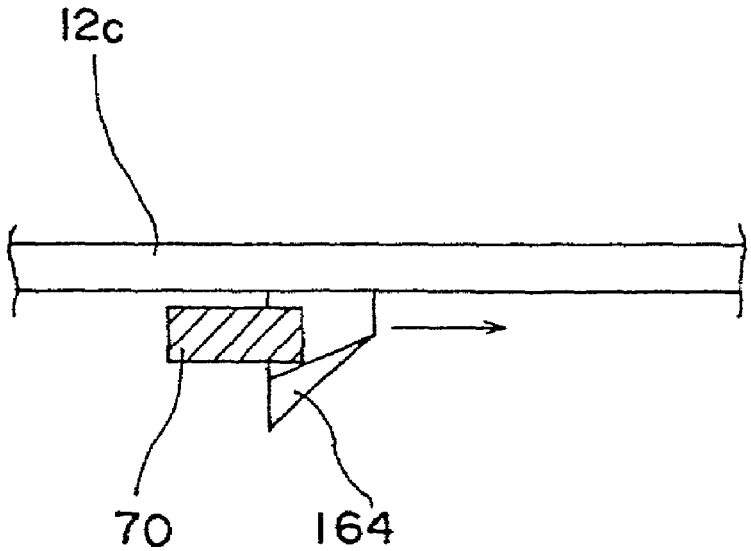

The structure for engaging the reset lever 70 may be constructed as shown in FIG. 33. More specifically, an elastic member 164 is provided at a circumferential edge of the rotor inertia disk 12*c* such that the elastic member 164 has a distal end formed to space from the upper (or lower) surface of the rotor inertia disk 12*c* by a predetermined distance (FIG. 33(A)). For engaging the reset lever 70 with the rotor inertia disk 12*c*, the reset lever 70 is rotated such that the fore end of the reset lever 70 rides over the elastic member 164. Thus, as shown in FIG. 33(B), the fore end of the reset lever 70 comes into abutment with the rear side of the elastic member 164 for engagement between the reset lever 70 and the rotor inertia disk 12*c*. For returning the reset lever 70 to the original position, the reset lever 70 is rotated in a direction opposite to the direction of engaging the same so as to pass a spacing between the elastic member 164 and the rotor inertia disk 12*c*.

The rotation target gear in the first and third embodiments is not limited to the 6th pinion 11*a*, but may be other gear such as the 6th wheel 11 or the 5th wheel 10. Taking into account the amount of rotation of the rotor 12 and the force to be applied to the rotation target gear, however, the rotation target gear is preferably the 6th wheel 11 just one step before the rotor 12 as described in the above embodiments, and the rotating force is preferably applied to the 6th pinion 11*a* for more surely establishing the engagement between the startup spring 60 and the rotation target gear.

The startup spring 60 is not limited to a leaf spring used in the above embodiments, but may be other type of spring. Further, while the startup spring 60 is fixed to the rotatable pin 61 in the first embodiment, it may be directly fixed to the main plate 2 as with the third embodiment. However, the use of the pin 61 is advantageous in that the initial position of the startup spring 60 can be adjusted later to change the setting of the rotating force.

The reset lever 70 in the first and third embodiments may be formed to have only the startup-spring biasing portion 74 with omission of the latch portion 73.

Further, the external operating member is not limited to the crown. For example, when a hand setting button is separately provided, the button may be used as the external operating member. In this case, it is just required that the starter (rotation driving means) 50 be operated in interlock with the operation of pushing the button. Using the crown as the external operating member, however, is advantageous in that operability is improved because the starter can be operated in interlock with the operation for return from the hand setting.

While the switch 131 and the capacitor 132 are provided in the above embodiments, these components may be omitted with only the capacitor 130 provided. In such a case, the capacitor 130 may have a small capacity as with the above embodiments so that the capacitor 130 is charged with the power only from the power generator 20 after the hand setting and the IC 151 is then started up. Alternatively, the capacitor 130 may have a large capacity so that the IC 151 is continuously driven by the capacitor 130 even during the hand setting.

In the above embodiments, the rotating force enough to rotate the rotor 12 at the reference speed is applied by the engaging portion 63 of the startup spring 60 or the engaging portion 77 of the reset lever 70. However, it is not always required to apply the rotating force enough to rotate the rotor 12 at the reference speed. Thus, the startup spring 60 or the reset lever 70 is required to apply the rotating force in such a proper range as not causing a problem that the rotating force is too great to brake the same, or that the rotating force is too small to rotate the rotor 12.

The construction for directly applying the rotating force to the rotor is not limited to those described in the above embodiments, but may be modified so long as the rotating force can be directly applied to the rotor by the startup member for rotating the rotor.

While the tooth profile and the rotor magnet are arranged to be out of phase in the fourth embodiment, the present invention is not limited to such an arrangement. For example, the tooth profile and the rotor magnet may be arranged in phase with each other. By arranging the tooth profile and the rotor magnet to be out of phase so that the rotor 12 is restricted to a position offset from the statically stable position, however, an advantage is obtained in that the effect of cogging torque at the startup is reduced and a required startup torque to be applied by the reset lever 70 can be reduced to a smaller value. Also, in the sixth and seventh embodiments using magnets, the layout position of the magnets and the position of the reset lever 70 may be adjusted so that the rotor magnet 12*b* is offset from the statically stable position.

Since the force applied to the rotor 12 by the reset lever 70 does not vary so much, the slip mechanism is not necessarily required between the rotor's rotating shaft and the rotor inertia disk 12*c*.

While the reset lever 70 is engaged with the outer peripheral portion of the rotor inertia disk 12*c* in the second embodiment, it may be engaged with the rotor pinion 12*a*, for example. This modification is advantageous in that, because a gear usable as the engaged portion is already formed on the rotor pinion 12*a*, there is no need of additionally forming a tooth profile unlike the case of forming the tooth profile 12*d* of the rotor inertia disk 12*c*. Because of the rotor pinion 12*a* having a small radius, however, a greater force must be applied from the reset lever 70 and the rigidity of the reset lever 70 must be increased. Using the reset lever 70 in the same way as in the second embodiment provides an advantage that the rigidity required for the reset lever 70 can be reduced to a comparatively small value and the reset lever 70 can be formed of a comparatively thin member, thus resulting in the reduced weight and easier arrangement of the reset lever 70.

Electromagnetic converters to which the present invention is applied are not limited to the power generator 20 in the above embodiments, but may include a motor as another example. The motor may be of the type having a similar structure to that used in the first to fourth embodiments, or the type having a similar structure to that used in the fifth embodiment.

Timepiece to which the present invention is applied are not limited to an electronically controlled mechanical watch, but may include other various types of timepieces, such as wristwatches, table clocks, and clocks, including various types of power generators; e.g., a self-winding, self-generating watch wherein electric power is generated upon movement of a rotating weight. Further, since the starter for the electromagnetic converter according to the present invention can also be utilized as a starter for a motor, the present invention is also applicable to a timepiece wherein hands are driven by a stepping motor or the like energized with an electrical energy source such as a button-type battery or a solar battery.

Moreover, the starter for the electromagnetic converter according to the present invention is not limited to timepieces in application, but is also applicable to equipment and power generating units which incorporate various types of dynamos and motors, such as a portable hemomanometer, cellular phone, pager, pedometer, electronic calculator, portable personal computer, electronic notepad, portable radio, music box, metronome, and electric shavers. Thus, the present invention can be applied to various equipment including electromagnetic converter such as power generators and motors.

The mechanical energy source is not limited to a coiled spring, but may be a rubber, another type of spring, weight, etc. In other words, the mechanical energy source can be appropriately selected depending on the target to which the present invention is applied.

Additionally, the mechanical energy transmitting device for transmitting mechanical energy from the mechanical energy source, e.g., the mainspring, to the rotor of the power generator is not limited to the wheel train (gears) in the above embodiments, but may be implemented by using a friction pulley, belt and pulley, chain and sprocket wheel, rack and pinion, cam, etc. In other words, the mechanical energy transmitting device can be appropriately selected depending on the types of equipment to which the present invention is applied.

INDUSTRIAL APPLICABILITY

According to the present invention, as described above, a startup member is employed which has an engaging portion mechanically engaging with an engaged portion of a rotation target gear, a pinion or a rotor of mechanical energy transmitting means. As compared with a conventional starter utilizing a frictional force, therefore, a mechanical rotating force can be more efficiently applied to the rotation target gear, the pinion or the rotor with higher stability.

Also, by applying a mechanical rotating force to the rotation target gear, the pinion or the rotor with only a resilient force of a startup spring, the mechanical rotating force can be applied to the gear, the pinion or the rotor with even higher stability.

Further, by applying a mechanical rotating force to the rotation target gear, the pinion or the rotor by moving the engaging portion, which engages with the gear, the pinion or the rotor, substantially in the tangential direction of the gear, the pinion or the rotor, the efficiency in rotating the gear, the pinion or the rotor by the startup spring is increased, whereby the rotation target gear, the pinion or the rotor can be rotated with improved stability.

Moreover, when a rotating force is directly applied to the rotor, an increase in speed error due to speed-up through the wheel train is avoided unlike the case of applying a rotating force to the wheel train, and hence the rotor can be rotated at a predetermined speed. Accordingly, the rotational speed of the rotor can be easily stabilized and a time lapsed until the start of driving of an IC can be made constant. It is therefore possible to eliminate an error in setting of the correct time by adding a preset compensation value, and manage the indication of time with high accuracy.

What is claimed is:

1. A timepiece, comprising:

a mechanical energy source;

an electric power generator driven by the mechanical energy source for outputting electrical energy, the electric power generator including a rotor;

a rotation controller operated with the electrical energy generated by the electric power generator;

hands driven under control of the rotation controller; and a starter for the electric power generator, the starter comprising:

a startup member having an engaging portion capable of mechanically engaging with an engaged portion of a rotation target gear of the mechanical energy source, wherein the engaging portion is moved in response to operation of an external operating member to temporarily apply a rotating force to the rotation target gear, while the engaging portion is in engagement with the engaged portion, whereby the rotor is rotated at an increased speed upon start up of the electric power generator, wherein the rotating force temporarily applied to the rotation target gear in response to operation of the external operating member does not vary substantially regardless of the force applied to the external operating member, and is set to such a magnitude as to cause the rotor of the electric power generator to be started up at a reference speed.

2. The timepiece according to claim 1, further comprising:

an electricity accumulator, selectively connectable to the rotation controller through a mechanical switch, that is able to accumulate the electrical energy outputted from the electric power generator;

wherein the mechanical switch is turned off in response to a first operation of the external operating member to disconnect the electricity accumulator from the rotation controller, and is turned on in response to a second operation of the external operating member to supply the electrical energy from the electricity accumulator to the rotation controller.

3. The timepiece according to claim 1, wherein, in biasing the startup spring, the engaging portion thereof is moved substantially in a tangential direction relative to a peripheral portion of the rotation target gear.

4. A timepiece, comprising:

a mechanical energy source;

a transmission wheel train for transmitting mechanical energy from the mechanical energy source;

hands driven by the transmission wheel train for indicating the time of day;

an electric power generator including a rotor rotated through the transmission wheel train for outputting electrical energy;

an electricity accumulator for accumulating an electromotive force generated by the electric power generator; and a rotation controller operated by the electricity accumulator, the rotation controller including a reference-signal output circuit for outputting a reference signal, and a comparison-and-control signal output circuit for detecting a cycle of the rotor of the electric power generator, comparing the detected cycle with the reference signal, and outputting a comparison and control signal; and a starter for the electric power generator, wherein the starter temporarily applies a rotating force that acts on the transmission wheel train or the rotor in response to operation of an external operating member, wherein the rotating force temporarily applied to the transmission wheel train or the rotor in response to operation of the external operating member does not vary substantially regardless of the force applied to the external operating member, and is set to such a magnitude as to cause the rotor of the electric power generator to be started up at a reference speed.

5. A timepiece, comprising:

an electrical energy source;

an electric power generator driven by the electrical energy source for outputting mechanical energy, the electric power generator comprising a rotor and mechanical energy transmitting means;

a rotation controller operated with electrical energy from the electrical energy source;

hands driven under control of the rotation controller; and a starter for the electric power generator, the starter comprising a startup member having an engaging portion capable of mechanically engaging with an engaged portion of a rotation target gear of the mechanical energy transmitting means, wherein the engaging portion is moved in response to operation of an external operating member to temporarily apply a rotating force to the rotation target gear, while the engaging portion is in engagement with the engaged portion, whereby the rotor is rotated at an increased speed upon start up of the electric power generator, wherein the rotating force temporarily applied to the rotation target gear in response to operation of the external operating member does not vary substantially regardless of the force applied to the external operating member, and is set to such a magnitude as to cause the rotor of the electric power generator to be started up at a reference speed.

6. A timepiece, comprising:

a mechanical energy source;

a transmission wheel train for transmitting mechanical energy from the mechanical energy source;

hands driven by the transmission wheel train for indicating the time of day;

an electric power generator including a rotor rotated through the transmission wheel train for outputting electrical energy;

an electricity accumulator for accumulating an electromotive force generated by the electric power generator; and a rotation controller operated by the electricity accumulator, the rotation controller including a reference-signal output circuit for outputting a reference signal, and a comparison-and-control signal output circuit for detecting a cycle of the rotor of the electric power generator, comparing the detected cycle with the reference signal, and outputting a comparison and control signal; and a starter comprising a startup spring having an engaging portion capable of mechanically engaging with an engaged portion of a rotation target gear of the transmission wheel train, and a startup-spring operating member comprising a latch portion capable of engaging with the rotation target gear to stop rotation thereof and a startup-spring biasing portion for biasing the startup spring by a predetermined amount, wherein the startup-spring operating member is adapted to bias the startup spring so as to engage the engaging portion thereof with the engaged portion of the rotation target gear and to cause the latch portion to engage with the rotation target gear, in response to a first operation of the external operating member, to temporarily apply a rotating force to the rotation target gear, while the engaging portion is in engagement with the engaged portion and the latch portion is in engagement with the rotation target gear, whereby the rotor is rotated at an increased speed upon startup of the electric power generator, and release the startup spring from a biased state to return the startup spring to an original position in response to a second operation of the external operating member.

7. A timepiece, comprising:

a mechanical energy source;

a transmission wheel train for transmitting mechanical energy from the mechanical energy source;

hands driven by the transmission wheel train for indicating the time of day;

an electric power generator including a rotor rotated through the transmission wheel train for outputting electrical energy;

an electricity accumulator for accumulating an electromotive force generated by the electric power generator; and a rotation controller operated by the electricity accumulator, the rotation controller including a reference-signal output circuit for outputting a reference signal, and a comparison-and-control signal output circuit for detecting a cycle of the rotor of the electric power generator, comparing the detected cycle with the reference signal, and outputting a comparison and control signal; and a starter comprising a startup spring having an engaging portion capable of mechanically engaging with a pinion of a gear of the transmission wheel train, the gear being directly coupled to the rotor, and a startup-spring operating member comprising a latch portion capable of engaging with the pinion to stop rotation thereof and a startup-spring biasing portion for biasing the startup spring by a predetermined amount, wherein the startup-spring operating member is adapted to bias the startup spring so as to engage the engaging portion thereof with the engaged portion of the pinion and to cause the latch portion to engage with the pinion, in response to a first operation of the external operating member, to temporarily apply a rotating force to the pinion, while the engaging portion is in engagement with the engaged portion and the latch portion is in engagement with the pinion, whereby the rotor is rotated at an increased speed upon startup of the electric power generator, and release the startup spring from a biased state to return the startup spring to an original position in response to a second operation of the external operating member.

* * * * *